US011072866B2

(12) United States Patent
Iimori et al.

(10) Patent No.: US 11,072,866 B2
(45) Date of Patent: Jul. 27, 2021

(54) PLATED MATERIAL AND MANUFACTURING METHOD THEREFOR

(71) Applicant: YKK Corporation, Tokyo (JP)

(72) Inventors: Masayuki Iimori, Toyama (JP); Ryosuke Takeda, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/493,539

(22) PCT Filed: Apr. 3, 2018

(86) PCT No.: PCT/JP2018/014318
§ 371 (c)(1),
(2) Date: Sep. 12, 2019

(87) PCT Pub. No.: WO2018/190202
PCT Pub. Date: Oct. 18, 2018

(65) Prior Publication Data

US 2020/0032410 A1 Jan. 30, 2020

(30) Foreign Application Priority Data

Apr. 14, 2017 (WO) ..... PCT/JP2017/015365
May 11, 2017 (WO) ..... PCT/JP2017/017949

(51) Int. Cl.
*C25D 7/02* (2006.01)
*C25D 3/56* (2006.01)
(Continued)

(52) U.S. Cl.
CPC ..... *C25D 5/10* (2013.01); *C25D 3/56* (2013.01); *C25D 3/58* (2013.01); *C25D 3/60* (2013.01);
(Continued)

(58) Field of Classification Search
CPC ... C25D 5/10; C25D 3/58; C25D 3/60; C25D 5/006; C25D 3/56; C25D 7/02; C25D 17/16; A44B 19/26
See application file for complete search history.

(56) References Cited

U.S. PATENT DOCUMENTS 4,908,106 A 3/1990 Takeshima
5,911,865 A 6/1999 Yih
(Continued)

FOREIGN PATENT DOCUMENTS

CN 101954618 A 1/2011
JP H01-139799 A 6/1989
(Continued)

OTHER PUBLICATIONS

International Preliminary Report on Patentability, PCT Application No. PCT/JP2018/014318, dated Oct. 24, 2019.
(Continued)

*Primary Examiner* — Daniel J. Schleis
*Assistant Examiner* — Kevin Ct Li
(74) *Attorney, Agent, or Firm* — Kilpatrick Townsend & Stockton LLP

(57) ABSTRACT

An electroplated article includes a base member that includes one or more base member-metallic elements; and an electroplated layer that is formed directly on the base member. The electroplated layer includes at least a first electroplated layer-metallic element and a second electroplated layer-metallic element that is different from the first electroplated layer-metallic element. The second electroplated layer-metallic element is a metallic element that is identical to at least one of the one or more base member-metallic elements. A ratio of the second electroplated layer-metallic element in the electroplated layer is continuously decreased as being away from the base member in the
(Continued)

5 thickness direction of the electroplated layer. Alloy grains including at least the first and second electroplated layer-metallic elements are distributed in the electroplated layer such that a clear interface is not formed between the base member and the electroplated layer.

17 Claims, 27 Drawing Sheets

(51) Int. Cl.

| | |
|---|---|
| ***C25D 5/10*** | (2006.01) |
| ***C25D 17/16*** | (2006.01) |
| ***C25D 3/58*** | (2006.01) |
| ***C25D 3/60*** | (2006.01) |
| ***C25D 5/00*** | (2006.01) |
| *A44B 19/26* | (2006.01) |

(52) U.S. Cl.
CPC ..... *C25D 5/006* (2013.01); *C25D 7/02* (2013.01); *C25D 17/16* (2013.01); *A44B 19/26* (2013.01)

(56) References Cited

U.S. PATENT DOCUMENTS

| | | | | |
|---|---|---|---|---|
| 6,010,610 | A | 1/2000 | Yih | |
| 2003/0178313 | A1 | 9/2003 | Tanaka et al. | |
| 2005/0211461 | A1 | 9/2005 | Horikoshi et al. | |
| 2008/0316715 | A1 | 12/2008 | Fujii | |
| 2009/0145772 | A1 | 6/2009 | Zhang et al. | |
| 2012/0245019 | A1 | 9/2012 | Adzic | |
| 2013/0282917 | A1 | 10/2013 | Reznik et al. | |
| 2014/0017512 | A1* | 1/2014 | Iimori ..... | C25D 5/10 428/652 |
| 2016/0024663 | A1 | 1/2016 | Lomasney | |
| 2017/0321341 | A1 | 11/2017 | Hasegawa | |

FOREIGN PATENT DOCUMENTS

| | | | | |
|---|---|---|---|---|
| JP | H07-011479 | A | | 1/1995 |
| JP | H07-173690 | A | | 7/1995 |
| JP | 11-350199 | A | | 12/1999 |
| JP | 11350199 | A | * | 12/1999 |
| JP | 2002-042556 | A | | 2/2002 |
| JP | 2002042556 | A | * | 2/2002 |
| JP | 2009-171472 | A | | 7/2009 |
| JP | 2010-236068 | A | | 10/2010 |
| JP | 4725051 | A | | 7/2011 |
| JP | 2012-62566 | A | | 3/2012 |
| JP | 2012-087388 | A | | 5/2012 |
| JP | 2013-119650 | A | | 6/2013 |
| JP | 2014-019953 | A | | 2/2014 |
| JP | 2014-070265 | A | | 4/2014 |
| JP | 2015-063711 | B2 | | 4/2015 |
| JP | 2015-518350 | A | | 6/2015 |
| JP | 5741944 | B2 | | 7/2015 |
| JP | 2016-084492 | A | | 5/2016 |
| KR | 2007-0037494 | A | | 4/2007 |
| WO | 2013/141166 | A1 | | 9/2013 |
| WO | 2016/075828 | A1 | | 5/2016 |

OTHER PUBLICATIONS

Office Action, Japanese Patent Application No. 2019-512458, dated Apr. 14, 2020.
International Search Report, PCT Application No. PCT/JP2018/014318, dated Jul. 10, 2018.
International Search Report, PCT Application No. PCT/JP2017/015365, dated May 16, 2017.
International Search Report, PCT Application No. PCT/JP2017/017949, dated Jun. 6, 2017.
Kaoru Aotani, Kinzoku Hyomen Kogyo Zensho Kinsoku no Mekkki (2) Gokin Mekki, first edition, Maki Shoten, 1966, p. 176.
Office Action, Pakistani Patent Application No. 229/2018, dated Oct. 31, 2019, 2 pages.
Office Action, Korean Patent Application No. 2019-7018582, dated Dec. 8, 2020, 10 pages.
European Supplementary Search Report, European Patent Application No. 17905121.4, dated Dec. 11, 2020, 9 pages.
Office Action, Korean Patent Application No. 2019-7018583, dated Oct. 21, 2020.
Non-Final Office Action, U.S. Appl. No. 16/495,733, dated Nov. 17, 2020.
Extended European Search Report, European Patent Application No. 18784523.5, dated Jan. 18, 2021, 8 pages.
U.S. Appl. No. 16/495,733 , Final Office Action, dated Jan. 27, 2021, 10 pages.
U.S. Appl. No. 16/495,733, Non-Final Office Action, dated Apr. 30, 2021, 14 pages.

* cited by examiner

Fig. 37
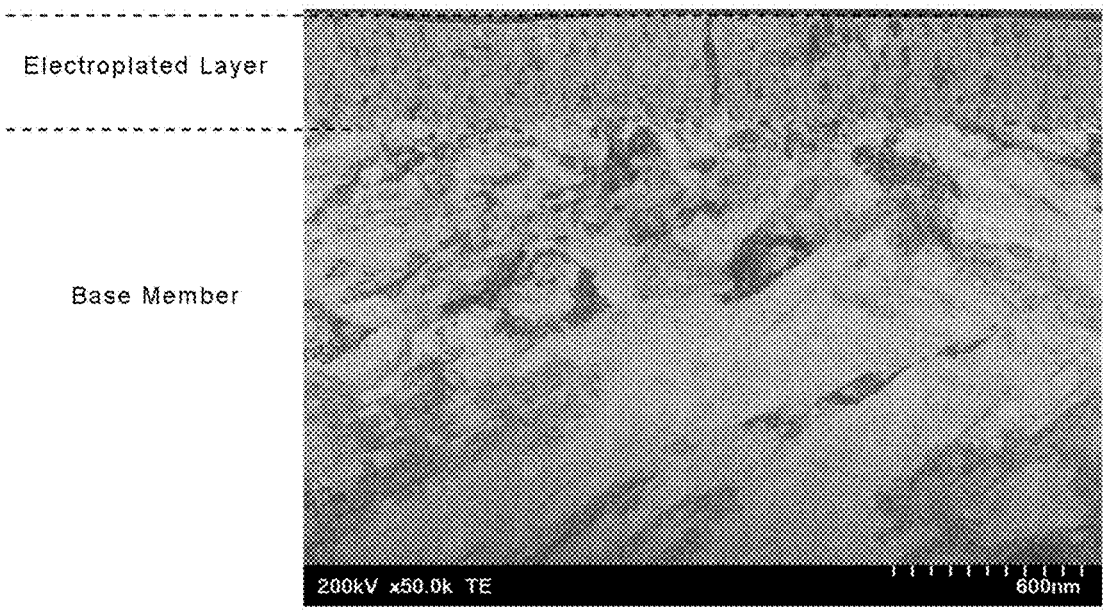
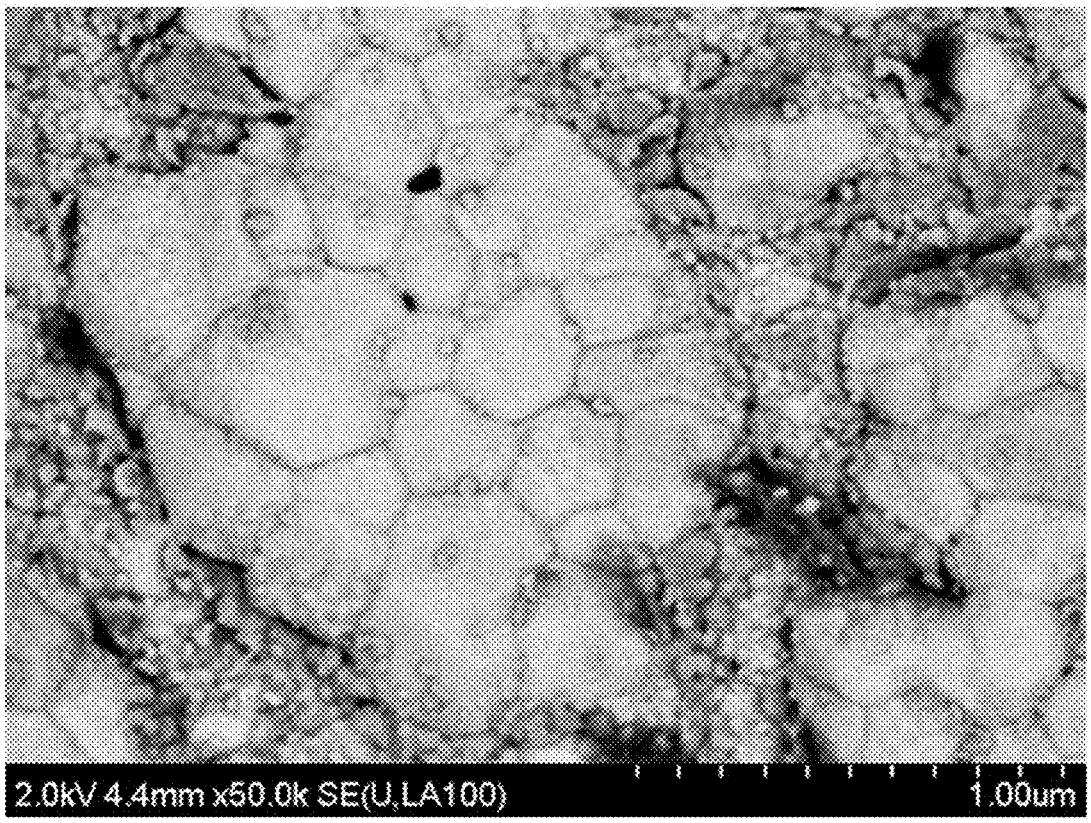
Fig. 38

PLATED MATERIAL AND MANUFACTURING METHOD THEREFOR

TECHNICAL FIELD

The present disclosure is related to electroplated articles and a method of manufacturing the same.

BACKGROUND ART

As disclosed in patent literature 1, a barrel plating has been known as a method of electroplating a number of members at once.

PATENT LITERATURE

[PTL 1] Japanese Patent Application Laid-open No. 1-139799

SUMMARY

Technical Problem

In a barrel plating, there is a problem of insufficient cohesion between an electroplated layer and a base member due to an interface between the electroplated layer and the base member.

Solution to Problem

An electroplated article according to an aspect of the present disclosure may include:

a base member that includes one or more base member-metallic elements; and an electroplated layer that is formed directly on the base member, the electroplated layer including at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, a ratio of the second electroplated layer-metallic element in the electroplated layer is continuously decreased as being away from the base member in the thickness direction of the electroplated layer, and alloy grains including at least the first and second electroplated layer-metallic elements are distributed in the electroplated layer such that a clear interface is not formed between the base member and the electroplated layer.

In some embodiments, a clear interface between the base member and the electroplated layer is not observed in a TEM (Transmission Electron Microscope) image of the electroplated layer.

In some embodiments, the electroplated layer may include a region where the grains each having a width equal to or less than 100 nm or 50 nm gather densely.

In some embodiments, the electroplated layer may include a grain that has a width equal to or less than 25 nm.

In some embodiments, the grain having a width equal to or less than 25 nm may be observed in a TEM image that shows an arrangement of metal atoms.

In some embodiments, the grain having a width equal to or less than 25 nm may be formed in an initial growth region in the electroplated layer.

In some embodiments, the initial growth region may be a region located within 50 nm from a region that shows an arrangement of metal atoms of the base member in the TEM image.

In some embodiments, when a rectangular frame is applied to a grain observed in a TEM image of the electroplated layer and a value of half of area of the rectangular frame is determined as an area of the grain, an average area of the grains in the TEM image of the electroplated layer may be equal to or less than 1000 $nm^2$.

In some embodiments, the average area of the grains in the TEM image of the electroplated layer may be equal to or less than 500 $nm^2$.

In some embodiments, when a rectangular frame is applied to a grain observed in a TEM image of the electroplated layer and a value of half of area of the rectangular frame is determined as an area of the grain, a maximum area of the grain in the TEM image of the electroplated layer may be equal to or less than 1000 $nm^2$ or 700 $nm^2$.

In some embodiments, the electroplated layer may not include coarse grains which will be included in an electroplated layer formed through a barrel-plating.

In some embodiments, the coarse grain may have a width greater than 150 nm or 100 nm.

In some embodiments, a result of X-ray diffraction of the electroplated layer may show a diffraction peak shifted from a diffraction peak angle identified based on ICDD card of an alloy having the same composition as the alloy included in the electroplated layer.

In some embodiments, a thickness of a portion of the electroplated layer where the ratio of the second electroplated layer-metallic element is continuously decreased as being away from the base member in the thickness direction of the electroplated layer may be equal to or greater than 10 nm or 20 nm or 60 nm.

In some embodiments, a thickness of a portion of the electroplated layer where the ratio of the second electroplated layer-metallic element is continuously decreased as being away from the base member in the thickness direction of the electroplated layer may be equal to or less than 80 nm or 60 nm or 30 nm or 20 nm.

In some embodiments, a ratio of the first electroplated layer-metallic element at a surface of the electroplated layer may be less than 100% or 90%.

In some embodiments, a thickness of the electroplated layer may be equal to or less than 150 nm or 100 nm.

In some embodiments, the electroplated layer may have an opposite surface that is opposite to the base member, and decrease of the ratio of the second electroplated layer-metallic element in the electroplated layer continues up to the opposite surface or to proximity of the opposite surface in the thickness direction of the electroplated layer.

In some embodiments, the base member may include a plurality of base member-metallic elements, and the electroplated layer may include a plurality of second electroplated layer-metallic elements, and ratio of each second electroplated layer-metallic element in the electroplated layer may be continuously decreased as being away from the base member in the thickness direction of the electroplated layer.

In some embodiments, a ratio of the first electroplated layer-metallic element in the electroplated layer may be decreased as being closer to the base member in the thickness direction of the electroplated layer.

In some embodiments, the base member may be a metal or an alloy at least including copper as the base member-metallic element.

In some embodiments, the electroplated layer may be a metal or an alloy at least including tin as the first electroplated layer-metallic element.

In some embodiments, the electroplated layer may have an opposite surface that is opposite to the base member, and particle-like portions and/or nubby portions may be two-dimensionally densely formed in the opposite surface.

In some embodiments, the electroplated article may be at least a part of a costumery part.

A method of manufacturing electroplated articles according to an aspect of the present disclosure may include:

a step of supplying, into an electroplating tank, base members each of which including one or more base member-metallic elements; and a step of flowing the base members in a circumference direction and electroplating the base members in the electroplating tank so that an electroplated layer is formed directly on the base member, the electroplated layer including at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, a ratio of the second electroplated layer-metallic element in the electroplated layer is continuously decreased as being away from the base member in the thickness direction of the electroplated layer, and alloy grains including at least the first and second electroplated layer-metallic elements are distributed in the electroplated layer such that a clear interface is not formed between the base member and the electroplated layer.

An electroplated article according to an aspect of the present disclosure may include:

a base member that includes one or more first metallic elements: and an electroplated layer that is formed directly on the base member (51), the electroplated layer including at least a second metallic element and a third metallic element that is different from the second metallic element, wherein the third metallic element is a metallic element that is identical to at least one of the one or more first metallic elements, a ratio of the third metallic element in the electroplated layer is continuously decreased as being away from the base member in the thickness direction of the electroplated layer, and alloy grains including at least the second and third metallic elements are distributed in the electroplated layer such that a clear interface is not formed between the base member and the electroplated layer.

Advantageous Effects of Invention

According to an aspect of the present disclosure, it would be possible to provide electroplated articles with improved cohesion between electroplated layer and base member.

BRIEF DESCRIPTION OF DRAWINGS

FIG. 37 is a TEM image (Magnification is 50,000×, and Size of field is 2.5 μm*1.8 μm) showing a cross-section of a conventional electroplated article.

FIG. 38 is a SEM image (Magnification is 50,000×, and Size of field is 2.5 μm*1.8 μm) showing a surface of an electroplated layer of an electroplated article identical to that shown in FIG. 37.

DESCRIPTION OF EMBODIMENTS

Hereinafter, non-limiting exemplary embodiments of the present invention will be described with references to FIGS. 1 to 38. A skilled person would properly combine the respective exemplary embodiments and/or respective features without requiring excess descriptions. A skilled person would also understand synergic effect by such combination. Overlapping descriptions among exemplary embodiments will be basically omitted. Referenced drawings are mainly for the purpose of illustrating an invention and may possibly be simplified for the sake of convenience of illustration.

A plurality of features described below in relation to an electroplated article and/or a method of manufacturing electroplated articles may be understood as, additionally to a combination of features, an individual feature which is independent to other features. The individual feature may be understood as independent individual feature without requiring a combination with other features, but it could be understood as a combination with one or more other individual features. Describing all possible combinations of individual features will be clearly lengthy for a skilled person in the art, and thus omitted. The individual features may be indicated by expressions such as "In some embodiments", "In some cases", and "In some examples". The individual features will be understood as universal features which are not only effective to an electroplated article and/or a method of manufacturing electroplated articles illustrated in figures for example, but also effective to other various electroplated articles and/or methods of manufacturing electroplated articles.

The terms such as "first", "second", and "third" will be affixed in an effort to logically distinguish nouns to which they are affixed. For example, "first" will not be used to indicate that "only one" noun to which "first" is affixed exists (unless otherwise clearly indicated). For example, Claims include a description such as "a plurality of second electroplated layer-metallic elements". This indicates an existence of plural metallic elements as a second electroplated layer-metallic element. The terms such as "first", "second", and "third" will not be used to indicate that nouns to which they are affixed are different each other (unless otherwise clearly indicated). For example, Claim states that "a third metallic element is a metallic element that is identical to at least one of one or more first metallic elements". As such, the third metallic element can be identical to the first metallic element.

Figure 1:
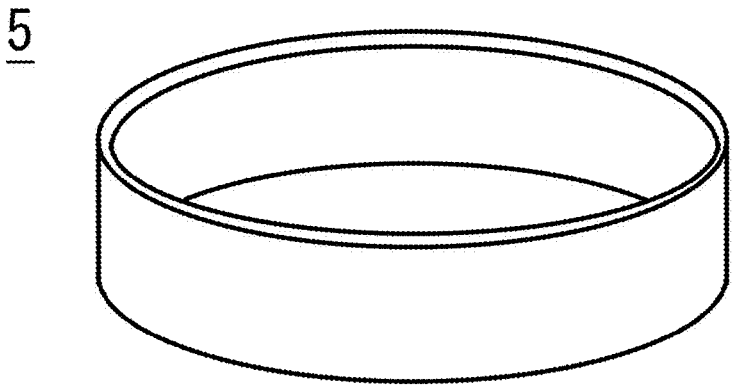
FIG. 1 is a schematic perspective view of a cap of an electroplated article according to an aspect of the present disclosure.
Figure 2:
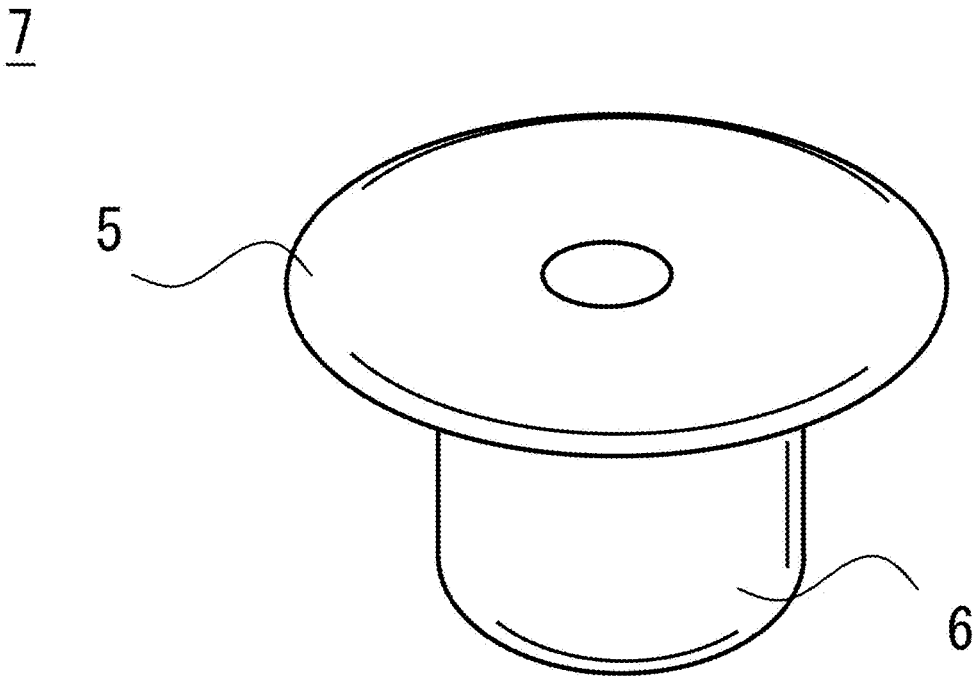
FIG. 2 is a schematic perspective view of a costumery part in which a cap as an electroplated article according to an aspect of the present disclosure has been attached to a core part.
Figure 3:
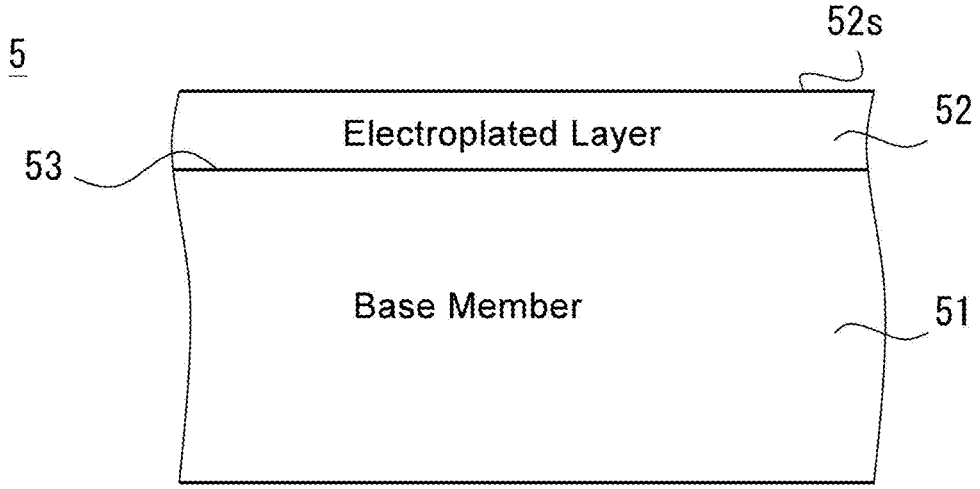
FIG. 3 is a view schematically illustrating a layer structure of an electroplated article according to an aspect of the present disclosure, illustrating a base member and an electroplated layer that is formed directly on the base member.
Figure 4:
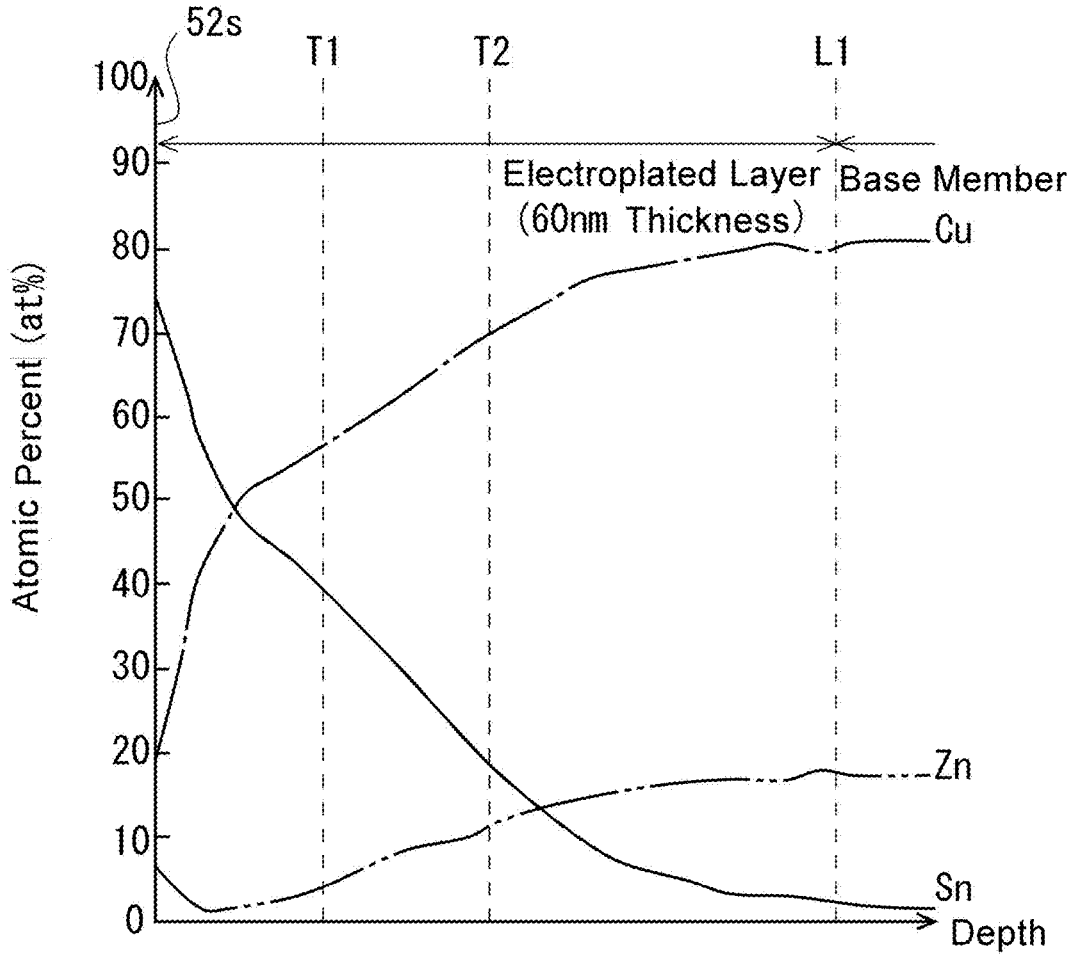
FIG. 4 is a schematic graph illustrating a change of ratio of respective metallic elements of an electroplated article in the thickness direction of an electroplated layer according to an aspect of the present disclosure. A ratio of a second electroplated layer-metallic element (Cu, Zn) in the electroplated layer is continuously decreased as being away from the base member in the thickness direction of the electroplated layer. A ratio of a first electroplated layer-metallic element (Sn) is decreased as being closer to the base member in the thickness direction of the electroplated layer.
Figure 5:
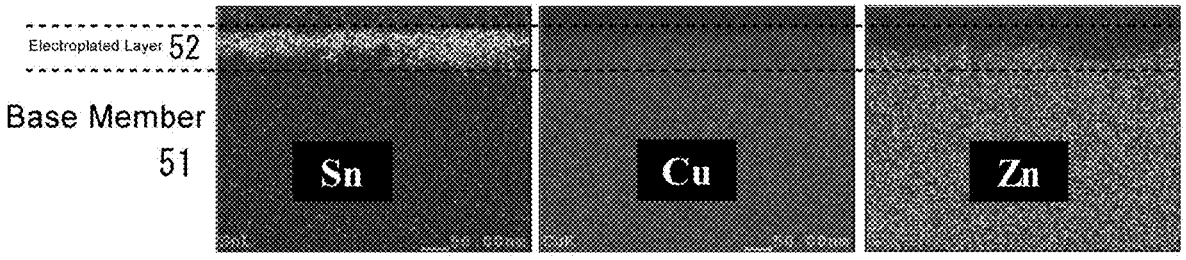
FIG. 5 is a view showing an elemental distribution in a cross-section of an electroplated article according to an aspect of the present disclosure, showing that: a first electroplated layer-metallic element (Sn) exists in the electroplated layer; a base member-metallic element (Cu) exists in the base member and the electroplated layer; and a base member-metallic element (Zn) exists in the base member and the electroplated layer. This shows that Cu exists much closer to a surface of the electroplated layer than Zn.
Figure 6:
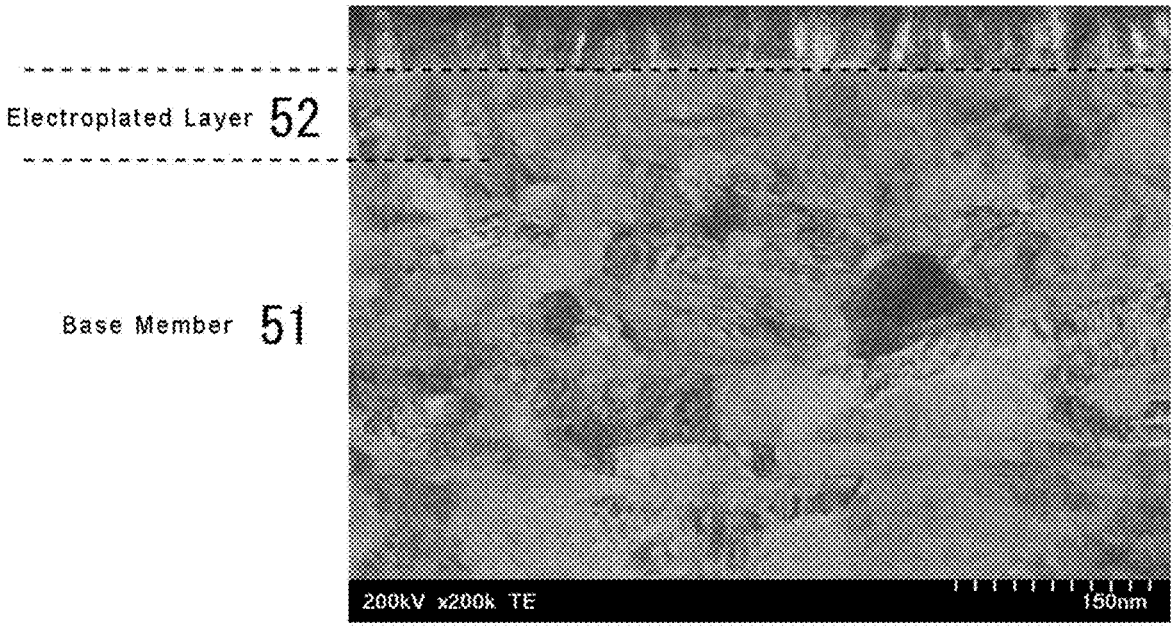
FIG. 6 is a TEM (Transmission Electron Microscope) image (Magnification is 200,000×, and Size of field is 0.64 μm*0.44 μm) of a cross-section of an electroplated article according to an aspect of the present disclosure, showing that a clear interface does not exist between the base member and the electroplated layer.
Figure 7:
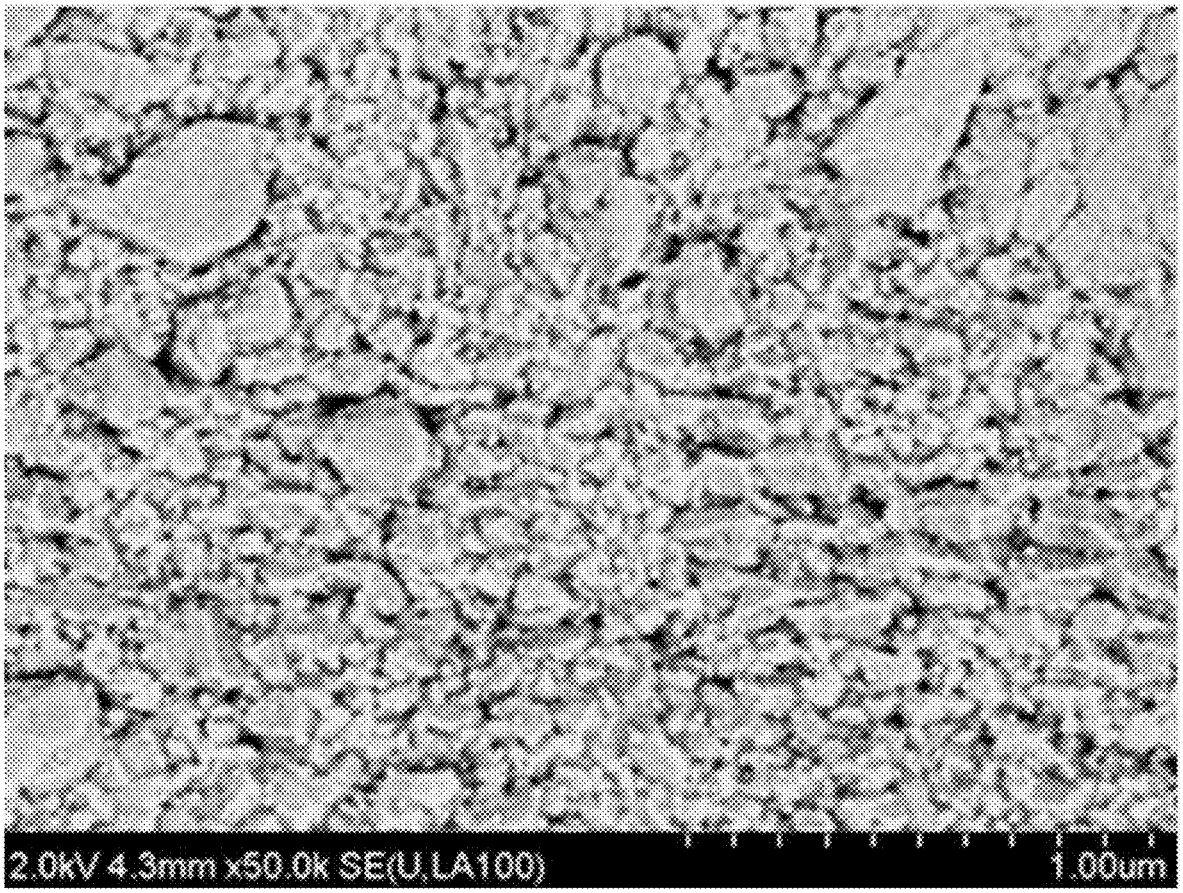
FIG. 7 is a SEM image (Magnification is 50,000×, and Size of field is 2.5 μm*1.8 μm) showing a surface condition of an electroplated layer according to an aspect of the present disclosure, showing that particle-like portions and/or nubby portions are formed two-dimensionally densely.

FIG. 1 is a schematic perspective view of a cap of an electroplated article 5. FIG. 2 is a schematic perspective view of a costumery part 7 in which a cap as an electroplated article 5 has been attached to a core part 6. FIG. 3 is a view schematically illustrating a layer structure of an electroplated article 5, illustrating a base member 51 and an electroplated layer 52 that is formed directly on the base member 51. It should be noted that an interface 53 between a base member 51 and an electroplated layer 52 is illustrated by a solid line, but a clear interface does not exist actually. The base member 51 includes one or more base member-metallic elements. The electroplated layer 52 includes one or more first electroplated layer-metallic elements. The electroplated layer 52 includes a base member-metallic element additionally to the first electroplated layer-metallic element. FIG. 4 is a schematic graph illustrating a change of ratio of respective metallic elements in an electroplated article 5 in the thickness direction of an electroplated layer 52. A ratio of a second electroplated layer 52-metallic element (Cu, Zn) in the electroplated layer 52 is continuously decreased as being away from the base member 51 in the thickness direction of the electroplated layer 52. A ratio of a first electroplated layer-metallic element (Sn) is decreased as being closer to the base member 51 in the thickness direction of the electroplated layer 52. FIG. 5 is a view showing an elemental distribution in a cross-section of an electroplated article 5, showing that: a first electroplated layer-metallic element (Sn) exists in the electroplated layer 52; a base member-metallic element (Cu) exists in the base member 51 and electroplated layer 52; and a base member-metallic element (Zn) exists in the base member 51 and the electroplated layer 52. This shows that Cu exists much closer to a surface of the electroplated layer 52 than Zn. FIG. 6 is a TEM image of a cross-section of an electroplated article 5 according to an aspect of the present disclosure, showing that a clear interface does not exist between the base member 51 and the electroplated layer 52. FIG. 7 is a SEM image showing a surface condition of an electroplated layer 52, showing that particle-like portions and/or nubby portions are formed two-dimensionally densely.

In some embodiments, the electroplated article 5 includes a base member 51, and electroplated layer 52 that is formed directly on the base member 51. The electroplated article 5 may be an article in which the base member 51 is covered at least by the electroplated layer 52. The electroplated article 5 may be at least a part of a costumery part 7, not necessarily limited to this through. In some cases of exemplary FIGS. 1 and 2, the electroplated article 5 is a part of a costumery part 7 and is combined with another part to construct the costumery part 7. In some cases of exemplary FIGS. 1 and 3, the electroplated article 5 has a cup-shaped base member 51 that is a cap, and an electroplated layer 52 that is formed on a surface of the base member 51 or covers an entire surface of the base member 51. In the case illustrated in FIG. 2, the electroplated article 5 of FIG. 1 is attached to a core part 6 so that a costumery part 7 is configured. Note that, in a technical field of costumery parts, there is a strong demand to have a wide variety of metallic colors or metallic lusters of costumery parts while suppressing a material and/or production cost.

In some exemplary cases of FIGS. 3 and 4, the base member 51 includes one or more base member-metallic elements. The electroplated layer 52 includes at least a first electroplated layer-metallic element and a second electroplated layer-metallic element that is different from the first electroplated layer-metallic element. In a case where the base member 51 is made of pure metal, the base member 51 includes one base member-metallic element. In a case where the base member 51 is made of alloy, the base member 51 includes two or more base member-metallic elements. There are cases where a trace amount of incidental impurities or incidental metals are included during a process of manufacturing or refining of metal products of a pure metal or alloy etc. For example, when a base member 51 is made of brass (CuZn), a trace amount of another metal or alloy could be included in the base member 51. For example, a trace amount of metal other than Sn could be included in a Sn-electrode for electroplating. It should be noted that both of the base member-metallic element and the electroplated layer-metallic element described in the present specification should not be construed to indicate the incidental metal. It should be noted that the base member-metallic element can be any one of various metallic elements. The first and second electroplated layer-metallic elements or other electroplated layer-metallic elements can be any one of various metallic elements.

In some cases, as would be understood from FIGS. 3 and 4, the second electroplated layer-metallic element included in the electroplated layer 52 is a metallic element that is identical to at least one of the one or more base member-metallic elements. In an example of FIG. 4, the first electroplated layer-metallic element is Sn, and the second electroplated layer-metallic element is Cu and/or Zn. The first electroplated layer-metallic element (Sn in the example of FIG. 4) is different from at least one base member-metallic element (both of Cu and Zn in the example of FIG. 4). In some cases, the first electroplated layer-metallic element included in the electroplated layer 52 is different from at least one of a plurality of base member-metallic elements (This would be well understood by referring to FIG. 11 and so on).

As would be well understood from the non-limiting exemplary demonstration of FIGS. 4 and 5, in some cases, a ratio of the second electroplated layer-metallic element (Cu and Zn in the example of FIG. 4) in the electroplated layer 52 is continuously decreased as being away from the base member 51 in the thickness direction of the electroplated layer 52. Additionally or alternatively, as would be well understood from the non-limiting exemplary demonstration of FIG. 6, a clear interface does not exist between the base member 51 and the electroplated layer 52. In such a case, cohesion between the base member 51 and the electroplated layer 52 may be enhanced. Due to this improved cohesion, a likelihood of interface separation between the base member 51 and the electroplated layer 52 may be reduced and/or thinning of the electroplated layer 52 may be facilitated, for example. It should be noted that the first electroplated layer-metallic element is originated from a metal ion existed in an electrolytic solution during an electroplating, not necessarily limited to this through. The second electroplated layer-metallic element is originated from a base member-metallic element of the base member 51.

As would be understood from the whole disclosure of the present specification, if necessary, the electroplated layer can be defined as a layer including a metal deposited on the base member by electroplating in its thickness direction. Therefore, in the present specification, the electroplated layer can include a metal other than a metal deposited on the base member by electroplating. The above-described electroplated layer-metallic element is a metallic element configuring the electroplated layer, a metallic element included in the electroplated layer in other words. The second electroplated layer-metallic element may be originated from a composition of the base member. On the other hand, the first electroplated layer-metallic element is not needed to be originated from a composition of the base member. In particular, without an intention of narrowing, the first electroplated layer-metallic element may be a metallic element deposited on the base member as at least a portion of the electroplated layer. For example, the first electroplated layer-metallic element is equal to a metallic element of deposited metallic ions which had been supplied to an electroplating solution separately to the base member and had been moved to the base member through electroplating. The second electroplated layer-metallic element is not limited to a deposit onto the base member differently from the first electroplated layer-metallic element. The second electroplated layer-metallic element may be a base member-metallic element which had existed or been included in the base member to be electroplated and/or a base member-metallic element which has eluted from and deposited onto the base member to be electroplated. The base member-metallic element may be a metallic element which configures the base member, a metallic element included in the base member in other words.

As would be understood from non-limiting exemplary demonstration of FIGS. 4 and 5, in some cases, a ratio of metallic element at a surface of the electroplated layer can be easily changed by changing the thickness of the electroplated layer. For example, a ratio of metallic element at a surface of the electroplated layer of FIG. 4 having a thickness T1 and a ratio of metallic element at a surface of the electroplated layer of FIG. 4 having a thickness T2 are different. The configuration of electroplated layer can be changed by changing the thickness of the electroplated layer, and thus a variation of electroplated layers can be easily obtained. The variation of electroplated layer can be a variation of chemical property, electrical property and/or physical property in accordance with a ratio of element. The variation of the electroplated layer can be a variation of color of the electroplated layer. In some cases, a variation of metallic colors or metallic lusters of costumery parts can be easily ensured. It should be noted that an interface L1 is illustrated between the electroplated layer and the base member in FIG. 4. In FIG. 4, the first electroplated layer-metallic element (Sn) does not exactly reach to a zero in a region of the base member deeper than the interface L1. However, this is due to errors caused during a measurement and a data output. As would be understood from the elemental distribution in FIG. 5, the first electroplated layer-metallic element (Sn) does not exist in a region of the base member 51.

As would be understood from the non-limiting exemplary demonstration of FIGS. 4 and 5, in some cases, a ratio of first electroplated layer-metallic element (Sn) is decreased as being closer to the base member 51 in the thickness direction of the electroplated layer 52. As would be understood from the non-limiting exemplary demonstration of FIG. 4, in some cases, a curved line showing a change of a ratio of the first electroplated layer-metallic element in the thickness direction of the electroplated layer 52 and a curved line showing a change of a ratio of the base member-metallic element in the thickness direction of the electroplated layer 52 are crossed. In other words, a greater amount of the first electroplated layer-metallic element exists nearby the opposite surface 52*s* of the electroplated layer 52 opposite to the side of the base member 51, and a greater amount of the second electroplated layer-metallic element exists in a region of the electroplated layer 52 nearby the base member 51. In the present specification, the opposite surface 52*s* of the electroplated layer 52 is also referred to as a surface of the electroplated layer 52.

As would be understood from the non-limiting exemplary demonstration of FIG. 4, in some cases, decrease of the ratio of the second electroplated layer-metallic element in the electroplated layer 52 continues up to the opposite surface 52*s* or to proximity of the opposite surface 52*s* in the thickness direction of the electroplated layer 52. In other words, in some embodiments, the electroplated layer 52 is not formed to be thicker such that a change of a ratio of base member-metallic element ceases. Thinning of the electroplated layer 52 would contribute in reducing an amount of metal material used for forming the electroplated layer.

As would be understood from the non-limiting exemplary demonstration of FIG. 4, in some cases, the base member 51 includes a plurality of base member-metallic elements, the electroplated layer 52 includes a plurality of base member-metallic elements, and the respective ratios of the second electroplated layer-metallic elements in the electroplated layer 52 are decreased as being away from the base member 51 in the thickness direction of the electroplated layer 52. A case is envisaged where the base member 51 includes three or more base member-metallic elements. A case is envisaged where the electroplated layer 52 includes two or three or more electroplated layer-metallic elements.

It should be noted that a ratio of an element should be based on an atomic percent (at %). That is, when a ratio of an element is great, then a value of atomic percent of that element is great. The determination of atomic percent should be done by using an Auger electron spectroscopy analyzer of JAMP9500F produced by JEOL Ltd.

The base member-metallic element and the first electroplated layer-metallic element can be any one of various metallic elements and, as an example, the base member 51 is made of brass (CuZn) and the base member-metallic elements are copper (Cu) and zinc (Zn). In some cases, the base member 51 is a metal or an alloy at least including copper as a base member-metallic element. In some cases, the electroplated layer 52 is a metal or alloy at least including tin (Sn) as a first electroplated layer-metallic element. In some exemplary cases of FIG. 4 and so on, the base member 51 includes a plurality of base member-metallic elements (for example, Cu and Sn), and the electroplated layer 52 includes a plurality of second electroplated layer-metallic elements (for example, Cu and Sn). The respective ratios of the second electroplated layer-metallic elements (for example, Cu and Sn) in the electroplated layer 52 are decreased as being away from the base member 51 in the thickness direction of the electroplated layer 52.

As would be understood from the non-limiting exemplary demonstration of FIG. 7, in some cases, particle-like portions and/or nubby portions are two-dimensionally densely formed in the opposite surface 52*s* of the electroplated layer 52. The electroplated layer 52 may have an improved tolerance to alkali and acid chemicals due to its fine surface condition. Even if the electroplated layer 52 is formed to be thin, a sufficient chemical tolerance of the electroplated layer 52 may be ensured. In some cases, the thickness of the electroplated layer 52 is equal to or less than 150 nm or 100 nm. Note that, for electroplated articles according to some embodiments, there is no particular problem in terms of cohesion of electroplated layer even if the thickness of the electroplated layer 52 is equal to or less than 150 nm or 100 nm. Therefore, the thickness may be set to be minimum when a production efficiency of electroplated articles is pursued. From this perspective, 150 nm or less or 100 nm or less may be preferable but not necessarily limited thereto, and the time period of electroplating can be longer to increase the thickness of the layer.

As described above, in some cases, a clear interface does not exist between the base member 51 and the electroplated layer 52. It is assumed that moderate change of ratio of the first and/or second electroplated layer-metallic elements in the electroplated layer 52 results in the non-existence of interface. It is alternatively assumed that the distribution of alloy grains including at least the first and second electroplated layer-metallic elements results in the non-existence of interface. In order to determine the thickness of the electroplated layer 52, we have to identify an interface between the base member 51 and the electroplated layer 52. In the present specification, an interface between the base member 51 and the electroplated layer 52 is determined based on a measurements shown in FIG. 4 and/or FIG. 5. In a method of measurement of FIG. 4, an interface between the base member 51 and the electroplated layer 52 is defined by a depth from a surface of the electroplated layer 52 at which a predetermined ratio of base member-metallic element is attained in the base member 51. In a method of measurement of FIG. 5, an interface between the base member 51 and the electroplated layer 52 is defined by a distribution of the first electroplated layer-metallic element and/or a distribution of the base member-metallic element. For example, when brass having an elemental ratio of Cu:Zn=80:20 is used for the base member 51, an interface may be defined at a position at which an atomic percent of Cu reaches about 80 at % and an atomic percent of Zn reaches about 20 at %. However, the change of ratio of atomic percent shown in FIG. 4 naturally includes an error because it is observed by elemental analysis of material released by etching in a measurement device. The interface between the base member 51 and the electroplated layer 52 should be determined appropriately in light of such an error in measurement.

For articles which embody the present invention, an interface between the base member 51 and the electroplated layer 52 should be determined as follows. A position at which an atomic percent of the major base member-metallic element reaches at 98% of the maximum ratio of the major base member-metallic element in the base member 51 should be determined as an interface between the base member 51 and the electroplated layer 52. In a case where the base member 51 includes a single base member-metallic element, the major base member-metallic element in the base member 51 is that single base member-metallic element. In a case where the base member 51 includes a plurality of base member-metallic elements, the major base member-metallic element in the base member 51 is a base member-metallic element having the maximum ratio, i.e. atomic percent. For example, when brass having an elemental ratio of Cu:Zn=80:20 is used for the base member 51, a position at which an atomic percent of Cu having the maximum ratio of metallic ingredient (the maximum atomic percent of metallic ingredient) reaches 98% of the maximum ratio of 80 at %.

There is a clear interface for cases of conventional barrel plating or rack plating unlike articles having a condition of non-interface according to the present invention, and thus the position of that interface is defined as an interface between the base member 51 and the electroplated layer 52. Actually, there are minute projections and recesses in a surface of a base metal, and thus the position of averaged height (Rc) of the projections and recesses at that surface will be defined as an interface between the base member 51 and the electroplated layer 52.

Figure 8:
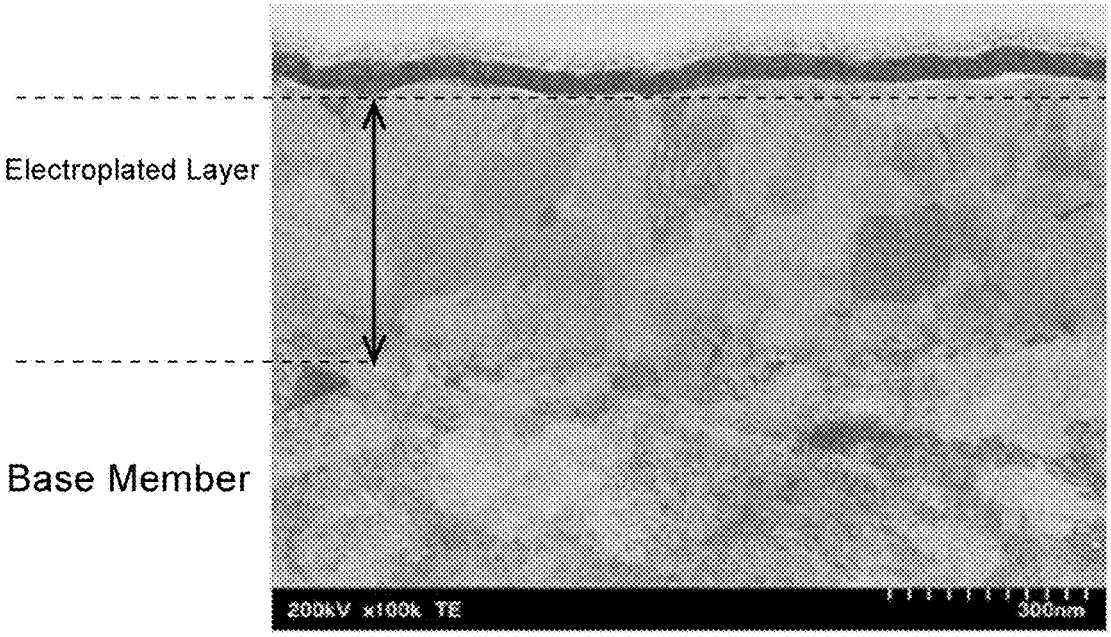
FIG. 8 is a TEM (Transmission Electron Microscope) image (Magnification is 100,000×, and Size of field is 1.3 μm*0.88 μm) of a cross-section of a conventional electroplated article, showing that a clear interface exists between the base member and the electroplated layer.
Figure 9:
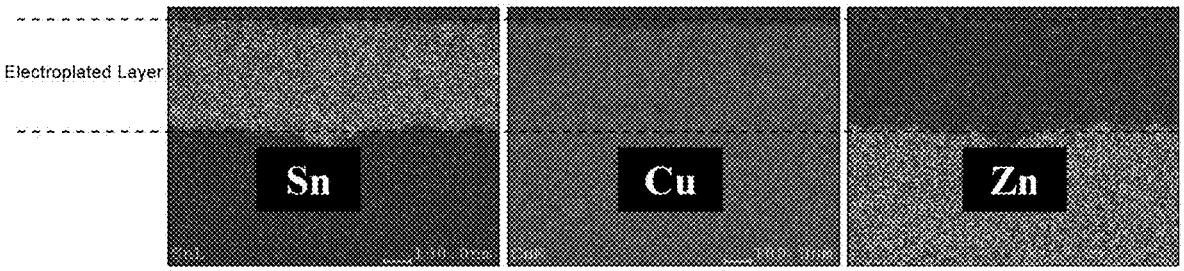
FIG. 9 is a view showing an elemental distribution in a cross-section of a conventional electroplated article, showing that: an electroplated layer-metallic element (Sn) exists in an electroplated layer; an electroplated layer-metallic element and a base member-metallic element (Cu) exist in the base member and the electroplated layer; and a base member-metallic element (Zn) exists in the base member. This shows that a base member-metallic element (Zn) does not exist in the electroplated layer.
Figure 10:
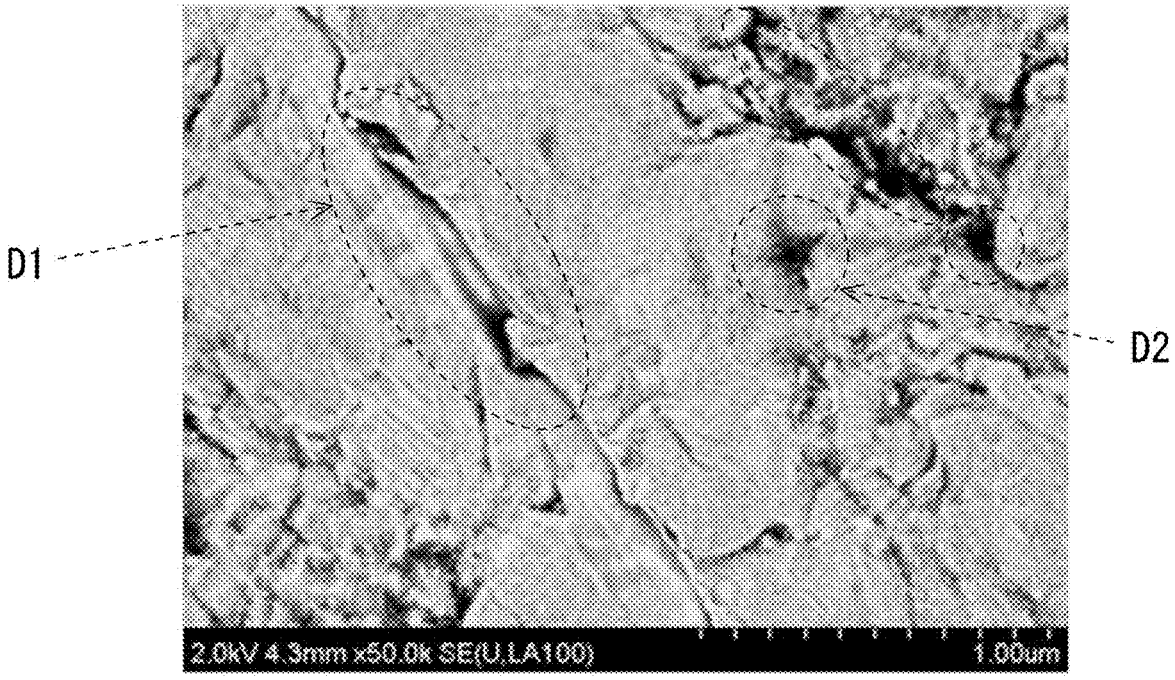
FIG. 10 is a SEM image (Magnification is 50,000×, and Size of field is 2.5 μm*1.8 μm) showing a surface condition of an electroplated layer of a conventional electroplated article, showing that cracks and pin-holes are formed.

As described above, in some cases, the ratio of the second electroplated layer-metallic element in the electroplated layer 52 moderately changes and a clear interface does not exist between the base member 51 and the electroplated layer 52. With reference to FIGS. 8-10, description will be followed for conventional electroplated articles that do not have such electroplated layer 52. FIG. 8 is a TEM image of a cross-section of a conventional electroplated article, showing that an interface exists between the base member and the electroplated layer. FIG. 9 is a view showing an elemental distribution in a cross-section of a conventional electroplated article, showing that: an electroplated layer-metallic element (Sn) exists in an electroplated layer; an electroplated layer-metallic element and a base member-metallic element (Cu) exist in the base member and the electroplated layer; and a base member-metallic element (Zn) exists in the base member. This shows that a base member-metallic element (Zn) does not exist in the electroplated layer. As shown in FIGS. 8-9, in the conventional barrel plating, there is a case where a layer thickness is set to be greater than 200 nm for improving a color tone or surface condition of an electroplated surface, and furthermore the electroplated layer is simply laminated onto the base metal. Therefore, an interface between the base member 51 and the electroplated layer 52 is clearly identifiable visually. Note that there are minute projections and recesses in a surface of base metal in actual, and thus the interface may be a surface of the projections and recesses. In a case where the thickness of the electroplated layer is expressed by a numerical value, a position of averaged height (Rc) of projections and recesses in that surface is determined as an interface between the base member 51 and the electroplated layer 52 just for convenience. FIG. 10 is a SEM image showing a surface condition of an electroplated layer of a conventional electroplated article, showing that cracks and pin-holes are formed.

In FIGS. 8-10, the base member is made of brass (CuZn), the electroplated layer is made of CuSn alloy. In an electroplated layer of CuSn layer having 250 nm thickness, an elemental percent of Cu and an elemental percent of Sn are substantially the same. As shown in FIG. 8, a clear interface exists between the electroplated layer and the base member as would be understood from a difference in metallic structures of the electroplated layer and the base member. As shown in FIG. 9, the electroplated layer does not include Zn of base member-metallic element. The reason why the electroplated layer includes Cu is that Cu is an electroplated layer-metallic element. As shown in FIG. 10, there are cracks D1 and pin-holes D2 in a surface of the electroplated layer. If alkali or acid chemical enters into the cracks D1 and pin-holes D2, then rust or collapse of the electroplated layer may progress. In order to fully cope with this and/or other technical problems, a thickness of electroplated layer may be required to be equal to or greater than about 10000 nm. For practical electroplated articles based on a conventional mass-production, the thickness of the electroplated layer is set to be over a range of 100 nm to 200 nm such as 250 nm for example, and thus technical problems such as peeling-off of electroplated layer or oxidization or color change are suppressed to some extents which is sufficient for practical use.

The electroplated layer of the conventional electroplated article of FIGS. 8-10 is formed by a barrel plating. A barrel plating is a method where articles to be electroplated, i.e. base members in the present specification are supplied into a barrel (rotational cargo) immersed in an electroplating bath and electroplating is performed while the barrel is being rotated. The benefit is that a large number of articles can be electroplated at once. The electroplated layer of electroplated article according to an embodiment of FIGS. 1-7 is formed by a non-limiting exemplary method described below with reference to FIGS. 19-21, but not necessarily limited to this method. A skilled person in the art may improve the existing barrel plating or invent completely different method for achieving the electroplated layer according to the present disclosure.

The electroplated article according to an exemplary embodiment of FIGS. 1-7 may be able to solve one or more problems of conventional electroplated article of FIGS. 8-10. In particular, the electroplated article according to an exemplary embodiment of FIGS. 1-7 may contribute in solving conventional problem of low cohesion due to an interface between the base member and the electroplated layer. When an interface exists between the electroplated layer and the base member, even if the electroplated layer was formed to be thicker, peeling-off of the electroplated layer might be still induced. Additionally or alternatively, the electroplated article according to an exemplary embodiment of FIGS. 1-7 may contribute in solving conventional problem of thick electroplated layer. Additionally or alternatively, the electroplated article according to an exemplary embodiment of FIGS. 1-7 may contribute in solving conventional problem that plural cracks and/or pin-holes are formed in a surface of the electroplated layer.

Figure 11:
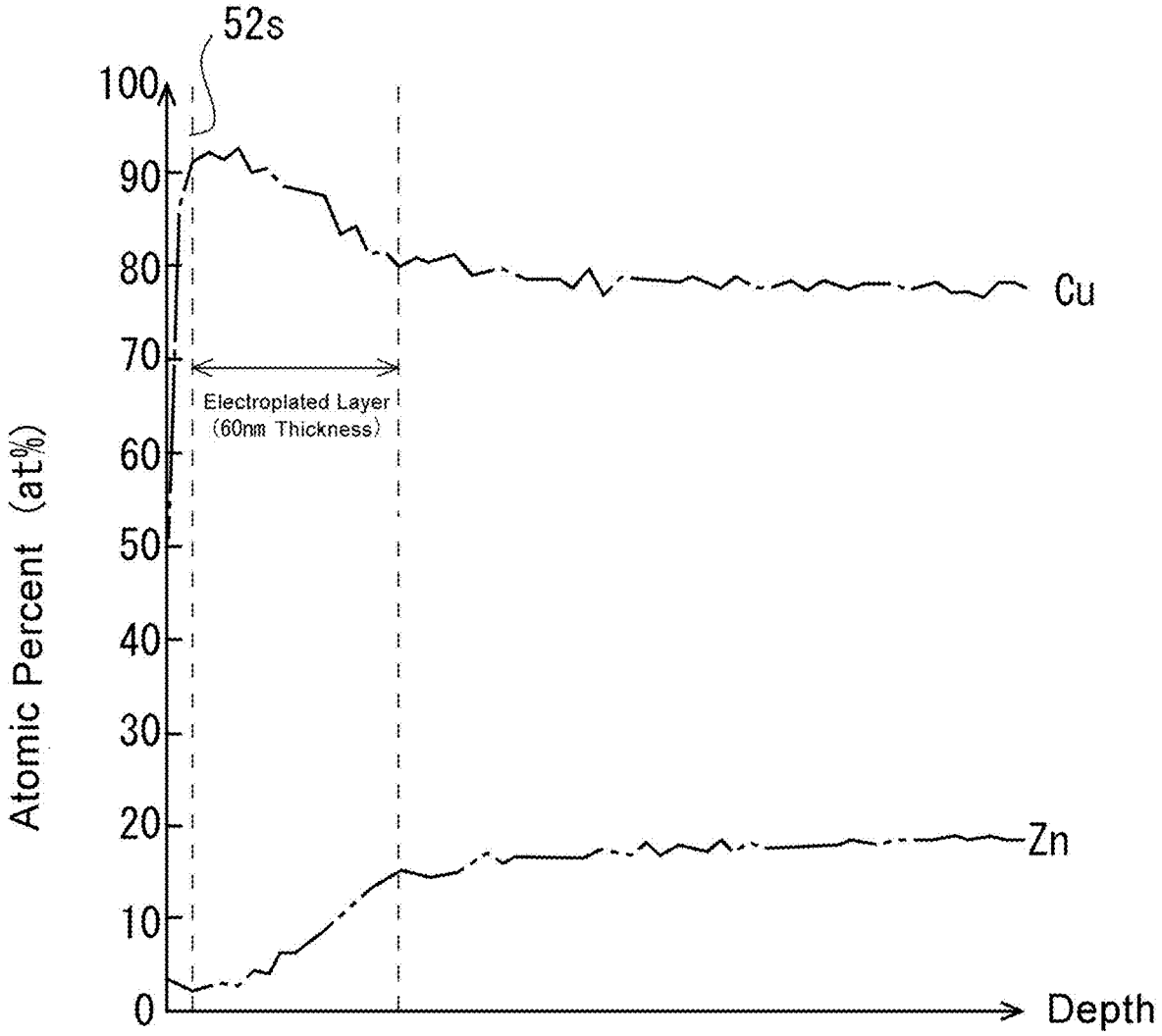
FIG. 11 is a schematic graph illustrating a change of ratio of respective metallic elements of an electroplated article in the thickness direction of an electroplated layer according to an aspect of the present disclosure. A ratio of a second electroplated layer-metallic element (Zn) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

Hereinafter, variations of metallic element will be mainly discussed with reference to FIGS. 11-18. FIG. 11 is a schematic graph illustrating a change of ratio of respective metallic elements of an electroplated article in the thickness direction of an electroplated layer. In FIG. 11, the base member 51 is made of brass (CuZn), and the first electroplated layer-metallic element is copper (Cu). As would be understood from FIG. 11, a ratio of a second electroplated layer-metallic element (Zn) in the electroplated layer is continuously decreased as being away from the base member in the thickness direction of the electroplated layer. In the case of FIG. 11, a change in ratio of the metallic element (Cu), originated from the base member 51, in the electroplated layer cannot be observed because the first electroplated layer-metallic element is copper (Cu).

A ratio of the metallic element (Cu) is decreased as being closer to the base member in the thickness direction of the electroplated layer. The change of ratio of the metallic element (Cu) in the electroplated layer of FIG. 11 represents the total change in ratio of Cu as the base member-metallic element and of Cu as the first electroplated layer-metallic element. However, it is apparent that greater amount of first electroplated layer-metallic element exists at a side of surface of the electroplated layer 52. Thus, the change of ratio of the metallic element (Cu) in the electroplated layer of FIG. 11 proves that a ratio of the first electroplated layer-metallic element (Cu) is decreased as being closer to the base member in the thickness direction of the electroplated layer.

Figure 12:
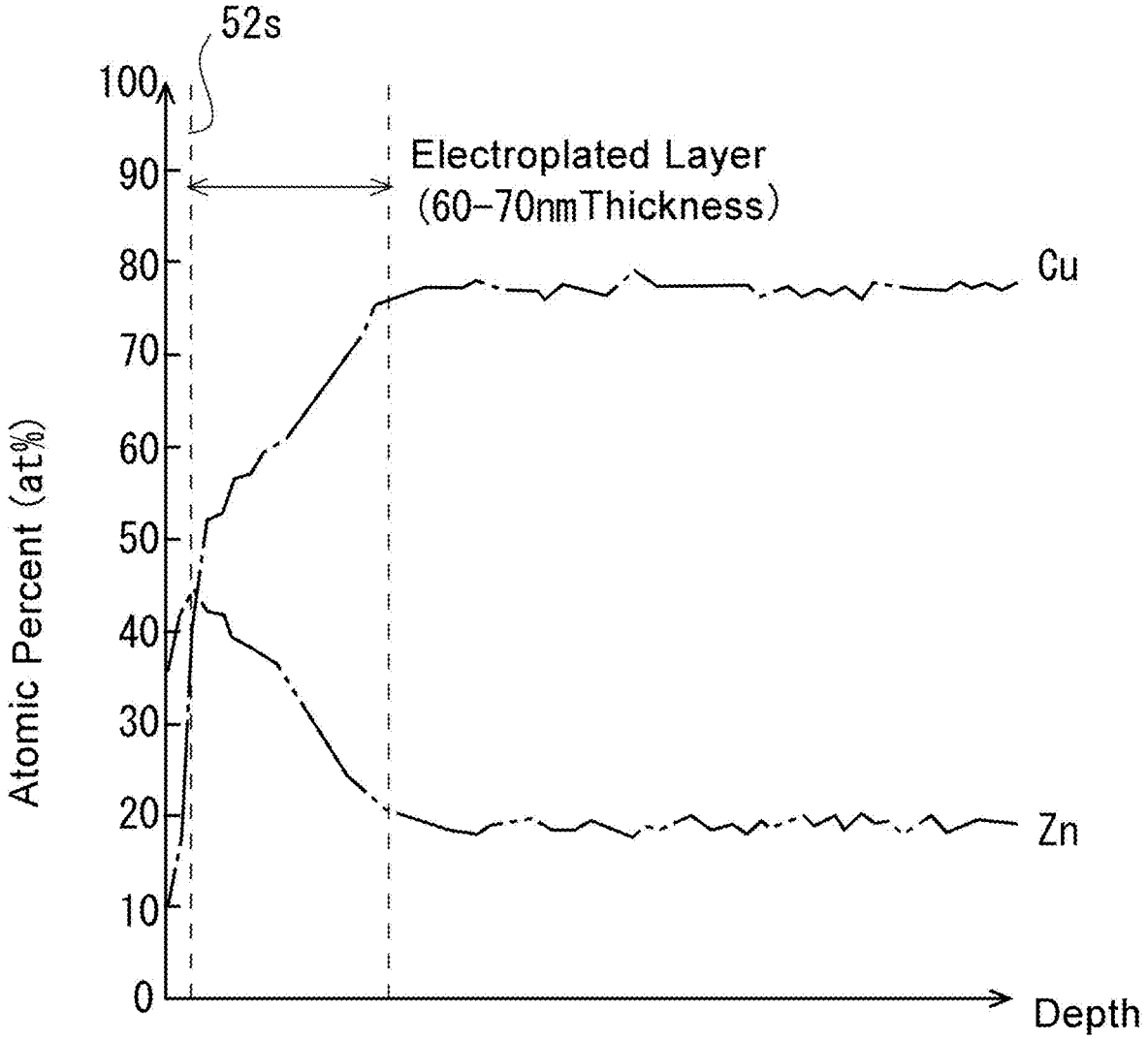
FIG. 12 is a schematic graph illustrating a change of ratio of respective metallic elements of an electroplated article in the thickness direction of an electroplated layer according to an aspect of the present disclosure. A ratio of a second electroplated layer-metallic element (Cu) in the electroplated layer is continuously decreased as being away from the base member in the thickness direction of the electroplated layer. A ratio of a first electroplated layer-metallic element (Zn) is decreased as being closer to the base member in the thickness direction of the electroplated layer.

FIG. 12 is a schematic graph illustrating a change of ratio of respective metallic elements of an electroplated article in the thickness direction of an electroplated layer. In FIG. 12, the base member 51 is made of brass (CuZn), and the first electroplated layer-metallic element is zinc (Zn). As would be understood from FIG. 12, a ratio of a second electroplated layer-metallic element (Cu) in the electroplated layer is continuously decreased as being away from the base member in the thickness direction of the electroplated layer. In a case of FIG. 12, the first electroplated layer-metallic element is zinc (Zn), and thus it is not possible to observe a change of ratio of metallic element (Zn) originated from the base member 51 in the electroplated layer. The decreased ratio of the metallic element (Zn) as being close to the base member in the thickness direction of the electroplated layer proves that a ratio of the first electroplated layer-metallic element (Zn) is decreased as being closer to the base member in the thickness direction of the electroplated layer.

Figure 13:
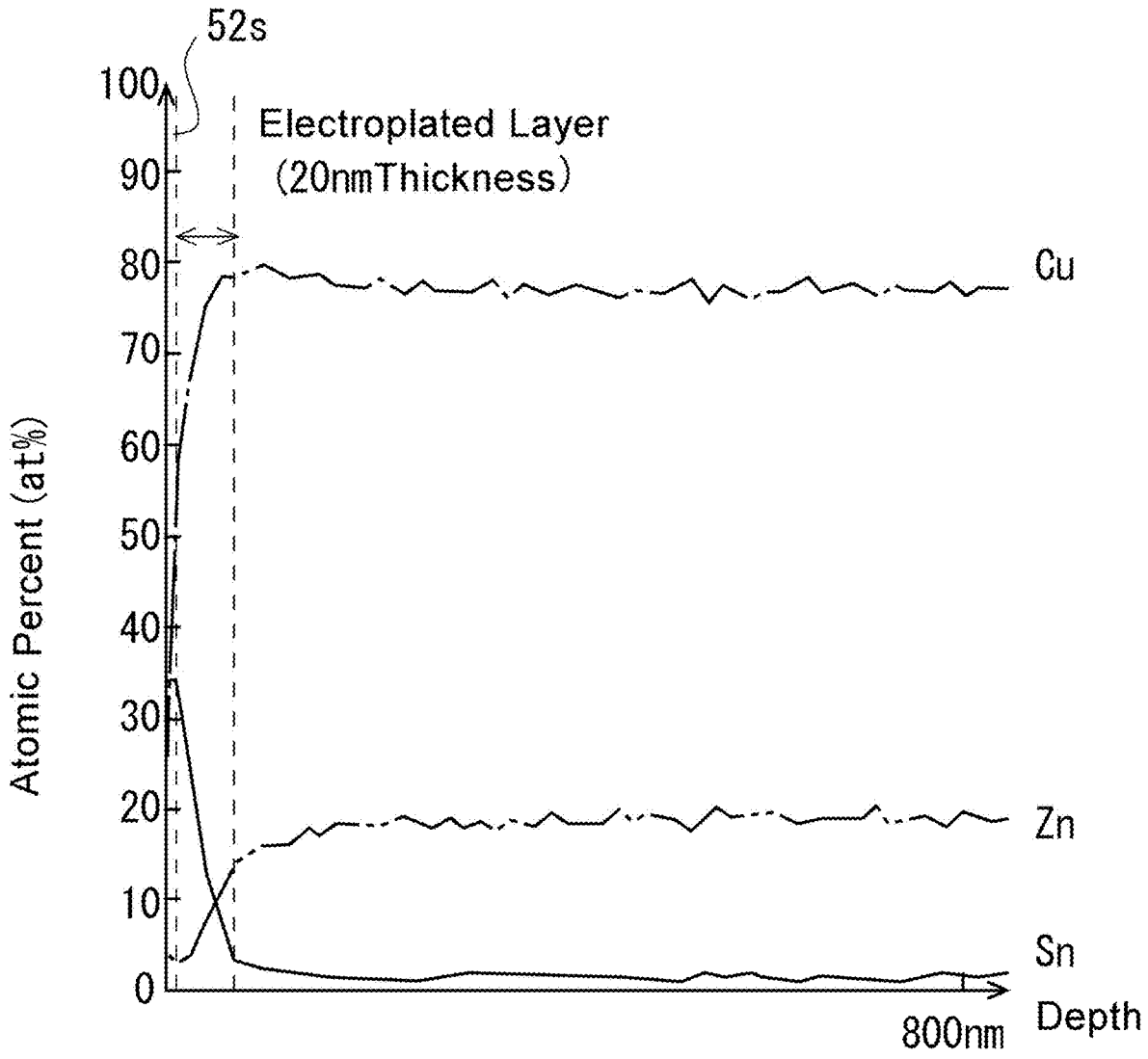
FIG. 13 is a schematic graph illustrating a change of ratio of respective metallic elements of an electroplated article in the thickness direction of an electroplated layer according to an aspect of the present disclosure. A ratio of a second electroplated layer-metallic element (Cu, Zn) in the electroplated layer is continuously decreased steeply as being away from the base member in the thickness direction of the electroplated layer. A ratio of a first electroplated layer-metallic element (Sn) is decreased as being closer to the base member in the thickness direction of the electroplated layer. A thickness of the electroplated layer is further reduced compared to the case of FIG. 4.

FIG. 13 is a schematic graph illustrating a change of ratio of respective metallic elements of an electroplated article in the thickness direction of an electroplated layer according to an aspect of the present disclosure. In FIG. 13, the base member 51 is made of brass (CuZn), and the first electroplated layer-metallic element is tin (Sn). A ratio of a second electroplated layer-metallic element (Cu or Zn) in the electroplated layer is continuously decreased steeply as being away from the base member in the thickness direction of the electroplated layer. A ratio of a first electroplated layer-metallic element (Sn) is decreased as being closer to the base member in the thickness direction of the electroplated layer. In a case of FIG. 13, a machine different from FIG. 4 is used to form an electroplated layer, and a remarkable effect can be obtained that the thickness of the electroplated layer can be thinner than the thickness of the electroplated layer of FIG. 4.

It should be noted that a thickness of an electroplated layer should not necessarily be limited to thicknesses of above described respective examples. For example, in the case of FIG. 13, if the thickness of electroplated layer is set to be greater than 20 nm, then an electroplated article may be obtained that has a color-appearance much closer to silver color that is a color of material of Sn. In contrast, if the thickness of electroplated layer is set to be less than 20 nm, then an electroplated article may be obtained that has a color-appearance much closer to yellow color that is a color of brass of the base member 51.

Figure 14:
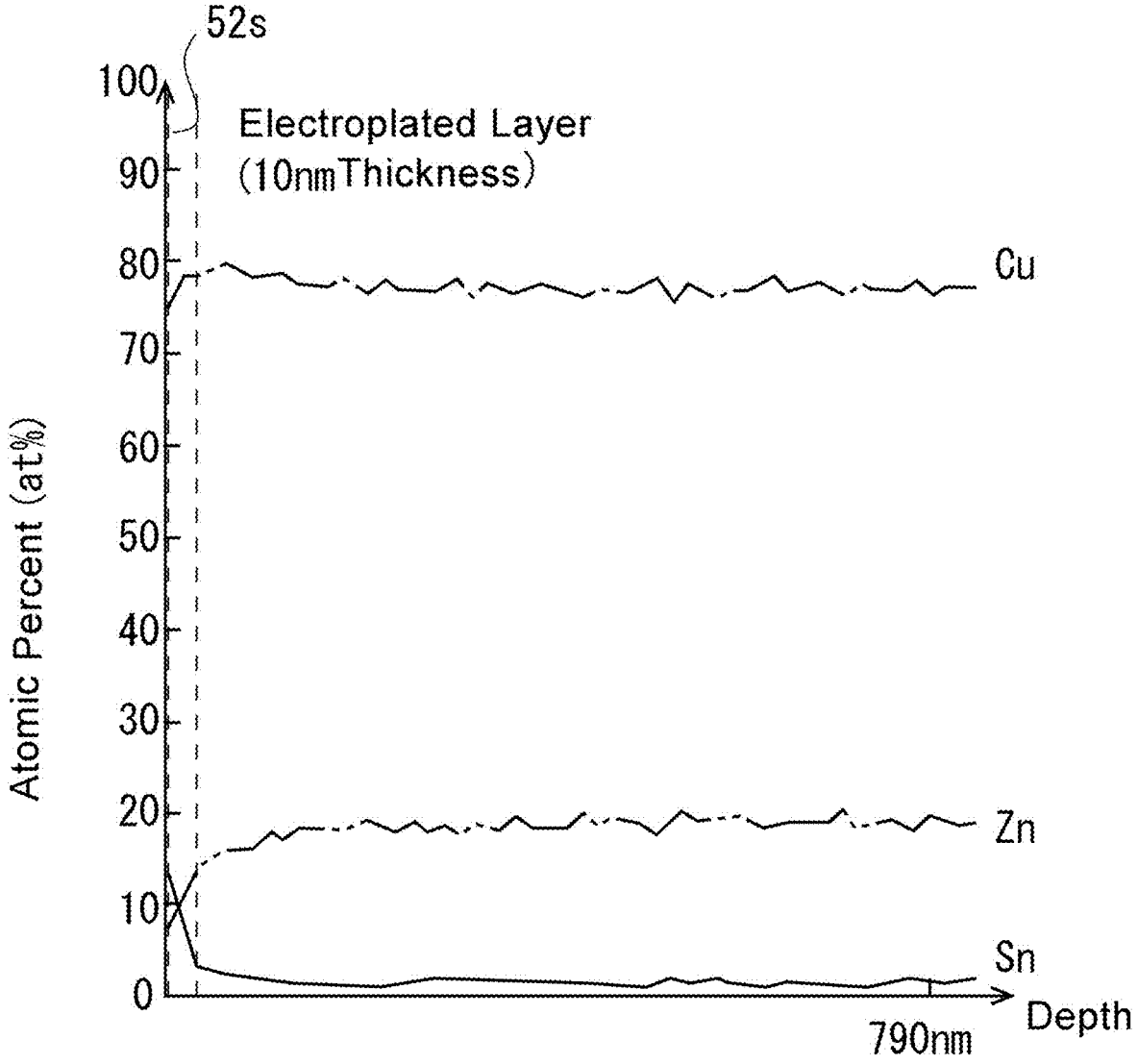
FIG. 14 is a schematic graph of a case where the electroplated layer is formed thinner than FIG. 13.

In particular, FIG. 14 illustrates an example where the thickness of the electroplated layer of FIG. 13 is set to be 10 nm. The electroplated article of this case may have a color-appearance with slightly increased yellow compared to the electroplated article of the embodiment of FIG. 13 that has a light gold color. As such, even in a case of embodiment of the present invention where the thickness is set to be 10 nm, a competitive electroplated article over conventional barrel plating in terms of cohesion will be obtained.

Figure 15:
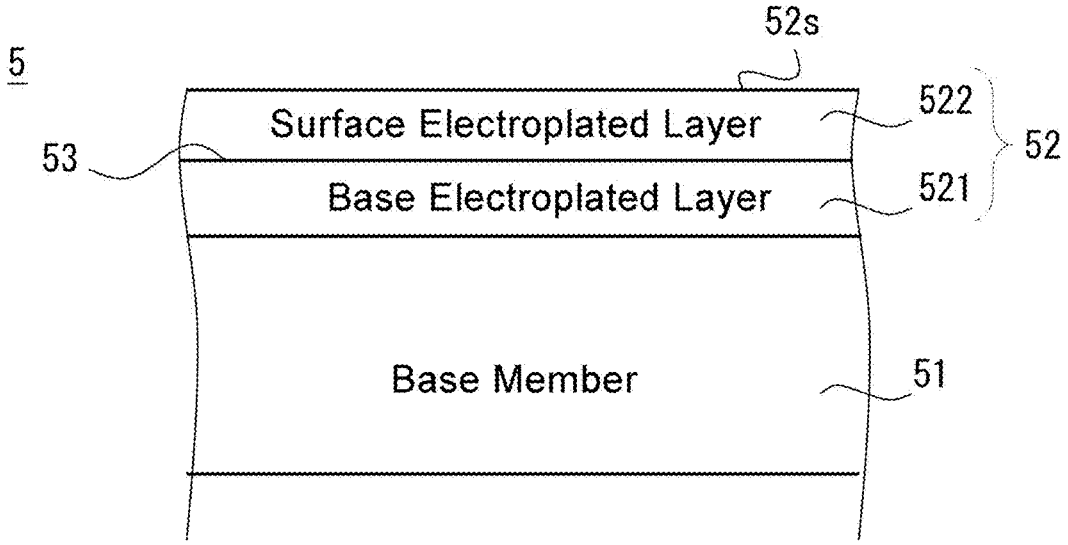
FIG. 15 is a view schematically illustrating a layer structure of an electroplated article according to an aspect of the present disclosure, illustrating that an electroplated layer formed directly on the base member includes a base electroplated layer and a surface electroplated layer.
Figure 16:
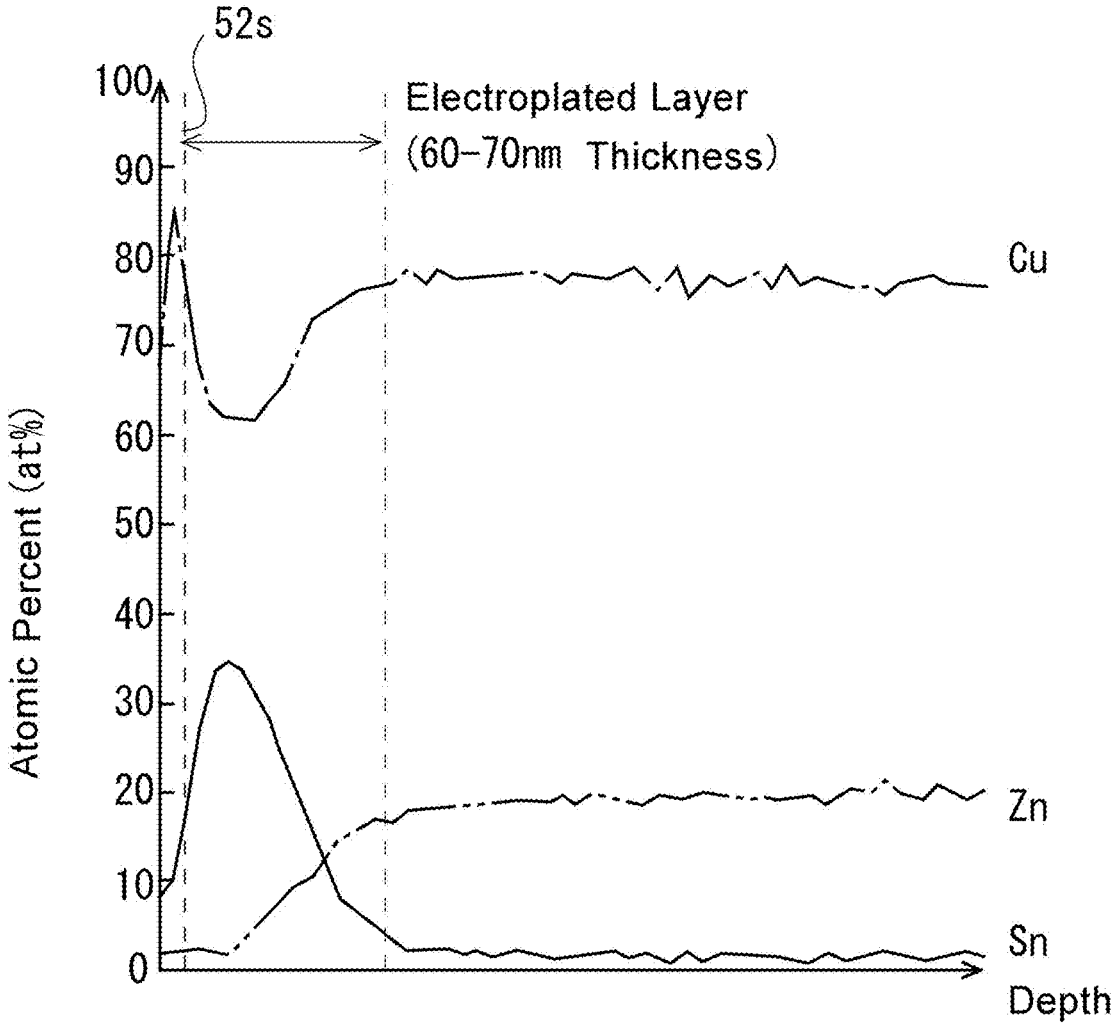
FIG. 16 is a schematic graph illustrating a change of ratio of respective metallic elements of an electroplated article in the thickness direction of an electroplated layer according to an aspect of the present disclosure. A base electroplated layer is made of first electroplated layer-metallic element (Sn). A surface electroplated layer is made of another first electroplated layer-metallic element (Cu).

FIG. 15 is a view schematically illustrating a layer structure of an electroplated article, illustrating that an electroplated layer formed directly on the base member includes a base electroplated layer and a surface electroplated layer. FIG. 16 is a schematic graph illustrating a change of ratio of respective metallic elements of an electroplated article in the thickness direction of an electroplated layer. In FIG. 16, the electroplated layer is comprised of a base electroplated layer and a surface electroplated layer as shown in FIG. 15. In FIG. 16, the base member 51 is made of brass (CuZn), and the first electroplated layer-metallic element of the base electroplated layer is tin (Sn), and the first electroplated layer-metallic element of the surface electroplated layer is copper (Cu). A ratio of a second electroplated layer-metallic element (Cu or Zn) in the electroplated layer is continuously decreased as being away from the base member in the thickness direction of the electroplated layer. A ratio of a first electroplated layer-metallic element (Sn) in the base electroplated layer is continuously decreased as being closer to the base member in the thickness direction of the electroplated layer.

A ratio of a second electroplated layer-metallic element (Zn) in the surface electroplated layer is continuously decreased as being away from the base electroplated layer in the thickness direction of the electroplated layer, and similarly a ratio of the first electroplated layer-metallic element (Sn) of the base electroplated layer is continuously decreased. In a case of FIG. 16, the first electroplated layer-metallic element of the surface electroplated layer is copper (Cu), and thus it is not possible to observe a change of ratio of the metallic element (Cu) in the surface electroplated layer which is originated from the base member 51. The decreased ratio of the metallic element (Cu) of the surface electroplated layer as being close to the base electroplated layer in the thickness direction of the electroplated layer proves that a ratio of the metallic element (Cu) originated from the base member 51 in the surface electroplated layer is decreased as being closer to the base electroplated layer in the thickness direction of the surface electroplated layer.

Examples where brass is used for the base member 51 have been mainly described, but it is envisaged that other metal (a zinc or stainless steel, for example), alloy or pure metal (such as zinc) can be used. Cases are envisaged where the electroplated layer is formed as a single layer, dual layers or three or more layers. The position of the surface of the electroplated layer 52 is pointed out by "52*s*" in FIGS. 4, 11-14, and 16-18.

Figure 17:
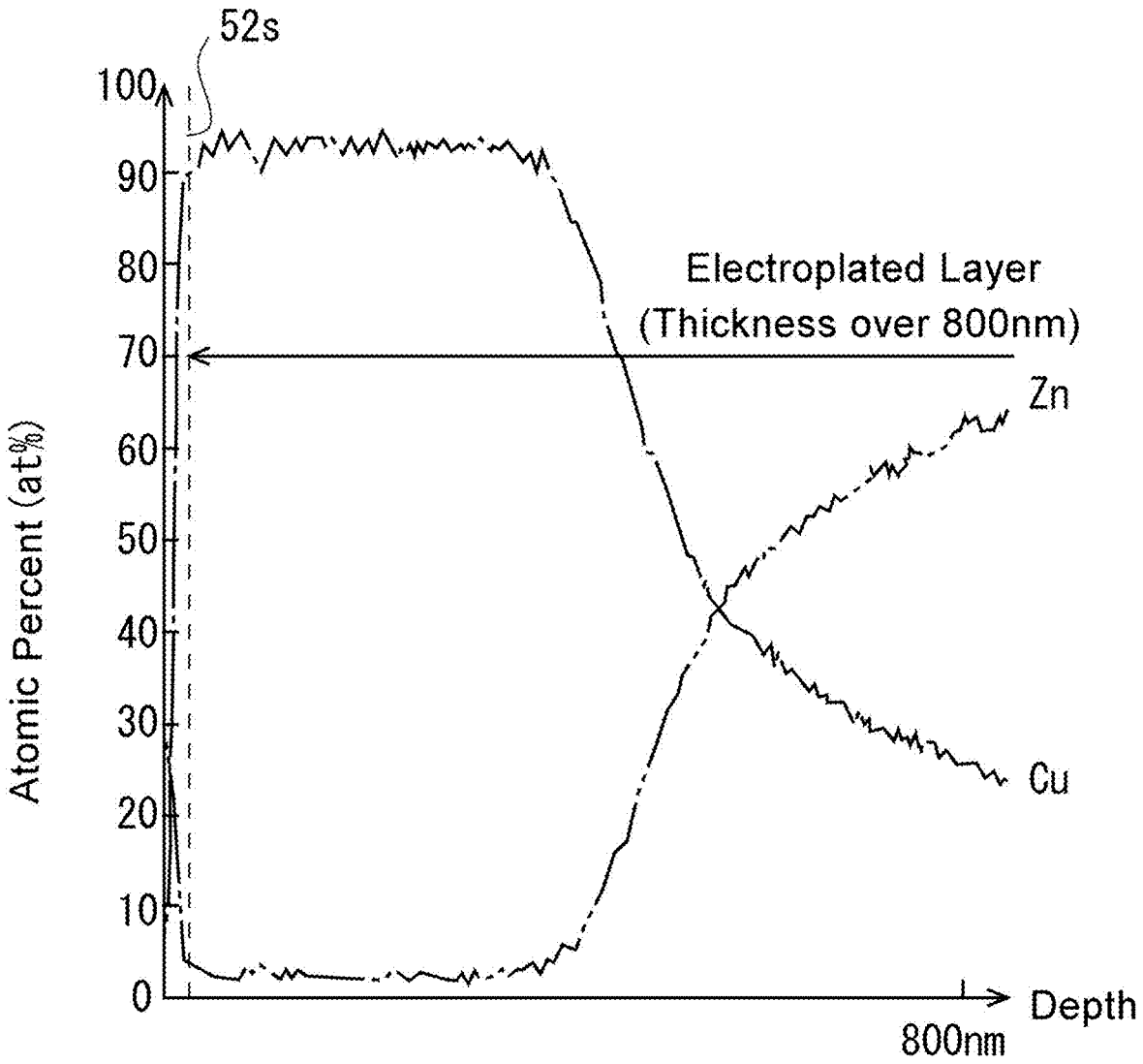
FIG. 17 is a schematic graph illustrating a change of ratio of respective metallic elements of an electroplated article in the thickness direction of an electroplated layer according to an aspect of the present disclosure. A ratio of a second electroplated layer-metallic element (Zn) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

FIG. 17 is a schematic graph illustrating a change of ratio of respective metallic elements of an electroplated article in the thickness direction of an electroplated layer. In FIG. 17, the base member 51 is made of zinc (Zn), and the first electroplated layer-metallic element of the electroplated layer is copper (Cu). A ratio of a second electroplated layer-metallic element (Zn) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

Figure 18:
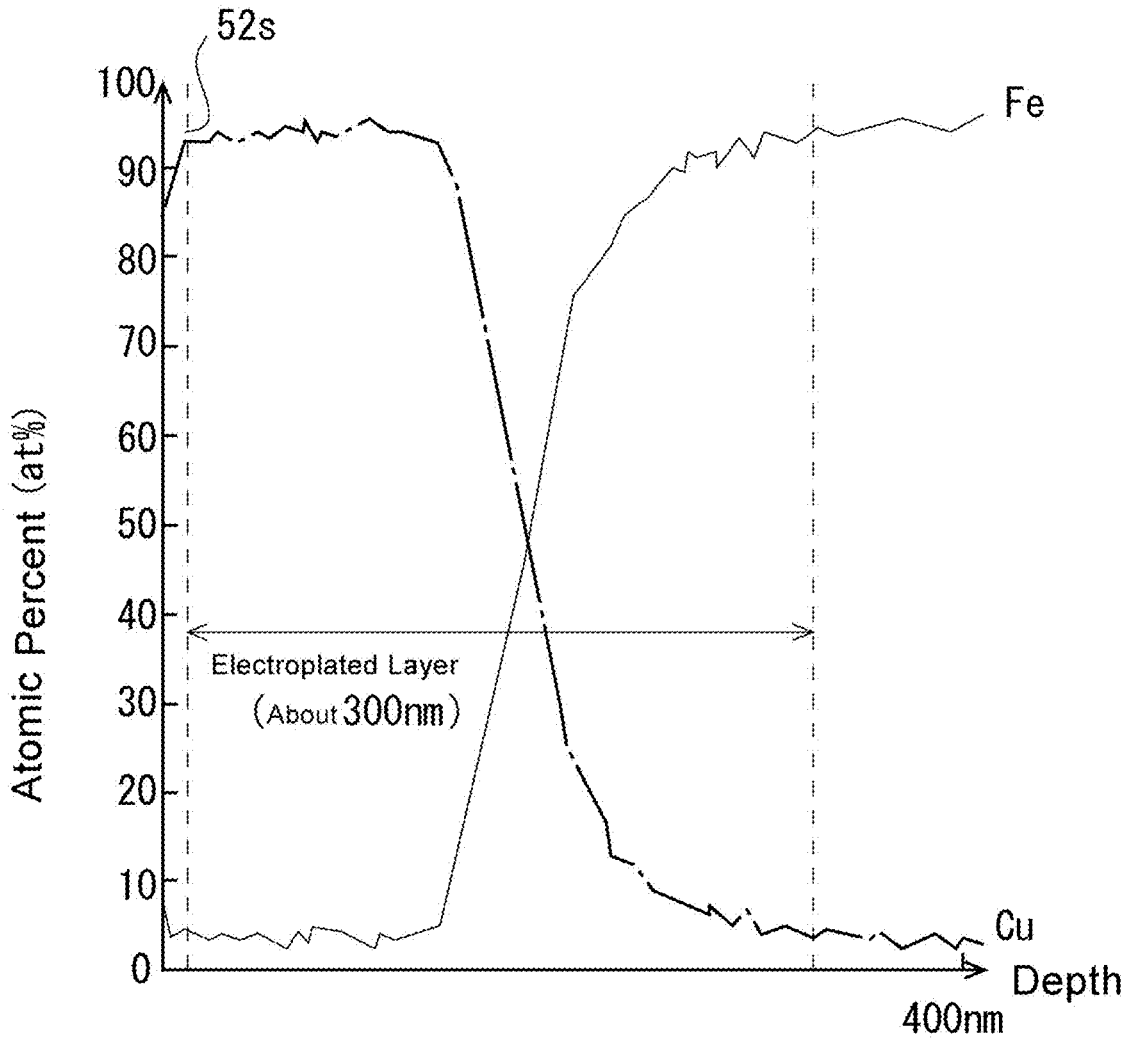
FIG. 18 is a schematic graph illustrating a change of ratio of respective metallic elements of an electroplated article in the thickness direction of an electroplated layer according to an aspect of the present disclosure. A ratio of a second electroplated layer-metallic element (Fe) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

FIG. 18 is a schematic graph illustrating a change of ratio of respective metallic elements of an electroplated article in the thickness direction of an electroplated layer. In FIG. 18, the base member 51 is made of stainless steel, and includes a base member-metallic element (Fe). The first electroplated layer-metallic element of the electroplated layer is copper (Cu). A ratio of a second electroplated layer-metallic element (Fe) in the electroplated layer is continuously decreased as being away from the base member in the thickness direction of the electroplated layer. A ratio of a first electroplated layer-metallic element (Cu) is decreased as being closer to the base member in the thickness direction of the electroplated layer.

As would be understood from the above disclosure, in some cases, a thickness of a portion of the electroplated layer 52 where the ratio of the second electroplated layer-metallic element is continuously decreased as being away from the base member 51 in the thickness direction of the electroplated layer 52 is equal to or greater than 10 nm or 20 nm or 60 nm. FIG. 17 shows that a ratio of the second electroplated layer-metallic element (Zn) is continuously decreased in the thickness range equal to or greater than 60 nm and/or 400 nm. FIG. 18 shows that a ratio of the second electroplated layer-metallic element (Fe) is decreased in the thickness range equal to or greater than 60 nm and/or 100 nm. FIG. 4 shows that a ratio of the second electroplated layer-metallic element (Cu) is continuously decreased in the thickness range equal to or greater than 60 nm. FIG. 4 shows that a ratio of the second electroplated layer-metallic element (Zn) is continuously decreased in the thickness range equal to or greater than 40 nm. FIG. 11 and FIG. 12 are similar to FIG. 4. FIG. 13 shows that a ratio of the second electroplated layer-metallic element (Cu, Zn) continuously decreased steeply in the thickness range equal to or greater than 10 nm and/or 20 nm.

As would be understood from the above disclosure, in some cases, a thickness of a portion of the electroplated layer 52 where the ratio of the second electroplated layer-metallic element is continuously decreased as being away from the base member 51 in the thickness direction of the electroplated layer 52 is equal to or less than 80 nm or 60 nm or 30 nm or 20 nm. FIG. 4 shows that a ratio of the second electroplated layer-metallic element (Cu, Zn) is continuously decreased in the thickness range equal to or less than 80 nm or 60 nm. The same applies to FIG. 11 and FIG. 12. FIG. 13 shows that a ratio of the second electroplated layer-metallic element (Cu, Zn) is continuously decreased steeply in the thickness range equal to or less than 30 nm and/or 20 nm.

As would be understood from the above disclosure, in some cases, a ratio of the first electroplated layer-metallic element at a surface of the electroplated layer 52 is less than 100% or 90%. The ratio of the first electroplated layer-metallic element at the top surface of the electroplated layer 52 is less than 100% because of the second electroplated layer-metallic element in the electroplated layer. The ratio of the first electroplated layer-metallic element at the surface of the electroplated layer 52 is less than 100% theoretically or less than 90% even considering foreign body or measurement errors. For example, in the embodiment of FIG. 13, an electroplating finishes when Sn of the first electroplated layer-metallic element reaches 35%. In the conventional barrel plating, a ratio of electroplated layer-metallic element at a surface of an electroplated article at the time of end of electroplating will be 100% theoretically or will be equal to or greater than 90% even considering foreign body or measurement errors. Electroplating may be stopped when electroplated articles are in an electroplated condition with desired color-appearance so that electroplated articles having slightly different color-appearance may be easily produced.

Figure 19:
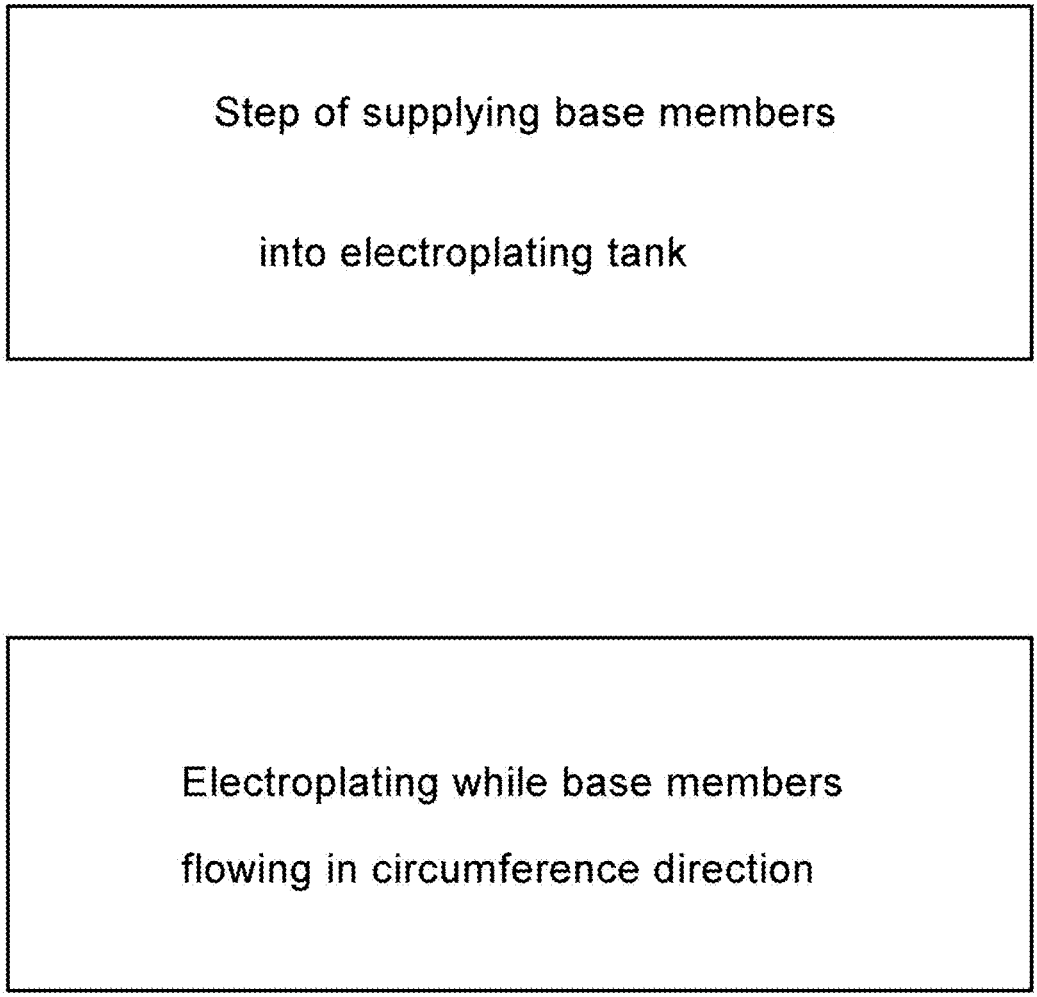
FIG. 19 is a schematic flowchart showing a non-limiting exemplary method of manufacturing electroplated articles according to an aspect of the present disclosure.
Figure 20:
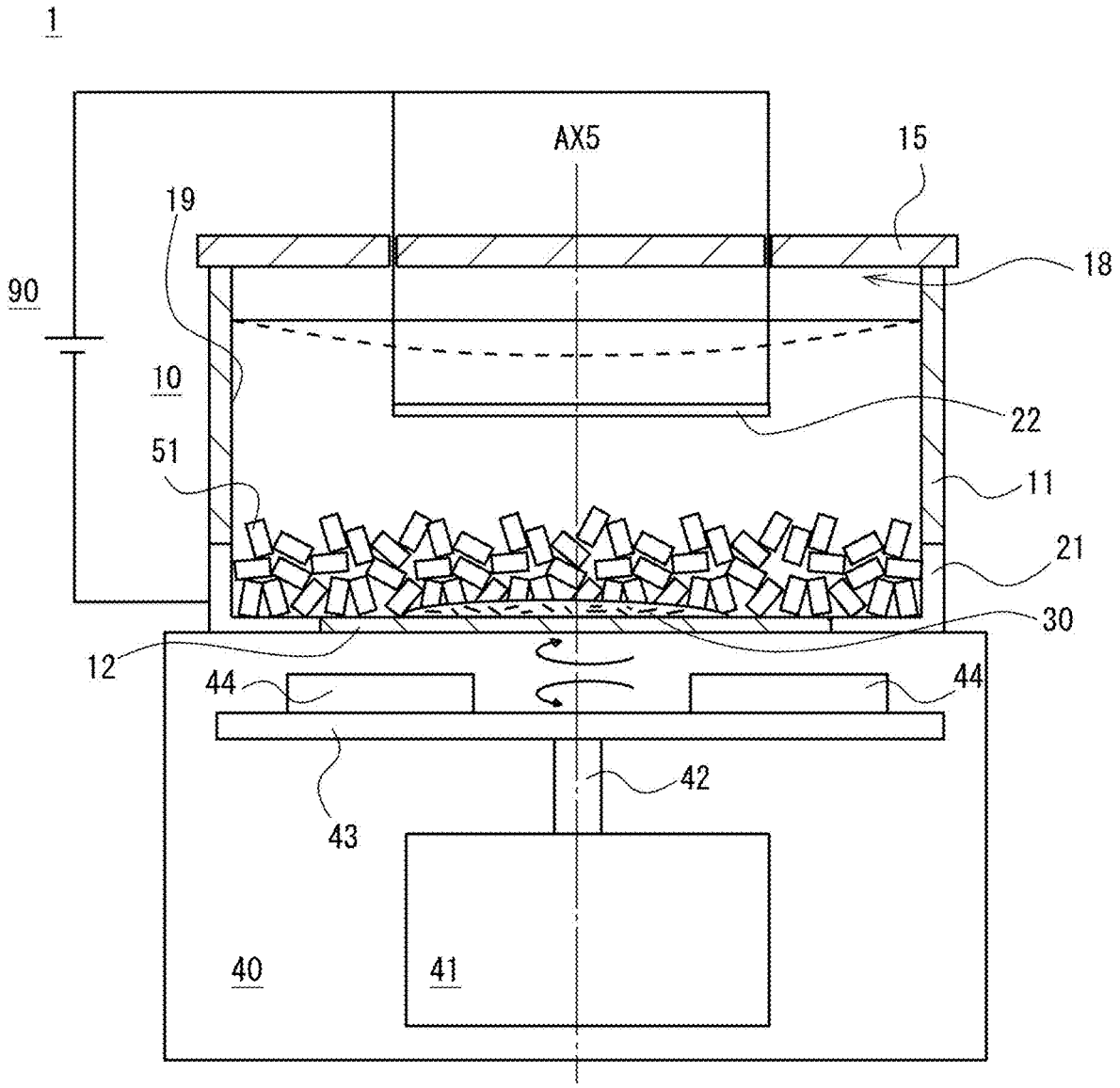
FIG. 20 is a view showing a schematic configuration of a non-limiting exemplary apparatus for electroplating usable for manufacturing electroplated articles according to an aspect of the present disclosure.
Figure 21:
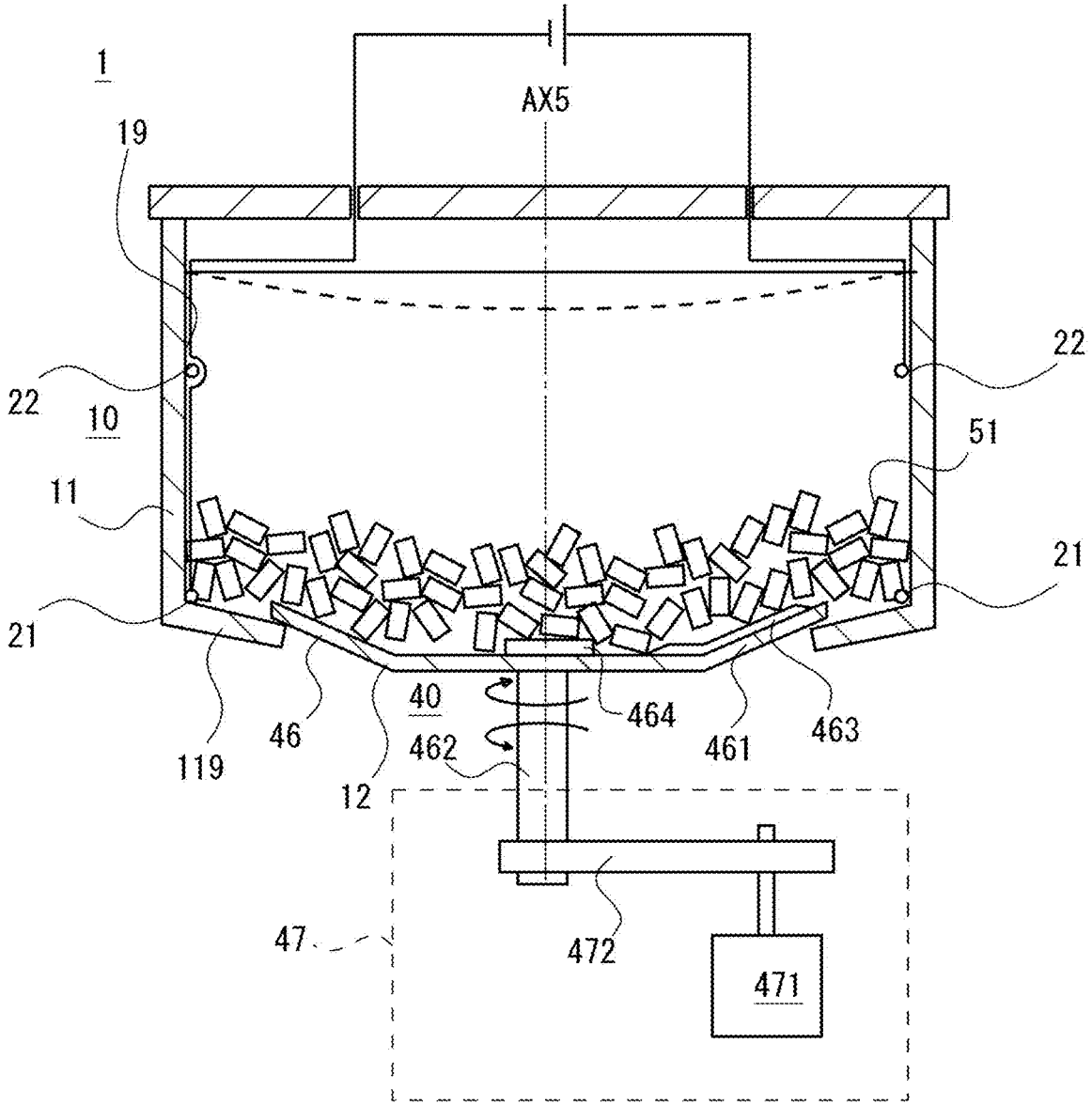
FIG. 21 is a view showing a schematic configuration of non-limiting exemplary apparatus for electroplating usable for manufacturing electroplated articles according to an aspect of the present disclosure.

Hereinafter, a method of manufacturing a non-limiting exemplary electroplated article (or a plating method) and a configuration of an electroplating apparatus used for that methods will be described with reference to FIGS. 19-21. It should be noted that FIGS. 19-21 and related descriptions will not give any limitation to electroplated article identified in claims as a product. FIG. 19 is a schematic flowchart showing a non-limiting exemplary method of manufacturing electroplated articles. FIG. 20 is a view showing a schematic configuration of a non-limiting exemplary apparatus for electroplating usable for manufacturing electroplated articles. FIG. 21 is a view showing a schematic configuration of a non-limiting exemplary apparatuses for electroplating usable for manufacturing electroplated articles.

As shown in FIG. 19, a method of manufacturing electroplated articles may include a step of supplying base members each including a base member-metallic element into an electroplating tank, and a step of flowing the base members in a circumference direction and electroplating the base members in the electroplating tank. An electroplated layer, which includes a first electroplated layer-metallic element that is different from the base member-metallic element, is formed directly on the base member by that electroplating method. As described above, the electroplated layer formed as such further includes the base member-metallic element. As described above, a ratio of the second electroplated layer-metallic element in the electroplated layer is decreased as being away from the base member in the thickness direction of the electroplated layer and/or a clear interface does not exist between the base member and the electroplated layer. Other features described in relation to the electroplated article 5 will be effective for the electroplated article described in this paragraph.

A plating apparatus 1 according to some exemplary embodiments as shown in FIGS. 20 and 21 is equipped with a plating tank 10 that is filled with an electrolytic solution, and an agitation mechanism 40 that causes a multiple of base members 51 to flow that have been immersed in the electrolytic solution stored in the plating tank 10. The electrolytic solution may be a cyanide electrolytic solution, for example. The base member 51 may be referred to as an article to be electroplated in some cases. The circumstantial flow of the base members 51 is caused in accordance with actuation of the agitation mechanism 40 and plating is also performed simultaneously. In some cases, the agitation mechanism 40 causes a multiple of base members 51 that has been immersed in the electrolytic solution inside of the plating tank 10 to flow in a circumference direction along an inner wall 19 of the plating tank 10 while the multiple of base members 51 are kept substantially submerged condition.

The agitation mechanism 40 in some exemplary cases of FIG. 20 magnetically affects a multiple of magnetic media 30 in the electrolytic solution in the plating tank 10 to flow the multiple of magnetic media 30. When the magnetic media 30 flow, the magnetic media 30 hit the base member 51. Impetus of the magnetic media 30 transmits to the base members 51, and the base members 51 start to flow. Due to continuous or periodical collisions between the magnetic media 30 and the base members 51, a flow of the base members 51 is maintained or facilitated. Due to contacts and collisions between the base members 51 and contacts and collisions between the base members 5 and the magnetic media 30, the base members 51 and the electroplated layers 52 are polished.

In some cases of exemplary FIG. 21, the agitation mechanism 40 causes a multiple of base members 51 to flow in the circumference direction by rotation of an agitation unit 46 that is provided at a bottom side of the plating tank 10. The agitation mechanism 40 is provided with an agitation unit 46 that is provided rotatably at the bottom side of the plating tank 10, and a torque-supply mechanism 47 to supply torque to the agitation unit 46. In accordance with rotation of the agitation unit 46, each base member 51 flows in the circumference direction. The base members 51 and the electroplated layers 52 are polished by contacts and collisions between the base members 51 before electroplated layers 52 are formed or between the base members 51 onto which electroplated layers 52 are growing.

In some cases, the plating tank 10 includes a tubular portion 11 and a bottom portion 12. The tubular portion 11 is a cylindrical tube that has an opening 18 at its top portion which allows throw-in and recovery of the base members 51. A bottom end of the tubular portion 11 is provided with the bottom portion 12. The plating tank 10 and the tubular portion 11 are stationary members. The tubular portion 11 is arranged such that the central axis of the tubular portion 11 matches a rotational axis AX5 described below. The central axis of the tubular portion 11 and the rotational axis AX5 match the vertical direction in some cases. Therefore, a multiple of base members 51 thrown into the plating tank 10 sink downward vertically in the electrolytic solution and deposits on the bottom portion 12.

In some cases, the plating apparatus 1 is equipped with a bottom cathode 21 provided at a bottom side of the plating tank 10, and a top anode 22 provided upward relative to the bottom cathode 21. The bottom side is equal to a direction that the base member 51 sinks which are thrown into the electrolytic solution in the plating tank 10. The bottom cathode 21 is connected to an anode of a power source 90, and the top anode 22 is connected to a cathode of the power source 90.

Metal ions released or eluted from the top anode 22 into the electrolytic solution or metal ions which have been already provided in the electrolytic solution receive electrons from a base member 51 that is directly touching the bottom cathode 21, or receive electrons from a base members 51 that is electronically connected to the bottom cathode 21 via another base members 51. Metal ions deposit on the base member 51 once receiving the electrons, and thus an electroplated layer is formed. The base member 51 touching the bottom cathode 21 can supply electrons, transferred from the bottom cathode 21 to this base member 51, to the metal ions. The base member 51, not directly touching the bottom cathode 21 and being electrically connected to the bottom cathode 21 via other one or more base members 51, can supply electrons, originated from the bottom cathode 21 and transferred via other one or more base members 51, to the metal ions.

In some embodiments, a multiple of base members 51 flows in the circumference direction while being kept at substantially submerged condition in the electrolytic solution stored in the plating tank 10. At least one of the multiple of base members 51 touches the bottom cathode 21, and base members positioned upward relative to the base member 51 touching the bottom cathode 21 are electrically connected to the bottom cathode 21 via at least the base members 51 touching the bottom cathode 21. The circumferential flow of the base members 51 being kept at substantially submerged condition indicates that a large number of the base members 51 do not come to float in the electrolytic solution. The circumferential flow of the base members 51 being kept at substantially submerged condition does not exclude but include temporal floating of base members 51 due to accidental turbulence of flow of electrolytic solution or collisions between base members 51. In a specific case, the circumferential flow of the base members 51 being kept at substantially submerged condition indicates that, while the electroplating solution or the base members 51 are flowing at the maximum circulation speed, a majority of base members 51 touches the bottom portion of plating tank 10 or other base members 51, except for a quite small number of base members 51 which are temporarily floating due to accidental turbulence of flow of electrolytic solution or collisions between base members 51. Accordingly, it would be possible to surely secure electrical connection between the base member 51 and the bottom cathode 21, and to avoid that the base members 51 are rendered to be in a power non-supply condition.

In a common barrel plating, a multiple of base members 51 is agitated and electroplated while circulation speed of barrel is set at a low speed of 3 to 8 rpm, and thus it takes a longer time period to produce even and shade-less electroplated articles. In contrast, according to a method of the present disclosure, shortening of a required time period for producing even and shade-less electroplated articles may be facilitated. In some cases, the time period of electroplating is half of that required for a barrel plating.

The bottom cathode 21 extends in the circumference direction nearby the inner wall 19 at the bottom side of the tubular portion 11. The bottom cathode 21 may be a ring-like electrode positioned at the bottom side of the plating tank 10. In a case where the bottom cathode 21 includes a ring-like electrode, sufficient contact between the base member 51 and the bottom cathode 21 may be ensured as the multiple of base members 51 flows in the circumference direction. Note that the circumference direction is a direction directed along an inner wall 19 of the plating tank 10, and should not be limited to a direction based on a perfect circle shape and could include any direction based on an oval or other shapes. It should be noted that a bottom cathode may preferably be shaped like a ring, but could be any shapes like a bar, a plate or sphere and so on. A whole or part of the bottom portion 12 of the plating tank 10 can be a cathode.

The top anode 22 extends in the circumference direction, and therefore a difference in growth rate of electroplated layer in the circumference direction may be avoided or suppressed. More particularly, the top anode 22 extends along the circumference direction at the side of the opening 18 of the tubular portion 11. The top anode 22 is a ring-like electrode positioned at the top portion of the plating tank 10. In some cases, the top anode 22 is a metal wire and easily replaceable for a new metal wire, not necessarily limited to this though. In another example, the top anode 22 may be like a sphere, a plate or a chip. Various types of metal can be adopted for the top anode 22. For example, it may be one or more metal selected from a group of a carbon, stainless steel, copper, tin, zinc, brass, titanium, gold, silver, nickel, chromium, lead, palladium, cobalt, platinum, ruthenium, and rhodium. As electroplating progresses, the top anode 22 elutes into the electrolytic solution, and its volume and weight will be reduced as time progresses. It should be noted an anode or cathode extending in the circumference direction does not mean a perfect circle, but includes a manner where electrodes are arranged in the circumference direction partially intermittently.

A desired finish color may be achieved by properly adjusting a type of metal material of the top anode 22 and composition of electrolytic solution. For example, the base member 51 is covered by an electroplated layer having a color of gold, black, silver, light copper, deep copper, or brown.

Various types of metal can be adopted for the bottom cathode 21. For example, it may be one or more metal selected from a group of stainless steel, copper, tin, zinc, stainless steel, carbon, titanium, gold, silver, nickel, chromium, lead, palladium, cobalt, platinum, ruthenium, and rhodium. An electroplated layer grows either on the bottom cathode 21. Therefore, in some cases, the electroplated layer is removed or the bottom cathode 21 is replaced at an appropriate timing.

The electroplating apparatus 1 further has a lid 15 in some cases. The lid 15 is provided with openings allowing a wiring to pass there-through which is coupled to the top anode 22. The height of the top anode 22 in a depth direction of the plating tank 10 is determined by defining a spacing between the lid 15 and the top anode 22. In other words, a lid 15 is placed on the plating tank 10 so that the top anode 22 is positioned at an appropriate height in the plating tank 10.

In some exemplary cases of FIG. 20, a multiple of magnetic media 30 is thrown into the plating tank 10 additionally to the multiple of base members 51. This is because that, as described above, the agitation mechanism 40 of FIG. 20 does not directly affect the base members 51 to flow the base members 51, but affects the base members 51 via the multiple of magnetic media 30. In some cases, one piece of magnetic media 30 is sufficiently small compared to one piece of base member 51. A type of magnetic media 30 may be various. As an example, the magnetic media 30 can be bar-like members or needle-like members. In another example, the magnetic media 30 may be like a sphere, a rectangular solid, a cube, or a pyramid. The magnetic media 30 can typically be made of stainless steel, but not necessarily limited to this though. When the magnetic media 30 is a bar-like or needle-like stainless steel member, at the time of collision with the base members 51, an outermost surface of electroplated layer of the base member 51 can be effectively polished. It should be noted that a top anode 22 may be hanged by a bar member without using the lid 15.

In some exemplary cases of FIG. 20, a flow of the multiple of base members 51 along the circumference direction is caused by the agitation mechanism 40 magnetically affecting the multiple of magnetic media 30 in the electrolytic solution in the plating tank 10 to cause the multiple of magnetic media 30 to flow in the circumference direction.

When the magnetic media 30 flows in the circumference direction, the magnetic media 30 has an impetus greater than that of the base member 51. Effective polishing of growing electroplated layer is facilitated.

In some cases, the agitation mechanism 40 has an electrically powered motor 41, a rotational axis 42, a rotating plate 43, and one or more permanent magnets 44. Rotational force generated by the electrically powered motor 41 is directly or indirectly transmitted to the rotational axis 42, and the rotating plate 43 fixed to the rotational axis 42 rotates and the permanent magnet 44 provided on the rotating plate 43 rotates in the circumference direction. It is envisaged that a torque transmission system, ex. an endless belt and so on is provided between the electrically powered motor 41 and the rotational axis 42. A specific configuration of the agitation mechanism 40 would be determined properly by a skilled person in the art.

In some cases, the agitation mechanism 40 can include a magnetic circuit. By properly designing a magnetic circuit, the magnetic media 30 may flow in the circumference direction without rotating any physical members.

The permanent magnet 44 is fixed to the top surface of the rotating plate 43 such that N-pole is upwardly directed in a vertical direction, for example. The magnetic media 30 is attracted by the permanent magnet 44. Therefore, the permanent magnet 44 is entrained by the magnetic media 30 as the permanent magnet 44 moves in the circumference direction. As such, the flow of the magnetic media 30 in the circumference direction is caused, and thus the flow of the base members 51 in the circumference direction is caused.

In some exemplary cases of FIG. 21, the agitation unit 46 includes a disk portion 461 configuring at least a portion of the bottom portion of the plating tank 10, and a rotational axis 462 coupled to the disk portion 461. The top surface of the disk portion 461 matches the bottom surface of the bottom portion 12 of the plating tank 10. The center of the top surface of the disk portion 461 is provided with a projection 464 projecting upward in a vertical direction. A radial array of blades 463 is provided on the top surface of the disk portion 461 which are projecting upwardly, i.e. upwardly in a vertical direction. The blades 463 are arranged radially around the center of the disk portion 461.

When the agitation unit 46 rotates around the rotational axis AX5, the blades 463 also rotates around the rotational axis AX5. When focusing on one blade 463, the one blade 463 moves along the circumference direction, causing a flow of electrolytic solution and causing a flow of base members 51 along the circumference direction. The blade 463 may directly touch or hit the base members 51. In some cases, the blade 463 has a lower height from the top surface of the disk portion 461. This facilitates smooth rotation of the agitation unit 46. As such, uniform agitation of base members 51 inside of the plating tank 10 is facilitated. Note that the tubular portion 11 of the plating tank 10 is a stationary member.

A slant portion provided on a radially outer region of the disk portion 461 is provided on a flange portion 119 extending radially inwardly and provided at the bottom end of the tubular portion 11 of the plating tank 10. A non-illustrated drain pipe is connected to a space between the slant portion of the disk portion 461 and the flange portion 119. The electrolytic solution in the plating tank 10 can be drained by opening and closing the drain pipe.

The torque-supply mechanism 47 includes an electrically powered motor 471 and a motive power transmission belt 472. A torque is transmitted from the electrically powered motor 471 to the rotational axis 462 of the agitation unit 46 via the motive power transmission belt 472. Accordingly, the rotational axis 462 rotates, the disk portion 461 coupled to the rotational axis 462 rotates, and the blade 463 on the top surface of the disk portion 461 moves along the circumference direction. Accordingly, a multiple of base members 51 that has been immersed down onto the disk portion 461 of the agitation unit 46 in the electrolytic solution of the plating tank 10 freely moves along the circumference direction.

In some cases, a low-friction member is provided on the bottom surface at the bottom portion 12 radially inwardly of the bottom cathode 21. This facilitates the flow of the base members 51 on the bottom portion 12. In some cases, additionally or alternatively, the low-friction member is provided on the inner wall 19 of the plating tank 10. For example, the low-friction member is a resin-made sheet such as a polyethylene, polypropylene, polyvinyl chloride, or polyurethane, for example.

In some exemplary embodiments of FIGS. 20 and 21, agitation and electroplating are performed simultaneously in the plating apparatus 1. During agitation step, surfaces of base members 51 are polished and surfaces of electroplated layer 52 on the base members 51 are polished. In an apparatus of FIG. 20, the magnetic media 30 collides with the base members 51, and additionally the base members 51 collide with one another, thereby the electroplated layer 52 can grow while affecting surface conditions. In the apparatus of FIG. 21 either, rotational number is regulated and the base members 51 collide with one another at a given or greater frequency so that the electroplated layer 52 can grow while affecting surface conditions. Note that the electroplated layer shown in FIGS. 4, 11, 12, and 16-18 are formed by the electroplating apparatus 1 of FIG. 20. The electroplated layer of FIGS. 13 and 14 is formed by the electroplating apparatus 1 of FIG. 21.

It may be seen that polishing of the electroplated layers while the electroplated layers are growing is against an initial object for growing the electroplated layer. However, when the electroplated layers are polished while the electroplated layers grow, a degree of flatness would be enhanced at thin thickness range of electroplated layer. As a result, thin electroplated layers are obtained with a desired finish appearance, in other words with a desired flatness or gloss. Thinning of electroplated layer may result in reduced time and power required for electroplating, and may results in remarkably reduced product unit price of electroplated article 5 and/or costumery part 7.

In some cases, a direction of flow of base members 51 is reversed during agitation. Accordingly, it would be possible to facilitate to reduce or avoid that the base members 51 gather on the bottom portion 12 of the plating tank 10.

The maximum rotational speed (rpm) of base members 51 in the plating tank 10 may preferably be a value that is sufficient to maintain the substantially submerged condition of base members 51. The maximum rotational speed (rpm) indicates a rotational speed of base member 51 that is at a maximum rotating state among the base members 51 supplied there. The rotational speed of base members 51 changes in accordance with an input volume of base members 51 but, in this case either, the input volume and rotational number may preferably be set such that the substantially submerged condition is maintained. In some cases, the electroplating solution has 20 to 30 liter, and the input volume of base members 51 is 10 gram to 8000 gram, and magnetic media of roughly 50 cc is placed into a plating tank.

In some cases, in the type of plating apparatus shown in FIG. 20, the maximum rpm of base members 51 in the plating tank 10 is maintained to be less than 40 rpm. Variation of electroplated layer thickness is thus effectively lowered.

In some cases, in the type of plating apparatus shown in FIG. 20, the maximum rpm of base members 51 in the plating tank 10 is maintained to be less than 30 rpm or 25 rpm or 20 rpm or 15 rpm or 10 rpm.

In some cases, in the type of plating apparatus shown in FIG. 21, the maximum rpm of base members 51 in the plating tank 10 is maintained to be less than 120 rpm. Variation of electroplated layer thickness is thus effectively lowered.

In some cases, in the type of electroplating apparatus shown in FIG. 21, the maximum rpm of base members 51 in the electroplating tank 10 is maintained to be less than 100 rpm or 80 rpm or 70 rpm or 60 rpm or 50 rpm. Note that, in a type of electroplating apparatus shown in FIG. 21, as described above, chance of collisions between base members 51 may be regulated by setting the rotational speed, but it is possible to further add media for polishing and cause collisions between the polishing media and base members 51.

Figure 22:
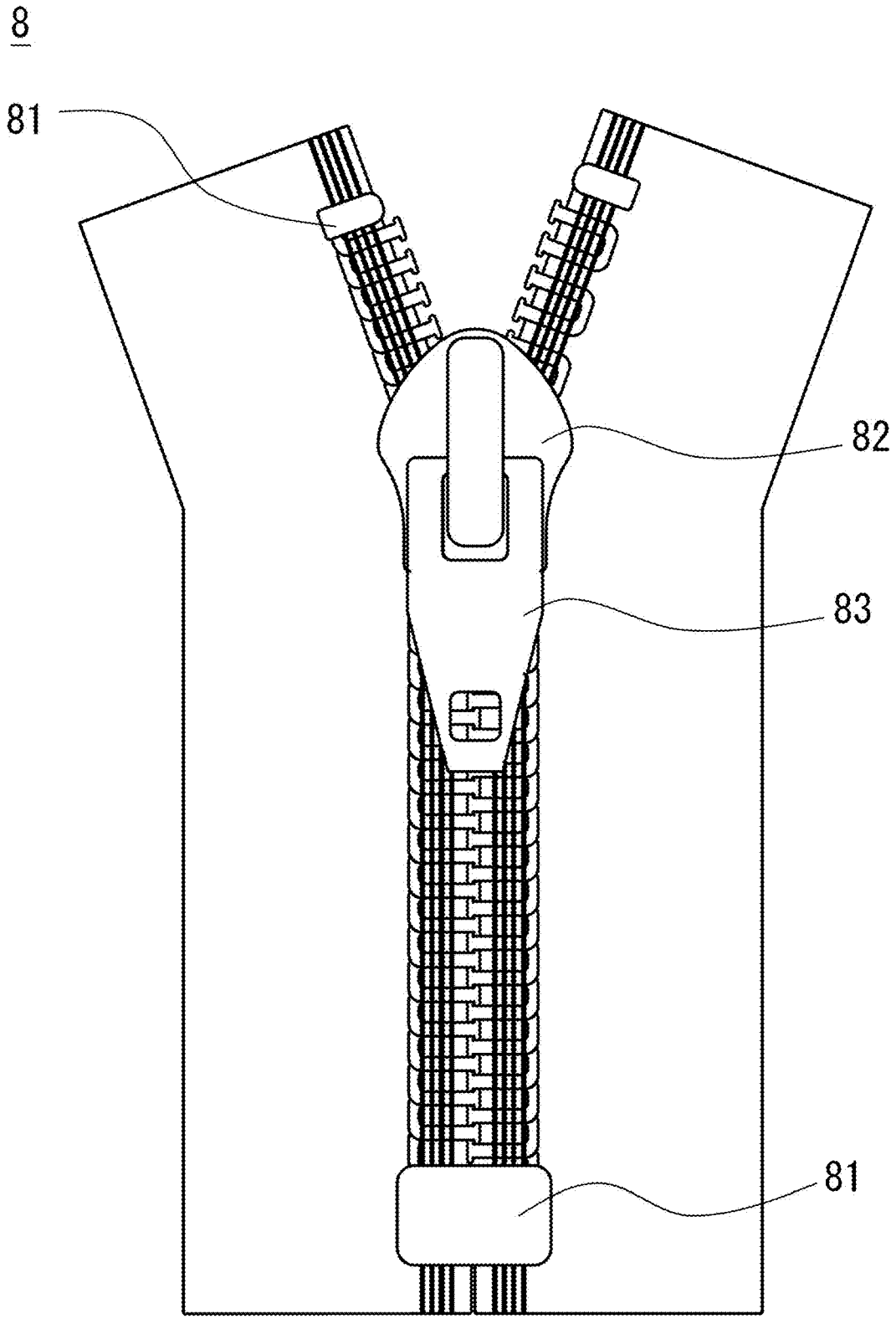
FIG. 22 is a schematic elevational view of a slide fastener which is seen to understand a variation of electroplated articles.

FIG. 22 is a schematic elevational view of a slide fastener which is seen to understand a variation of electroplated articles. An electroplated article 5 may be a metallic part included in a slide fastener 8 such as a stop 81, slider 82, and pull-tab 83, for example.

Figure 23:
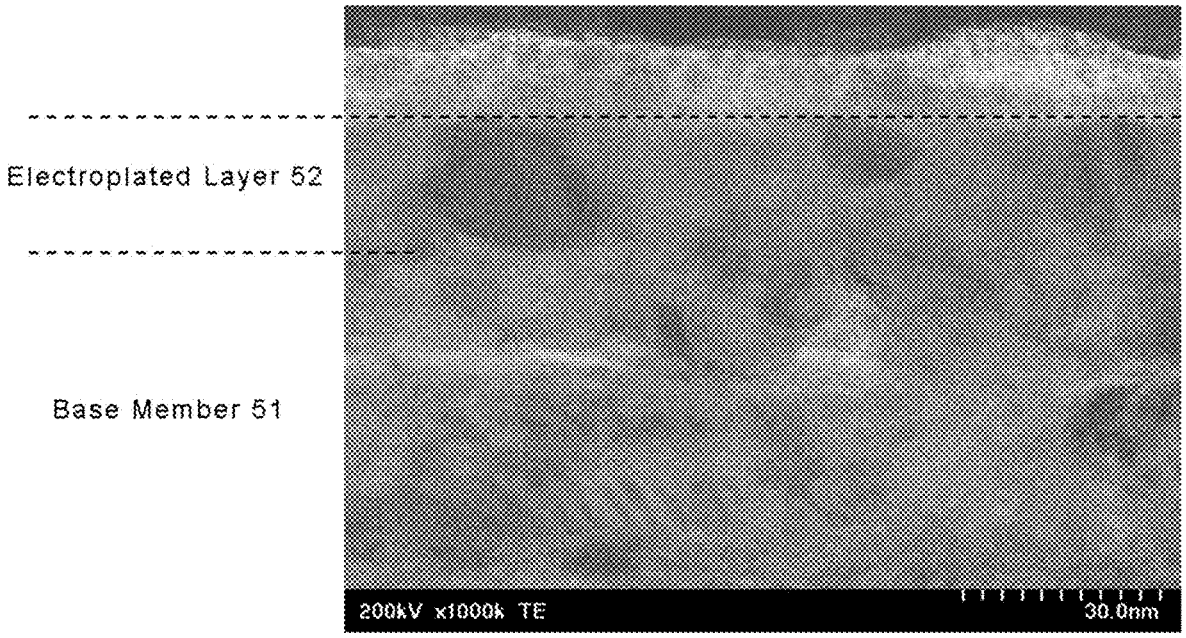
FIG. 23 is a TEM image (Magnification is 1,000,000×, and Size of field is 0.13 μm*0.09 μm) of a cross-section of an electroplated article according to an aspect of the preset disclosure.
Figure 24:
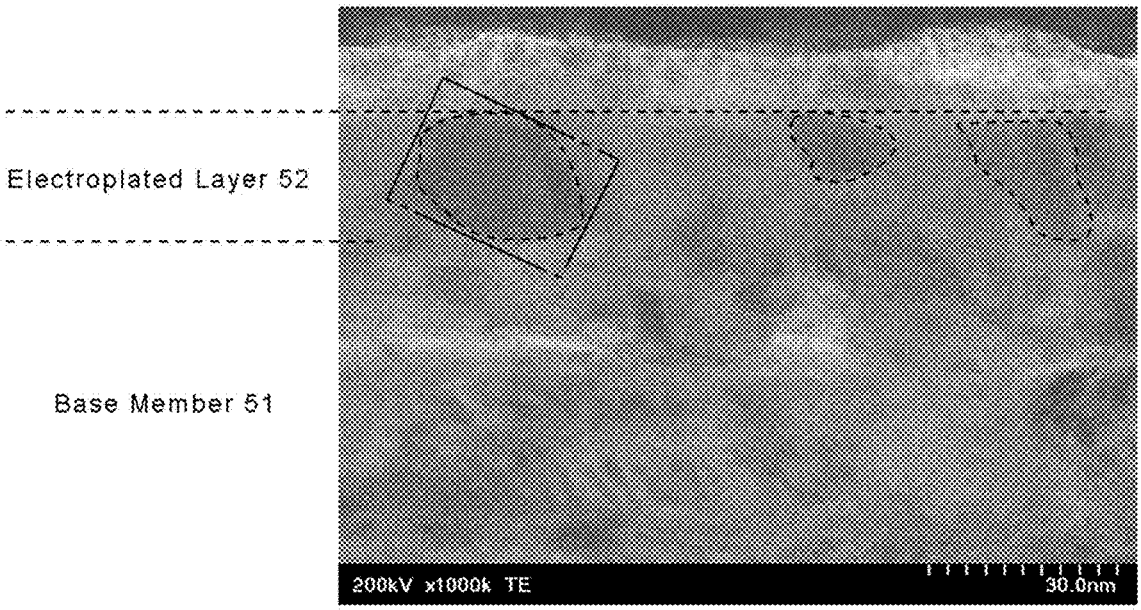
FIG. 24 is the same TEM image as FIG. 23 (Magnification is 1,000,000×, and Size of field is 0.13 μm*0.09 μm), where dotted lines point out three grains included in the distribution of grains in an electroplated article. Area of grain is calculated as a half of area of rectangular frame of dash-dotted line applied so as to surround the grain.
Figure 25:
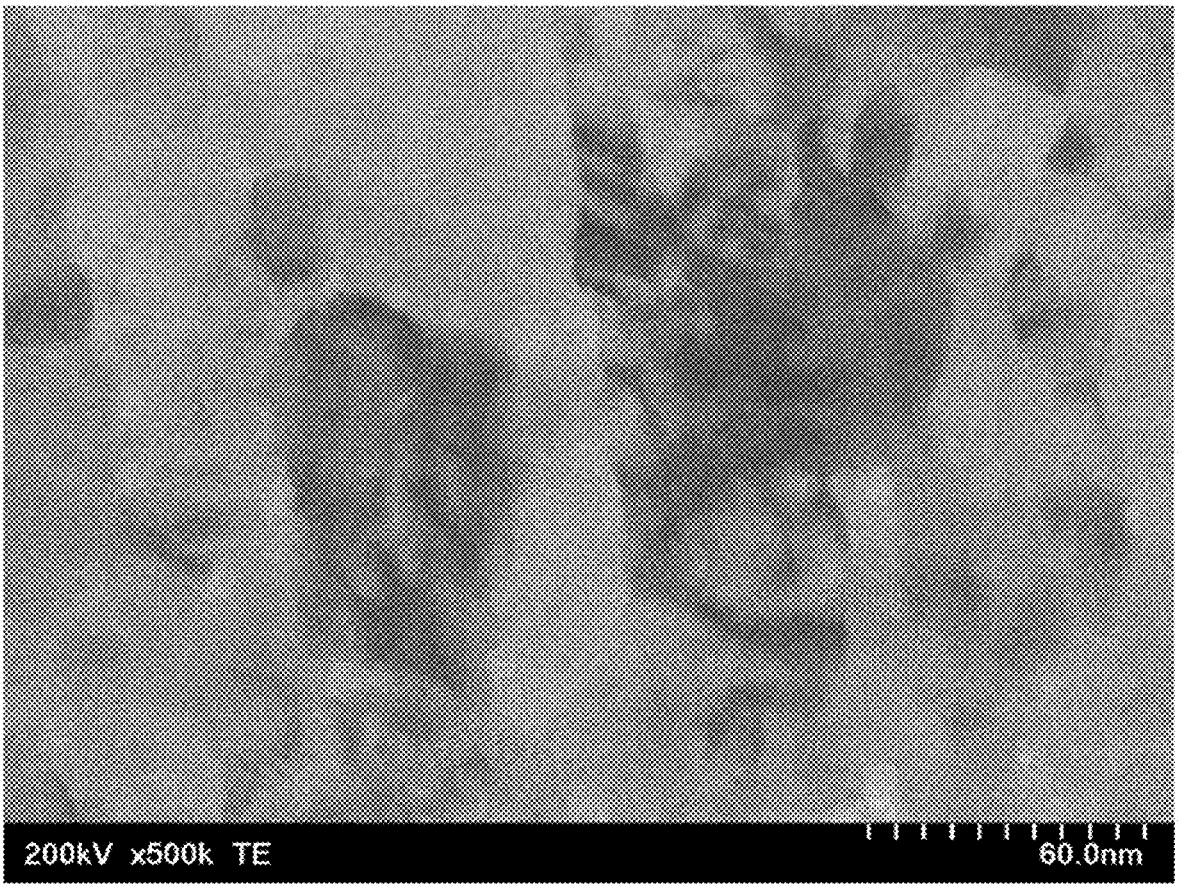
FIG. 25 is a TEM image of a cross-section of a conventional electroplated article (Magnification is 500,000×, and Size of field is 0.28 μm*0.20 μm).
Figure 26:
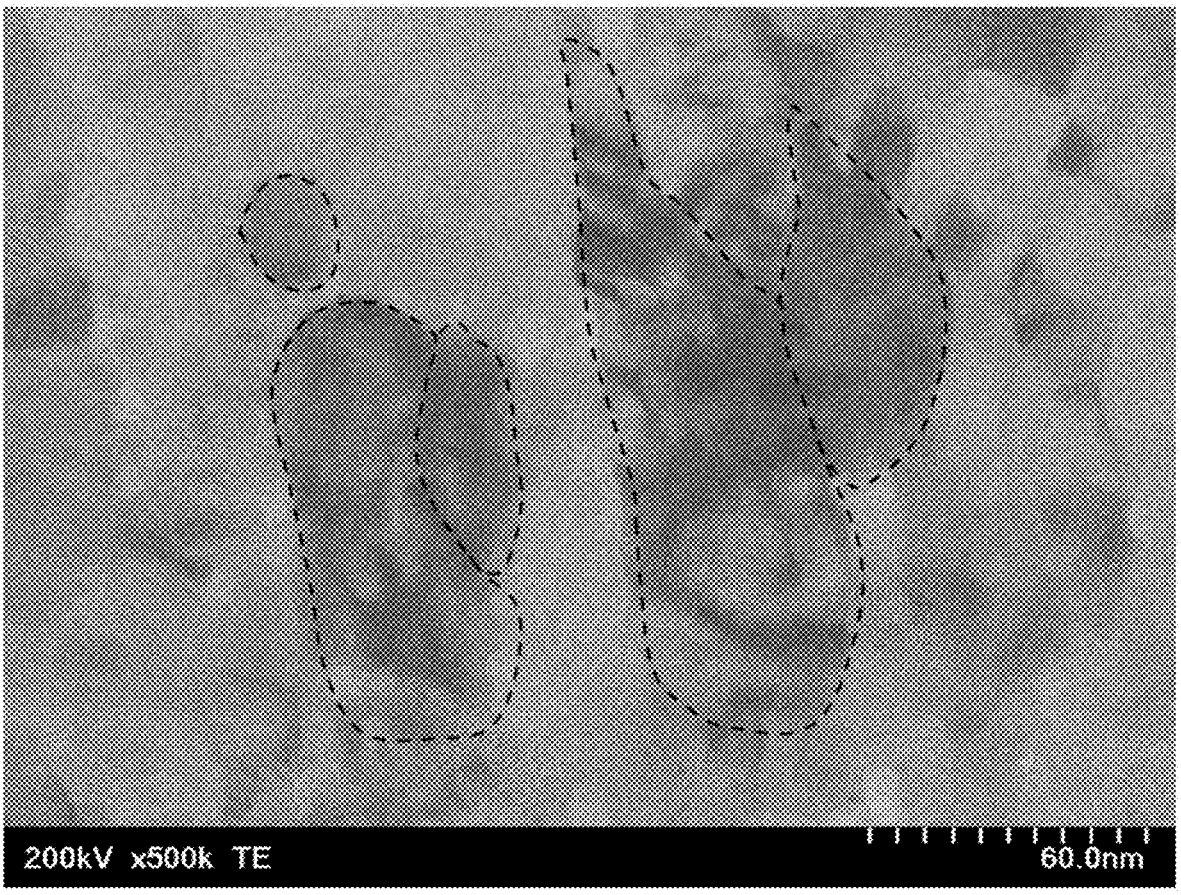
FIG. 26 is the same TEM image as FIG. 25 (Magnification is 500,000×, and Size of field is 0.28 μm*0.20 μm), where dotted lines point out five grains included in the distribution of grains in an electroplated article.
Figure 27:
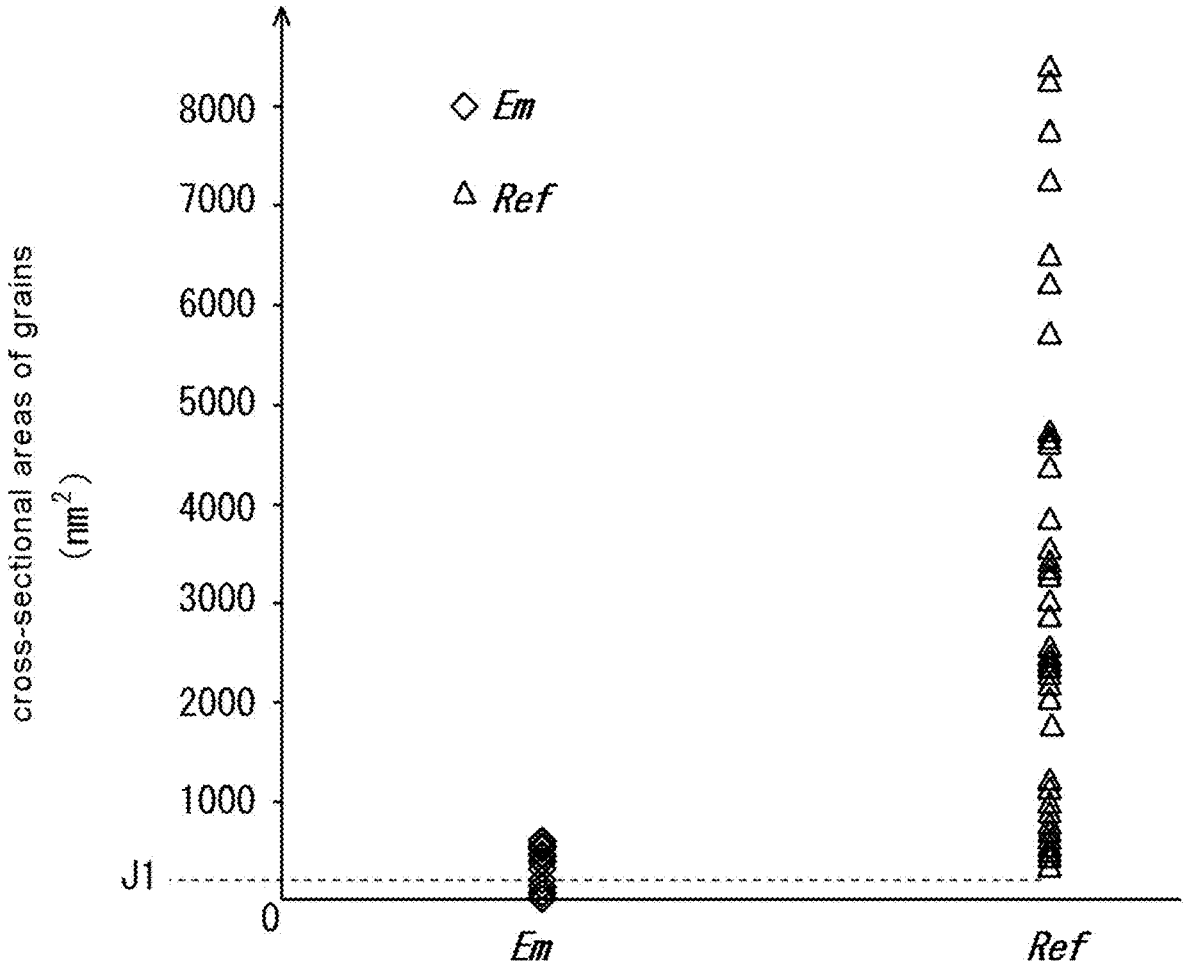
FIG. 27 is a chart showing a distribution of areas of grains determined based on applications of rectangular frames to the grains.
Figure 28:
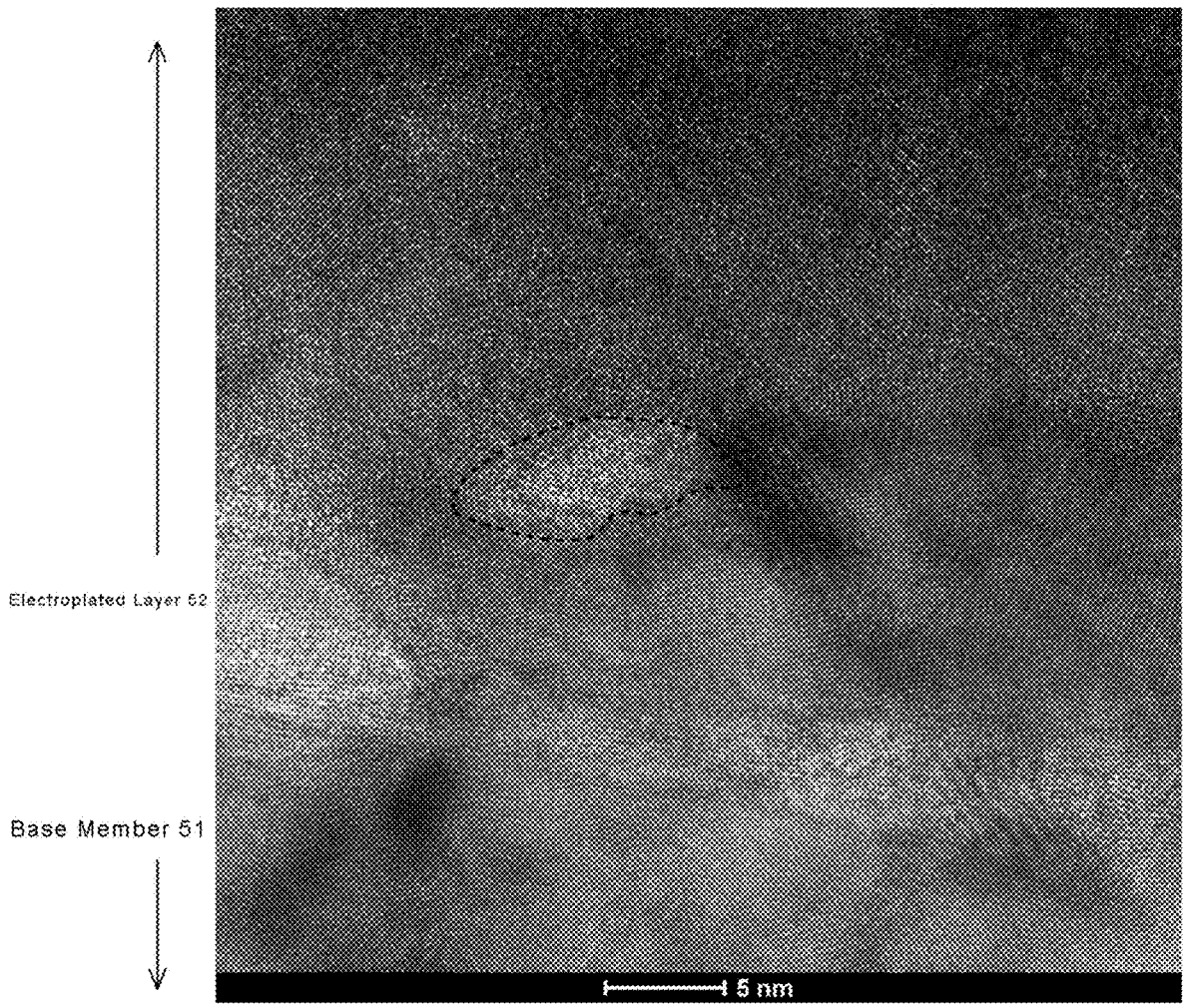
FIG. 28 is a TEM image (Magnification is 1,000,000×, and Size of field is 40 nm*40 nm), showing a cross-section of an electroplated article according to an aspect of the preset disclosure with much smaller Size of field. A grain (shown by dotted line in FIG. 28) having a width equal to or less than 25 nm in an initial growth region in an electroplated layer is shown (the grain shown by dotted line in FIG. 28 has a width about 10 nm). Arrangement of metal atoms is shown in this TEM image.
Figure 29:
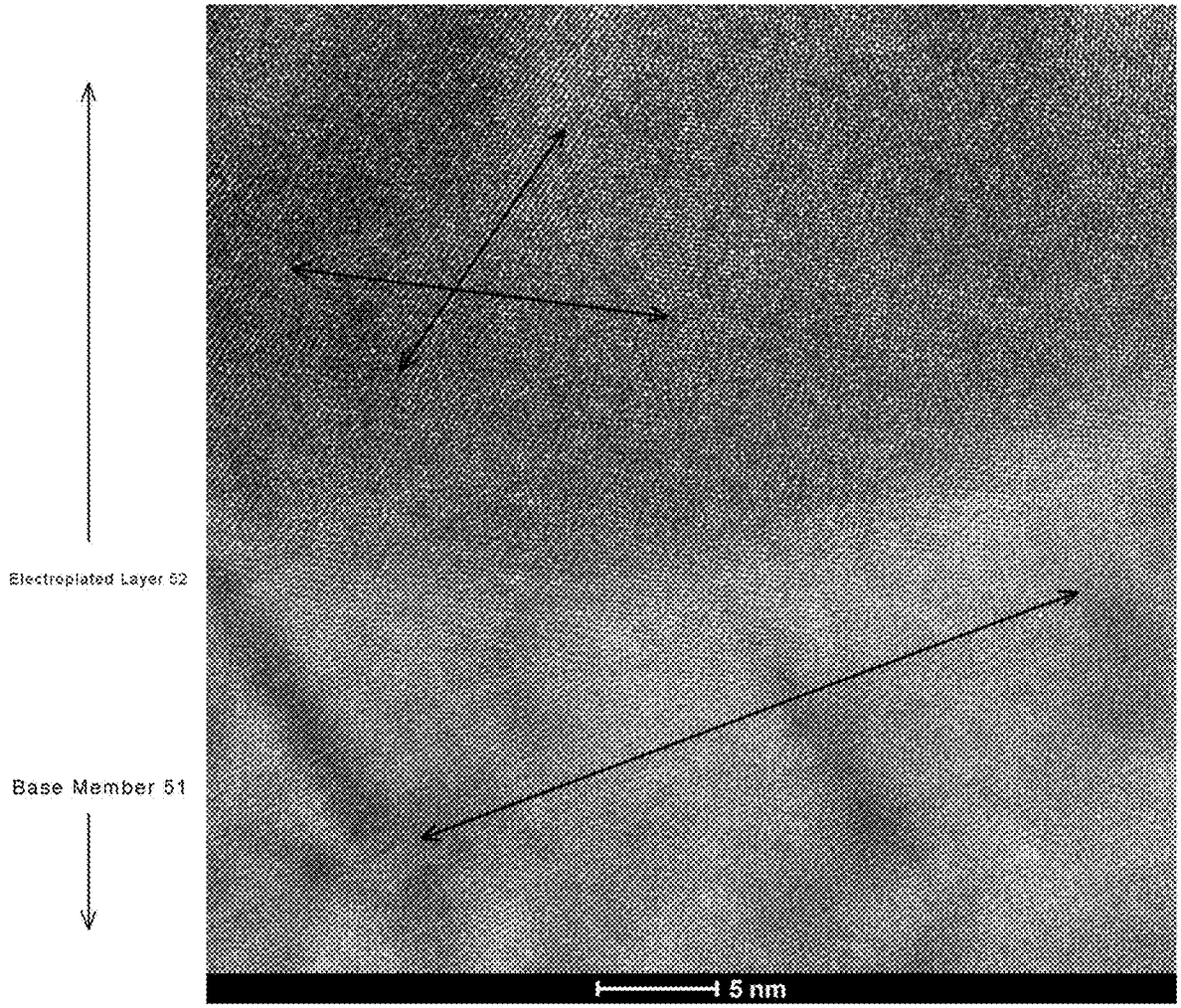
FIG. 29 is a TEM image (Magnification is 1,000,000×, and Size of field is 40 nm*40 nm), showing a cross-section of a conventional electroplated article with much smaller Size of field. It shows that the arrangement of metal atoms in the base member is different from the arrangement of metal atoms in the electroplated layer with an interface between the base member and the electroplated layer as a boundary.
Figure 30:
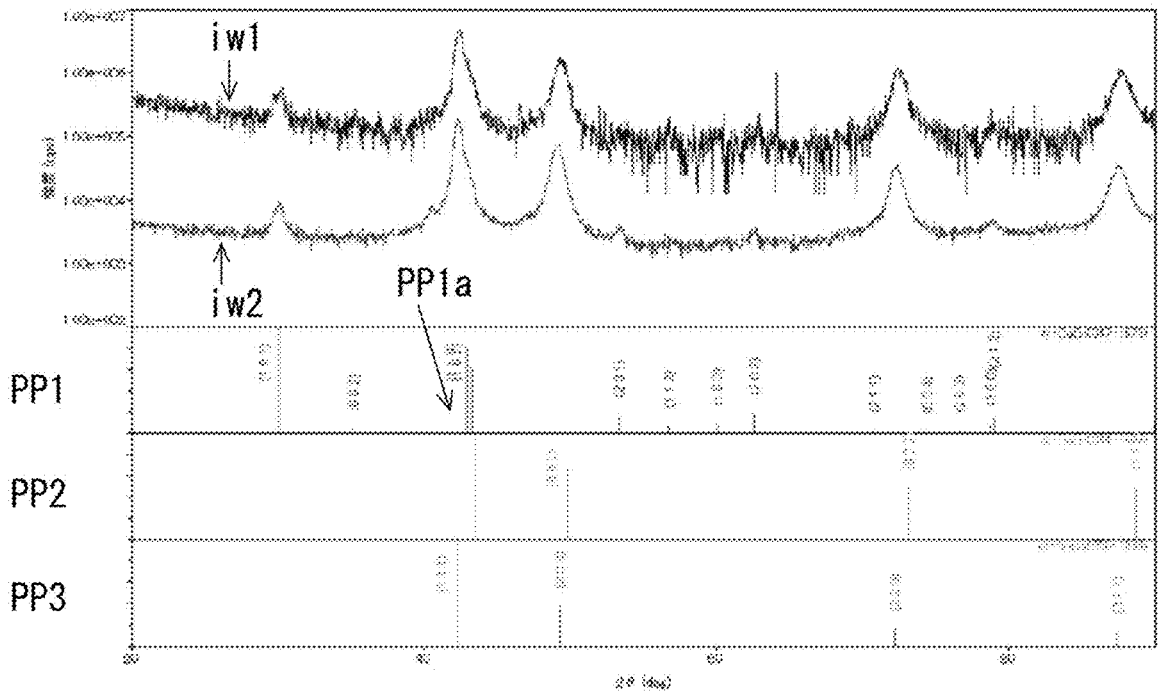
FIG. 30 is a graph showing a result of X-ray diffraction of an electroplated article according to an aspect of the present disclosure.
Figure 31:
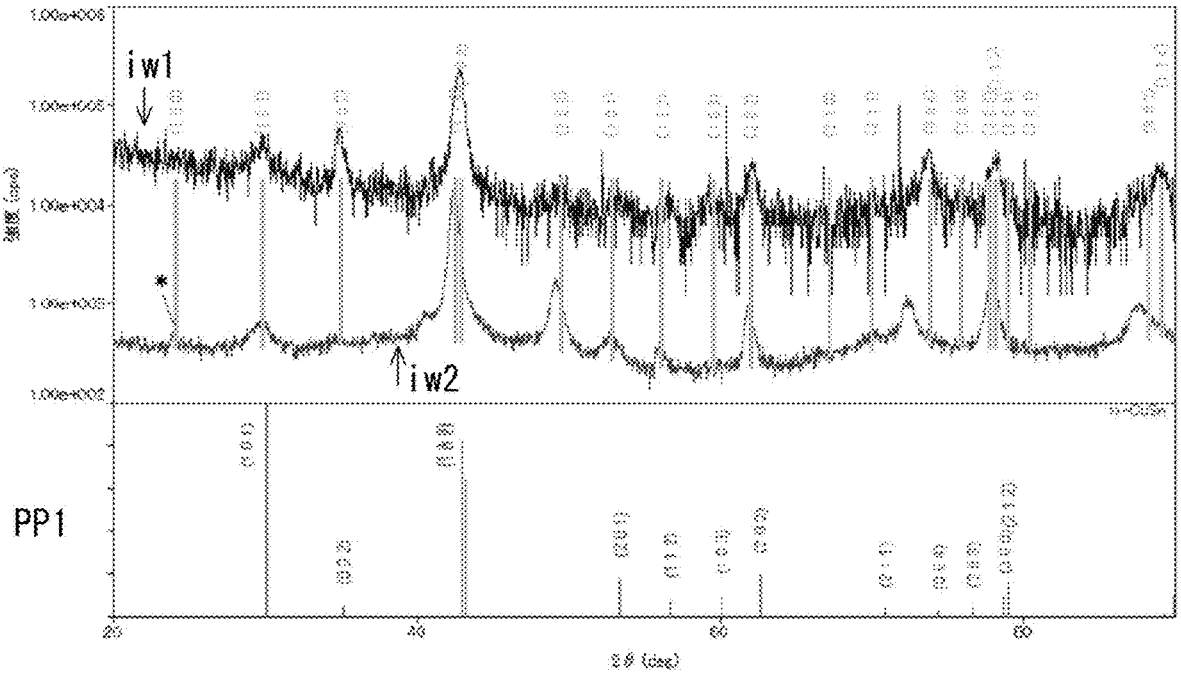
FIG. 31 is a graph showing a result of X-ray diffraction of a conventional electroplated article.
Figure 32A:
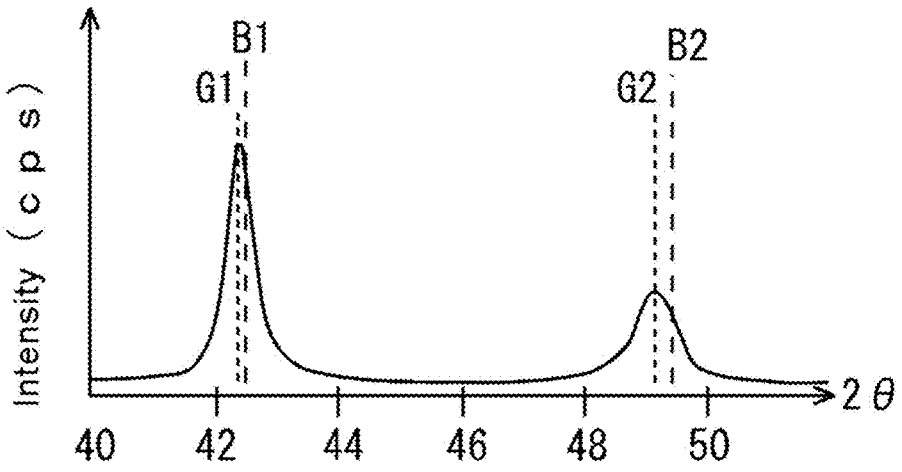
FIG. 32(*a*), FIG. 32(*b*), and FIG. 32(*c*) (collectively referred to as FIG. 32) are schematic views showing an expanded main portion in FIG. 30.
Figure 32B:
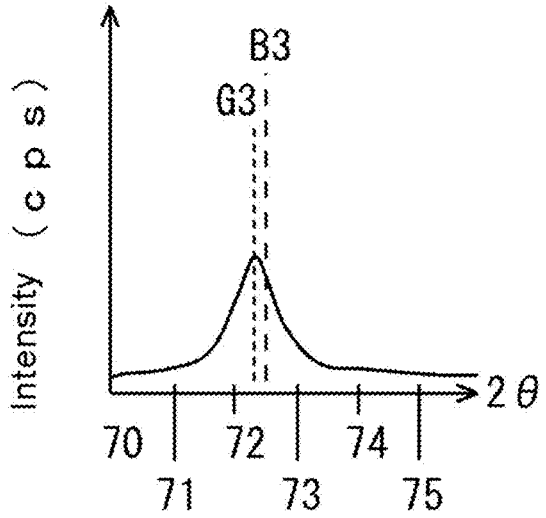
Figure 32C:
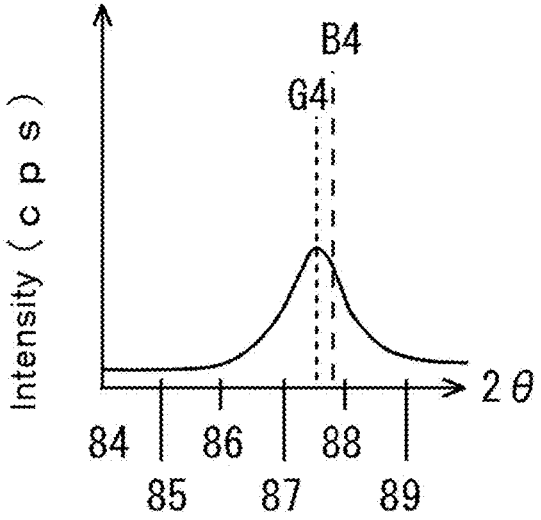

Further descriptions will be followed with reference to FIGS. 23-30. FIG. 23 is a TEM image of a cross-section of an electroplated article according to an aspect of the preset disclosure. FIG. 24 is the same TEM image as FIG. 23, where dotted lines point out three grains included in the distribution of grains in an electroplated article. A portion other than the three grains pointed out by the dotted lines is a portion where no contrast emerges in the image due to directionality of grains, and it is considered that each grain has an equivalent size as the grain pointed out by the dotted line. FIG. 25 is a TEM image of a cross-section of a conventional electroplated article. FIG. 26 is the same TEM image as FIG. 25, where dotted lines point out five grains included in the distribution of grains in an electroplated article. FIG. 27 is a chart showing a distribution of areas of grains determined based on applications of rectangular frames to the grains. Em shows areas of grains observed in an electroplated layer of an electroplated article shown in FIGS. 23 and 24. Ref shows areas of grains observed in an electroplated layer of an electroplated article shown in FIGS. 25 and 26. FIG. 28 is a TEM image showing a cross-section of an electroplated article according to an aspect of the preset disclosure with much smaller field. A grain (shown by dotted line in FIG. 28) having a width equal to or less than 25 nm in an initial growth region in an electroplated layer is shown (the grain shown by dotted line in FIG. 28 has a width about 10 nm). Arrangement of metal atoms is shown in this TEM image. FIG. 29 is a TEM image showing a cross-section of a conventional electroplated article with much smaller field. It shows that the arrangement of metal atoms in the base member is different from the arrangement of metal atoms in the electroplated layer with an interface between the base member and the electroplated layer as a boundary. FIG. 30 is a graph showing a result of X-ray diffraction of an electroplated article according to an aspect of the present disclosure. FIG. 31 is a graph showing a result of X-ray diffraction of a conventional electroplated article. FIG. 32 is a graph showing a result of X-ray diffraction of an electroplated article according to an aspect of the present disclosure.

As described above, no clear interface exists between the base member 51 and the electroplated layer 52 in the electroplated article 5 according to an aspect of the present disclosure. Such non-existence of clear interface between the base member 51 and the electroplated layer 52 is a result of distribution of alloy grains in the electroplated layer 52. The electroplated layer 52 is a set of multiple alloy grains, i.e. polycrystalline metal layer. In an aspect of the present disclosure, a clear interface is not formed between the base member 51 and the electroplated layer 52 due to the distribution of alloy grains in the electroplated layer 52. Furthermore, boundaries between alloy grains one another in the electroplated layer 52 is not clear either. This would provide an electroplated article with enhanced cohesion between the base member and the electroplated layer. In some cases, the electroplated layer 52 has a region where plural grains each having a width equal to or less than 100 nm or 50 nm gather densely. Boundary line between grains can be identified through observation based on the difference in the degree of shade (the difference of shade and tint) in a TEM image, and a line can be drawn between any two dots on the identified boundary line, defining a maximum width to which a width of grain refers in the present specification.

The electroplated article 5 observed in FIG. 23 is an electroplated article produced in the same method as the electroplated article observed in FIG. 6. The base member 51 consists of brass (CuZn), and the electroplated layer 52 includes tin (Sn) supplied from an electroplating solution. The electroplated layer of the electroplated article observed in FIG. 23 is formed through electroplating using the electroplating apparatus illustrated in FIG. 20. The thickness of the electroplated layer 52 of the electroplated article 5 observed in FIG. 23 is 20 to 30 nm. The thickness of the electroplated layer 52 is thinner than that of the electroplated article 5 observed in FIG. 6. This is because a time period of electroplating is shorter. Regarding the plating color of this electroplated article, a plating color would be more shade if a time period of plating is longer; and a plating color would be more tint if a time period of plating is shorter. The TEM image of FIG. 23 is obtained under magnification of 1,000,000 higher than that of the TEM image of FIG. 6.

As shown in FIG. 23, an interface between the base member 51 and the electroplated layer 52 is not clear, and further boundaries of grains in the electroplated layer 52 are also not clear. Note that, in FIG. 23, a dotted line indicating an interface between the base member 51 and the electroplated layer 52 is drawn as a rough guide which is determined based on point analysis with EDX (Energy Dispersive X-ray Spectrometry) and detection/none-detection of Sn. The interface between the base member 51 and the electroplated layer 52 is not clear as described so far. On one hand, the grains in the electroplated layer 52 can be identified as shown in FIG. 24 based on the difference, i.e. contrast, in the degree of shade (the difference of shade and tint) in a TEM image.

The electroplated article observed in FIG. 25 is an electroplated article produced in the same method as the electroplated article 5 observed in FIG. 8. The base member consists of brass (CuZn), and the electroplated layer consists of CuSn alloy. The thickness of the electroplated layer 52 of the electroplated article 5 observed in FIG. 25 is about 350 nm (FIG. 25 does not illustrate the entire thickness of the electroplated layer). The electroplated article observed in FIG. 25 is formed through barrel electroplating, but it is envisaged that the result would be similar even if formed through a rack/still plating. The TEM image of FIG. 25 is obtained by magnification of 500,000 higher than that of the TEM image of FIG. 8. Even though not repeatedly shown by a TEM image, in the electroplated article observed in FIG. 25, there is a clear interface between the base member and the electroplated layer (See FIG. 8, for example). The grains in the electroplated layer shown in FIG. 25 can be identified as shown in FIG. 26.

TEM image should be utilized as a cross-sectional image used for identifying grains. TEM image is obtained such that a cross-section of electroplated layer in the thickness direction of the electroplated layer is shown. For obtaining TEM images, a scanning transmission electron microscope (Model Number: TalosF200X) produced by Japan FEI company or a scanning transmission electron microscope (Model Number: HD-2300A) produced by Hitachi High-Technologies Corporation. Magnification is 50,000× to 1,000,000×. (It should be noted that, even for the same magnification, definition of magnification may differ for each transmission electron microscope. Therefore, strictly speaking, it would be more appropriate to evaluate the degree of magnification based on the area of the field. Based on this, the field is described together in the present specification.) Except for FIGS. 28 and 29, the TEM images are obtained by the HD-2300A. The TEM images of FIGS. 28 and 29 are obtained by the TalosF200X. For obtaining the SEM images, a scanning electron microscope (Model Number: S-4800) produced by Hitachi High-Technologies Corporation should be used. The SEM images of FIGS. 7, 10, 36, and 38 are obtained by the S-4800.

Cross-sectional area of the grain identified as above can be determined as follows. Again, firstly the boundary of grain is identified in a TEM image. For this purpose, an appropriate software can be used. Next, a rectangular frame (see a frame of dash-dotted line in FIG. 24) is applied to the grain so as to surround the grain, and a value of half of the area of the rectangular frame is determined as a cross-sectional area of the grain. The rectangular frame may be applied to the grain by a computer, and thus the Cross-sectional area of grain can be calculated out automatically based on the application of rectangular frame. The rectangular frame may be set so as to surround a grain inside thereof, and may contact with the boundary of the grain at plural points.

As shown in FIG. 27, manners of distributions of cross-sectional areas of grains are different between the case Em of an electroplated article according to the present invention shown in FIG. 23 and the case Ref of a conventional electroplated article shown in FIG. 25. Compared to the grains observed in the TEM image of FIG. 25, in the grains observed in the TEM image of FIG. 23, the cross-sectional areas of grains are distributed locally within a small range.

The thickness (=about 350 nm) of the electroplated layer of the electroplated article shown in FIG. 25 is thicker than the thickness (=20-30 nm) of the electroplated layer 52 of the electroplated article 5 shown in FIG. 23 in order to secure cohesion of the electroplated layer to the base member. However, even considering this, compared to the case of Ref the cross-sectional areas of grains are distributed locally within a small range in the case of Em as illustrated by the dotted line J1 in FIG. 27.

The Chart shown in FIG. 27 illustrates, for the case of Em, cross-sectional areas of grains determined based on application of rectangular frame after identifying 47 pieces of grains in a plurality of different TEM images (including the TEM image of FIG. 24, for example). The Chart shown in FIG. 27 illustrates, for the case of Ref cross-sectional areas of grains determined based on application of rectangular frame after identifying 48 pieces of grains in a plurality of different TEM images (including the TEM image of FIG. 26, for example). For the cases of Em and Ref average area, minimum area, maximum area are shown in the Chart 1 below.

CHART 1

| | Em | Ref |
|---|---|---|
| Average Cross-sectional Area | 209 | 2984 |
| Maximum Cross-sectional Area | 602 | 8421 |
| Minimum Cross-sectional Area | 31 | 355 |

In the electroplated article 5 according to an aspect of the present disclosure, alloy grains at least including first and second electroplated layer-metallic elements are distributed such that a clear interface is not formed between the base member 51 and the electroplated layer 52. The distribution of alloy grains may be observed based on TEM image of electroplated layer 52 as described above. A TEM image used for identifying grains may be obtained under a condition where Magnification is equal to or greater than 500,000×. In some cases, grains each having a width equal to or less than 100 nm or 50 nm or 25 nm may be included in a distribution of grains observed in the TEM image of electroplated layer 52. In other words, the electroplated layer 52 has a region where plural grains each having a width equal to or less than 100 nm or 50 nm gather densely. The TEM image showing the cross-section of the electroplated article according to an aspect of the present disclosure shown in FIG. 24 and the TEM image showing the cross-section of the conventional electroplated article shown in FIG. 26 are compared to see a difference which is represented by a feature that plural grains having widths equal to or less than 100 nm or 50 nm are densely arranged. Additionally or alternatively to this feature, it would be possible to recognize a feature that a total area of grains having widths equal to or less than 100 nm or 50 nm, which can be identified based on the difference of the degree of shade (the difference of shade and tint) in the TEM image showing the cross-section of the electroplated article, is greater than a total area of grains having widths greater than 100 nm. Furthermore, additionally or alternatively to the above features, it would be possible to recognize a feature that 90% or more or all grains, identified based on the difference of the degree of shade (the difference of shade and tint) in the TEM image showing the cross-section of the electroplated article, are grains having widths equal to or less than 100 nm or 50 nm. Distribution of grains including such grains may facilitate that no clear interface is formed between the base member 51 and the electroplated layer 52.

When a rectangular frame is applied to a grain observed in a TEM image of electroplated layer 52 and area of grain is determined as a value of half of area of this rectangular frame, the average area of grains in the TEM image of the electroplated layer 52 may be equal to or less than 1000 $nm^2$ or 500 $nm^2$ or 400 $nm^2$ or 300 $nm^2$ or 250 $nm^2$. Additionally or alternatively, the minimum area of grain in the TEM image of electroplated layer 52 is equal to or less than 50 $nm^2$ and/or the maximum area of grain in the TEM image of electroplated layer 52 is equal to or less than 1000 $nm^2$ or 700 $nm^2$. Distribution of such grains may facilitate that no clear interface is formed between the base member 51 and the electroplated layer 52.

The TEM image of FIG. 28 is one obtained with much smaller Field Size than the TEM image of FIG. 23, and it is possible to recognize the structure of crystal and the manner of arrangement of atoms. Striped pattern in the TEM image reflects the difference of direction of crystal (a growth direction). In FIG. 28, shade regions and thin regions having widths of 5-10 nm or 5-20 nm are randomly arranged. Therefore, in FIG. 28, it would be understandable that the crystal structure changes complicatedly by the interval of 5-10 nm or 5-20 nm. The grain identified by a dotted line in FIG. 28 is a grain that has a width equal to or less than 25 nm (about 10 nm in the illustrated example), and this is referred to as "microcrystal" in the present specification. The existence of such "microcrystal" proves that the directions of crystal growth were random particularly at the initial growth stage of the electroplated layer 52. The direction of crystal growth is random and furthermore growth of rough grain is prevented during the growth of the electroplated layer 52. This may be caused by one or more factors of collision(s) of base members 51, collision(s) of electroplated layers 52 formed on separate base members 51, collision(s) of base member 51 and media, or collision(s) of electroplated layer 52 and media. As a result, this may facilitate that no clear interface is formed between the base member 51 and the electroplated layer 52, and also may facilitate a distribution of grains having smaller width or smaller cross-sectional area observed in the TEM image as described above. It should be noted that the observation of grain based on the TEM image such as FIG. 24 is done for a given cross-section of grain and does not reveal 3-dimensional shape of grain. The specific shape of grain observed in the TEM image may change according to the position and condition for obtaining the TEM image.

In the present embodiment, coarse grains are not included in the electroplated layer 52 which will be otherwise included in an electroplated layer when the electroplated layer is formed through a barrel-plating. The coarse grains included in the electroplated layer when the electroplated layer is formed through a barrel-plating may have a width greater than 150 nm or 100 nm.

Again, the microcrystal can be observed in the TEM image showing the arrangement of metal atoms as shown in the TEM image of FIG. 28. The microcrystal may be formed in an initial growth region of the electroplated layer 52. The initial growth region may be a region located within 50 nm from a region showing the arrangement of metal atoms of the base member 51 in the TEM image, for example. Note that, the base member 51 of the electroplated article 5 observed in FIG. 28 is made of brass (CuZn) and the electroplated layer 52 includes tin (Sn) supplied from an electroplating solution.

FIG. 29 is a TEM image of a conventional electroplated article obtained with the same Magnification as FIG. 28. As shown in FIG. 29, it is divided into a tint region of the base member 51 at the bottom side of the TEM image and a shade region of the electroplated layer 52 at the top side of the TEM image. In the respective regions in FIG. 29, unlike the TEM image of FIG. 28, it is not possible to recognize that crystal structure changes by the interval of 5-10 nm or 5-20 nm. In the respective regions in FIG. 29, there is no big change in the depth, and therefore it is recognized that the crystal structure spreads equally and continuously.

Referring to FIG. 29, it would be possible to recognize that the arrangement of metal atoms in the base member 51 is different from the arrangement of metal atoms in the electroplated layer 52 with the interface between the base member 51 and the electroplated layer 52 in the electroplated article 5 as a boundary. Arrows added to the TEM image of FIG. 29 indicates the direction of arrangement of metal atoms. Comparing of FIGS. 28 and 29 would find that the arrangement of metal atoms in the electroplated layer 52 observed in FIG. 28 is disordered. For the conventional electroplated article observed in FIG. 29, the base member is made of brass (CuZn) and the electroplated layer 52 is made of CuSn alloy.

Hereinafter, the electroplated layer 52 of the electroplated article 5 will be discussed further from another point of view. Here will be discussed is that the crystal structure of the electroplated layer 52 grows while being affected by the crystal structure of the base member 51 according to a method of the present invention. FIG. 30 shows a result of X-ray diffraction of the same electroplated article as that of FIG. 28. In FIG. 30, waveform iw1 is a result of X-ray diffraction of electroplated layer based on in-plane measurement. Waveform iw2 is a result of X-ray diffraction of electroplated layer based on an out-of-plane measurement. PP1 to PP3 indicate diffraction peak angels based on ICDD® (International Centre for Diffraction Data) card. PP1 shows a diffraction peak angels of η-CuSn. PP2 shows a diffraction peak angels of α-CuSn. PP3 shows a diffraction peak angels of α-CuZn. In order to avoid an overlap of waveforms iw1, iw2, the waveform iw1 has been shifted upward along the vertical axis relative to the waveform iw2.

In the in-plane measurement, diffraction from a lattice plane vertical to the surface of the electroplated layer 52 is measured. On the other hand, in the out-of-plane measurement, diffraction from a lattice plane parallel to the surface of the electroplated layer 52 is measured.

This result of FIG. 30 has confirmed that, for the electroplated layer 52, diffraction peaks of η-CuSn, α-CuSn and α-CuZn exist together. It should be noted here that, CuSn of the electroplated layer 52 shows a diffraction peak at the same angle as that of CuZn of the base member 51. This indicates that the electroplated layer 52 includes α-CuSn additionally to η-CuSn, and this α-CuSn has a crystal structure that has grown to reflect the crystal structure (interplanar spacing, etc.) of α-CuZn of the base member 51. That is, it is considered that, when CuSn grain grows, it is affected by the crystal structure of CuZn at the base member 51 side. It is considered that this continuity of crystal structure facilitates that no clear interface is formed between the base member 51 and the electroplated layer 52.

FIG. 31 shows a result of X-ray diffraction of a CuSn electroplated layer formed onto a base member of brass (CuZn) using a conventional barrel-plating. In FIG. 31, waveform iw1 is a result of X-ray diffraction of electroplated layer based on in-plane measurement. Waveform iw2 is a result of X-ray diffraction of electroplated layer based on out-of-plane measurement. PP1 indicates diffraction peak angels based on ICDD® (International Centre for Diffraction Data) card. Like the PP1 in FIG. 30, PP1 shows a diffraction peak angels of η-CuSn. In the result of diffraction of FIG. 31, a diffraction peak is observed which corresponds to a diffraction peak of η-CuSn, but a diffraction peak is not observed which corresponds to a diffraction peak of α-CuSn. This is in contrast to the description on FIG. 30. It is considered that, when the electroplated layer 52 is formed onto the base member 51, the electroplated layer 52 has grown without being affected from a crystal structure at the base member 51 side.

FIG. 32 is a schematic view showing an expanded main portion in FIG. 30. In FIG. 32, G1-G4 shows diffraction peaks of the electroplated layer 52 based on in-plane measurement, and B1-B4 shows diffraction peak angles of α-CuSn identified based on ICDD® card. It has been turned out that the peak angles of the diffraction peaks G1-G4 of the electroplated layer 52 based on the in-plane measurement do not match the diffraction peak angles B1, B2, B3 and B4 of α-CuSn identified based on ICDD® card, and are shifted to a lower angle side. This shift of diffraction peak is considered to prove that α-CuSn of the electroplated layer 52 is affected by α-CuZn of the base member 51. The reasons for this is considered as follows.

Regarding the relationship of interplanar spacing and diffraction peak angle, the following formula is satisfied.

$$2d \sin \theta = n\lambda$$

where d indicates an interplanar spacing,

θ indicates diffraction peak angle,

λ indicates a wavelength, n indicates a given integer.

For the same wavelength λ, an increase of the interplanar spacing results in a decrease of the diffraction peak angle θ. It is known that the interplanar spacing of α-CuSn is less than the interplanar spacing of α-CuZn. That is, the fact that the peak angles of the diffraction peaks G1-G4 of the electroplated layer 52 based on in-plane measurement shifts to the lower angle side relative to the peak angles of the diffraction peaks B1-B4 identified based on the ICDD® card of α-CuSn indicates that the interplanar spacing of α-CuSn becomes greater than its normal value, and this phenomenon is considered to be caused due to the influence of α-CuZn of the base member 51. This is consistent with the manner in FIG. 28 where image is complicated at the interface region between the electroplated layer 52 and the base member 51 and where the directions of crystal growth are random. Furthermore, in a comparative image shown in FIG. 29, the electroplated layer 52 is simply piled regularly onto the base member 51, and this is clearly different from the electroplated layer 52 of the present invention. Comparison with this would make the reason stated here in this paragraph more persuasive. This is considered to be caused by one or more factors such as collision(s) of base members 51, collision(s) of electroplated layers 52 formed on separate base members 51, collision(s) of base member 51 and media, or collision(s) of electroplated layer 52 and media, which are unique to the method of producing according to the present disclosure.

As stated above, in the electroplated layer 52 of the present invention, the electroplated layer grows, in the initial growth stage of the electroplated layer 52, so as to have a continuity with the interplanar spacing of the crystal structure of the base member 51. It should be noted that whether the shifting is directed to a lower angle side or higher angle side would depend on the metal composition or the crystal structures of the base member 51 and the electroplated layer 52. If dare to say, the measurement result of X-ray diffraction of the electroplated layer 52 shows a diffraction peak that is shifted to the nearest diffraction peak angle side among diffraction peak angles of the base member 51, from a diffraction peak angle identified based on ICDD card of an alloy having the same composition as the alloy included in the electroplated layer 52.

The electroplated layer 52 of the electroplated article 5 according to the present disclosure includes α-CuSn which is not included in the conventional electroplated layer formed through a barrel-plating, and this α-CuSn is considered to be formed due to the influence of α-CuZn of the base member 51. That is, in some cases, a crystal structure of alloy included in the electroplated layer 52 is one that has grown while reflecting a crystal structure (an interplanar spacing etc.) of alloy included in the base member 51. As stated above, the crystal structure of CuZn of the base member 51 is a phase. A crystal structure of CuSn of the electroplated layer 52 is a phase. Accordingly, cohesion between the base member 51 and the electroplated layer 52 is enhanced, and peeling of the electroplated layer 52 is suppressed even if the electroplated layer 52 is thin.

Smartlab produced by Rigaku co. should be used as X-ray analysis apparatus. Measurement conditions is as follows.

Source of X-ray: Cu Kα

X-ray wavelength: λ=1.54186 Å

Tube voltage: 45 kV

Tube current: 200 mA

Angular range: 20-90°

Scan Speed: 3°/min

Sampling interval: 0.04°

Figure 33:
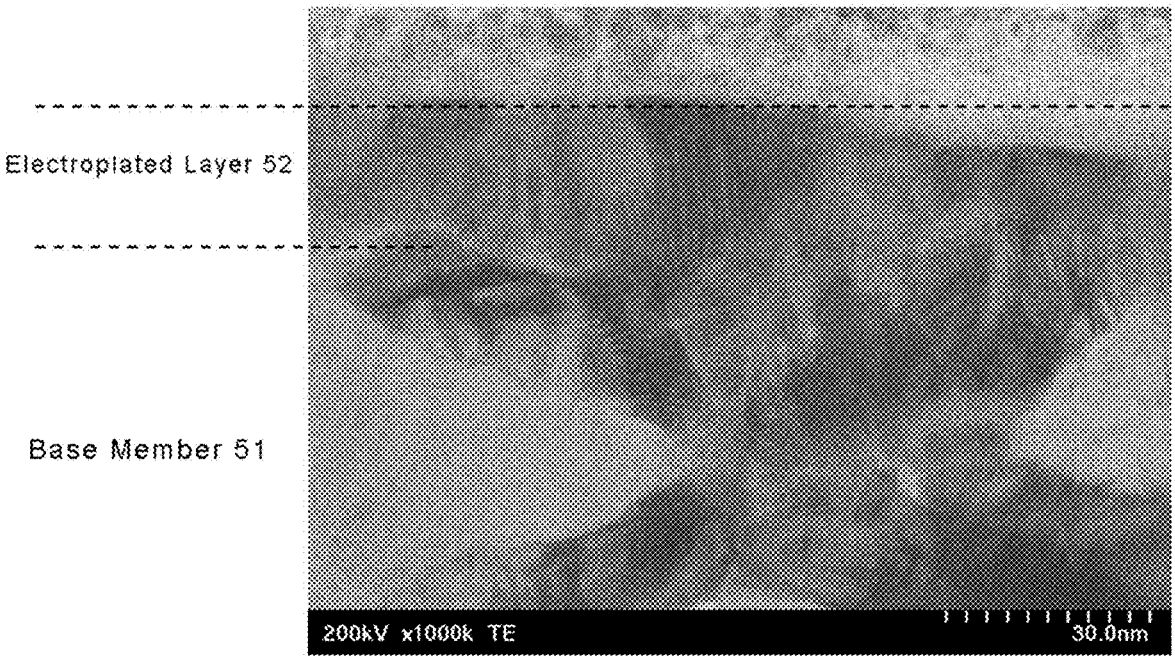
FIG. 33 is a TEM image (Magnification is 1,000,000×, and Size of field is 0.13 μm*0.09 μm), showing a cross-section of an electroplated article according to an aspect of the present disclosure.
Figure 34:
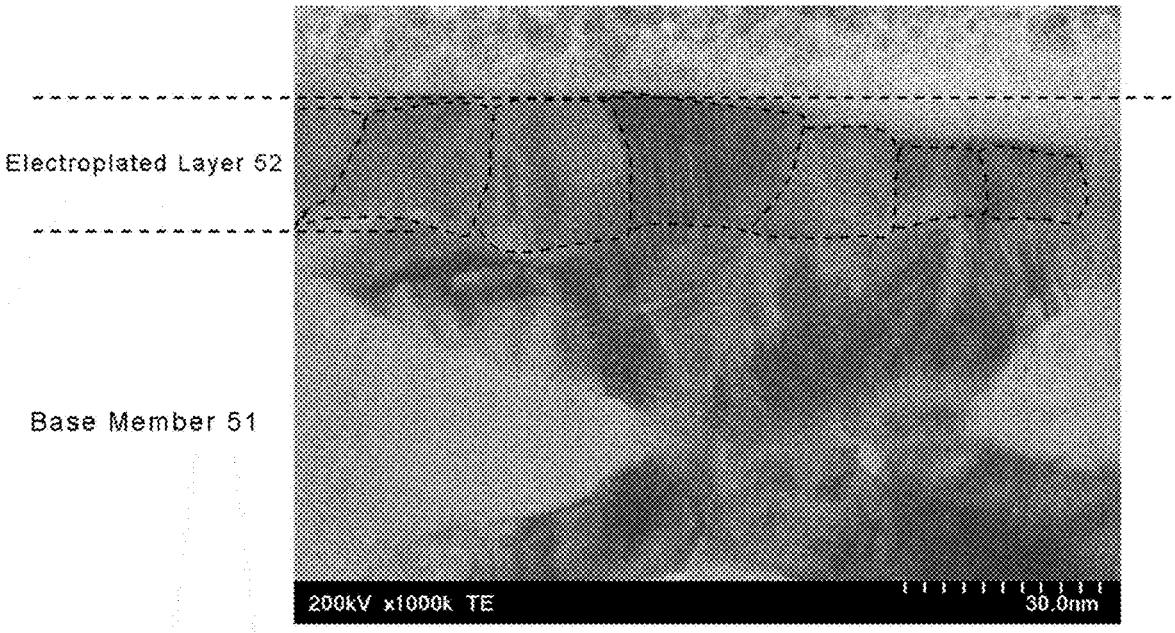
FIG. 34 is the same TEM image as FIG. 33, pointing out by dotted lines grains included in the distribution of grains in the electroplated layer.

FIG. 33 is another TEM image that shows a cross-section of an electroplated article according to an aspect of the present disclosure. FIG. 34 is the same TEM image as FIG. 33, and points out, by dotted lines, grains included in the distribution of grains in the electroplated layer. As to the electroplated article 5 observed in FIG. 33, the base member 51 is made of brass (CuZn), and the electroplated layer 52 includes tin (Sn) supplied from an electroplating solution. Interfaces between grains are not immediately apparent from FIG. 33, but they could be defined as shown in FIG. 34 based on the difference of the degree of shade (the difference of shade and tint). As to each grain, the ratio of second electroplated layer-metallic element (Cu, Zn) in the electroplated layer 52 is continuously reduced as being away from the base member 51 in the thickness direction of the electroplated layer 52. The same applies to the grains shown in FIGS. 23-24.

Figure 35:
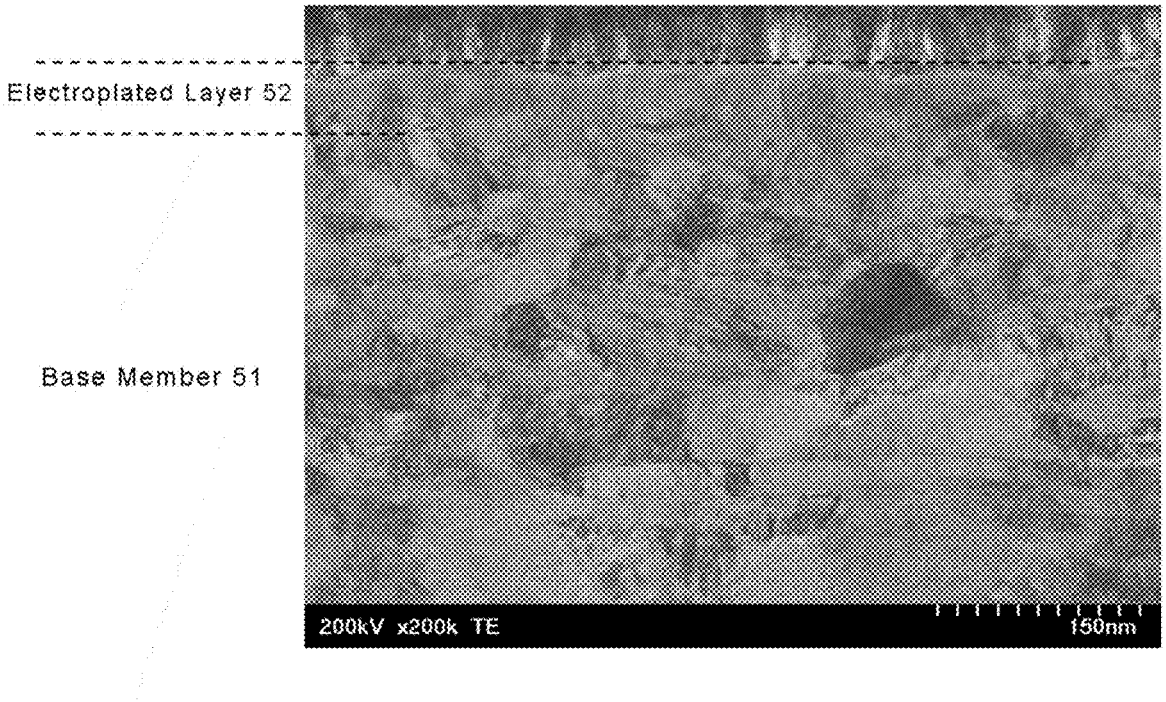
FIG. 35 is a TEM image (Magnification is 200,000×, and Size of field is 0.64 μm*0.44 μm), showing a cross-section of an electroplated article according to an aspect of the present disclosure.
Figure 36:
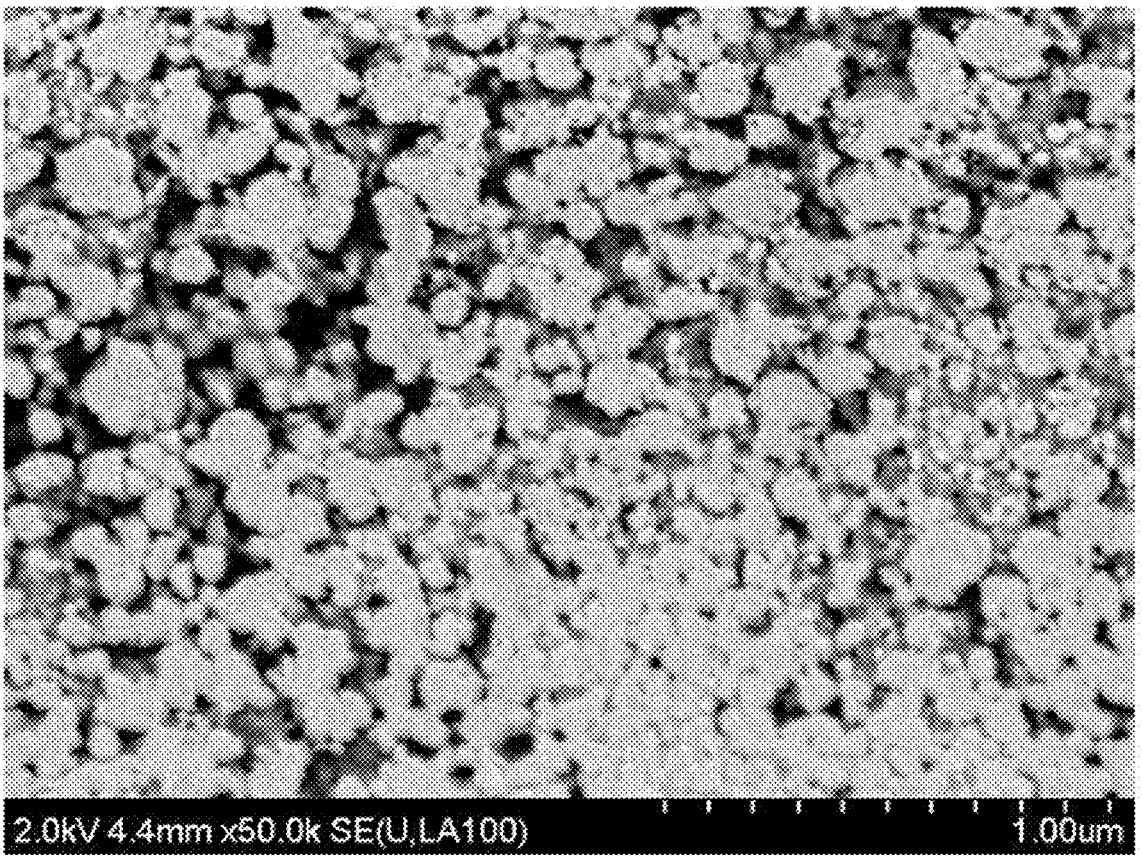
FIG. 36 is a SEM image (Magnification is 50,000×, and Size of field is 2.5 μm*1.8 μm) showing a surface of an electroplated layer of an electroplated article identical to that shown in FIG. 35.

FIG. 35 is another TEM image that shows a cross-section of an electroplated article according to an aspect of the present disclosure. FIG. 36 is a SEM image that shows the surface of the electroplated layer of the same electroplated article as that of FIG. 35. As to the electroplated article 5 observed in FIG. 35, the base member 51 is made of brass (CuZn), and the electroplated layer 52 includes tin (Sn) supplied from an electroplating solution. FIG. 37 is a TEM image showing a cross-section of a conventional electroplated article. FIG. 38 is a SEM image showing the surface of electroplated layer of the same electroplated article as that of FIG. 37. As to the electroplated article 5 observed in FIG. 37, the base member 51 is made of brass (CuZn), and the electroplated layer 52 is made of Cu and Sn.

The electroplated layer 52 of the electroplated article observed in FIG. 35 has a thickness of 50 to 80 nm. On the other hand, the electroplated layer 52 of the electroplated article 5 observed in FIG. 37 has a thickness of 150 to 180 nm. FIG. 35 is a TEM image of the electroplated article 5 produced by forming the electroplated layer 52 onto the base member 51 by using an electroplating apparatus shown in FIG. 20. On the other hand, FIG. 37 is a TEM image of the electroplated article 5 produced by forming the electroplated layer 52 onto the base member 51 by using a conventional barrel-plating.

Conditions of manufacturing the electroplated article 5 observed in FIG. 35 is as follows.

Electroplating solution: 40 liter

Weight of tin electrode immersed in the solution: 2000 g

Number of base members 51 thrown into the solution: 5000

Total weight of base members thrown into the solution: 5000 g

Total volume of magnetic media thrown into the solution: 50 cc

Rotational speed of powered motor 41: 1600 rpm

Applied Voltage: 5-10V

Time Period of electroplating: 30 minutes

Ambient temperature: Room temperature

Likewise FIG. 7, the SEM image of FIG. 36 shows that particle-like portions and/or nubby portions are formed two-dimensionally densely. The SEM image of FIG. 38 shows grains defined by polygonal boundary such as rectangle, pentagon, hexagon, and octagon. As described above, the shape of the grain observed in the TEM image does not show three-dimensional shape of grain. By referring to the SEM image of FIGS. 36 and 38, three-dimensional shape of grain can be envisioned.

As would be envisioned from comparison of FIGS. 36 and 38, in one hand the grain observed in FIG. 35 has a smaller 3D shape and, in the other hand the grain observed in FIG. 37 has a bigger 3D shape. Growth of grain may be prevented by one or more factors such as collision(s) of base members 51, collision(s) of electroplated layers 52 formed on separate base members 51, collision(s) of base member 51 and media, or collision(s) of electroplated layer 52 and media while the electroplated layer grows, thus preventing the grain from being enlarged. It is supposed that, together with the suppression of the enlargement of grains, fineness of the electroplated layer 52 may be enhanced or generation of lattice pores may be suppressed. The fineness and the ratio of lattice pores can be evaluated from density of electroplated layer 52 but, actually, there is no practical effective means for measuring it.

Noted that it has been confirmed that, when CuSn alloy or Cu electroplated layers are formed through barrel-plating, cracks or pin-holes are formed in the surface of the electroplated layer.

According to an aspect of the present disclosure, alloy grains including at least first and second electroplated layer-metallic elements are distributed in the electroplated layer 52 such that no clear interface is formed between the base member 51 and the electroplated layer 52. Accordingly, electroplated articles 5 with enhanced cohesion of base member 51 and electroplated layer 52 would be provided.

Working Example 1

Working example 1 relates to an example where magnetic media is used as described with reference to FIG. 20. An electroplating tank having a radius of 300 mm, depth of 150 mm, i.e. capacity of 40 liter was used. The electroplating tank was made of metal. A rubber sheet was attached to an inner circumference surface of a tubular portion of the electroplating tank, and a low-friction member made of polyethylene was attached to a bottom portion of the electroplating tank. An exposed portion between the rubber sheet and the low-friction member was used as a cathode. That is, a portion of the electroplating tank provides a cathode. The cathode was configured to be continuous circle in the circumstance direction. The anode was immersed in the solution in a hanged style. A copper wire was used as an anode. Stainless-steel pins were used as magnetic media. A size of one stainless-steel pin was a length of 5 mm and a diameter of 0.5 mm. Stainless-steel pins of 100 cc were added into the electroplating tank. Shells for button were used as base members. The shell was made of brass (Cu: Zn=65:35). The shell had been processed through degreasing and washing steps. An amount of thrown-in shells was 1 kg. A rotational speed of electrically powered motor was 1800 rpm. A rotational speed of solution was 30 rpm. A rotational speed of solution can be determined based on observation of a flowing pointer. A rotational speed of shells was less than 40 rpm. It was observed that substantial shells were in power-supply condition and uniform thickness of electroplated layer was formed.

Working Example 2

The same holds true as the working example 1 except that shells of 2 kg were thrown-in and stainless-steel pins of 200 cc were thrown-in. It was observed that substantial shells were in power-supply condition and uniform thickness of electroplated layer was formed.

Working Example 3

The same holds true as the working example 1 except that shells of 3 kg were thrown-in, stainless-steel pins of 250 cc were thrown-in, and direction of rotation of electrically powered motor was reversed intermittently by 30 seconds. It was observed that substantial shells were in power-supply condition and uniform thickness of electroplated layer was formed. However, a part of shells did not flow finely, and thus it was expected that color unevenness was formed in the electroplated layer, not confirmed though.

Similar result was obtained when similar experimentation was performed for sliders for slide fastener as replacement of shells.

The entire contents of two PCT applications regarding methods of producing electroplated articles (PCT Application Nos. PCT/JP2017/015365 and PCT/JP2017/017949) are herein incorporated by reference.

In the above disclosure, it has been described that the base member includes one or more base member-metallic elements, and the electroplated layer includes at least first and second electroplated layer-metallic elements. If desired or if necessary, the base member-metallic element, the first electroplated layer-metallic element and the second electroplated layer-metallic element may be referred to as a first metallic element, a second metallic element, and third metallic element alternatively. In such a case, the invention described in Claim may be redefined as shown by the following Appendix.

APPENDIX 1

An electroplated article comprising:

a base member (51) that includes one or more first metallic elements: and an electroplated layer (52) that is formed directly on the base member (51), the electroplated layer (52) including at least a second metallic element and a third metallic element that is different from the second metallic element, wherein the third metallic element is a metallic element that is identical to at least one of the one or more first metallic elements, a ratio of the third metallic element in the electroplated layer (52) is continuously decreased as being away from the base member (51) in the thickness direction of the electroplated layer (52), and alloy grains including at least the second and third metallic elements are distributed in the electroplated layer (52) such that a clear interface is not formed between the base member (51) and the electroplated layer (52).

APPENDIX 2

The electroplated article according to Appendix 1, wherein a thickness of a portion of the electroplated layer (52) where the ratio of the third metallic element is continuously decreased as being away from the base member (51) in the thickness direction of the electroplated layer (52) is equal to or greater than 10 nm or 20 nm or 60 nm.

APPENDIX 3

The electroplated article according to Appendix 1 or 2, wherein a thickness of a portion of the electroplated layer (52) where the ratio of the third metallic element is continuously decreased as being away from the base member (51) in the thickness direction of the electroplated layer (52) is equal to or less than 80 nm or 60 nm or 30 nm or 20 nm.

APPENDIX 4

The electroplated article according to any one of Appendixes 1 to 3, wherein a ratio of the second metallic element at a surface of the electroplated layer (52) is less than 100% or 90%.

APPENDIX 5

The electroplated article according to any one of Appendixes 1 to 4, wherein a thickness of the electroplated layer (52) is equal to or less than 150 nm or 100 nm.

APPENDIX 6

The electroplated article according to any one of Appendixes 1 to 5, wherein the electroplated layer (52) has an opposite surface (52*s*) that is opposite to the base member (51), and wherein decrease of the ratio of the third metallic element in the electroplated layer (52) continues up to the opposite surface (52*s*) or to proximity of the opposite surface (52*s*) in the thickness direction of the electroplated layer (52).

APPENDIX 7

The electroplated article according to any one of Appendixes 1 to 6, wherein the base member (51) includes a plurality of the first metallic elements, and the electroplated layer (52) includes a plurality of third metallic elements, and wherein ratio of each third metallic element in the electroplated layer (52) is continuously decreased as being away from the base member (51) in the thickness direction of the electroplated layer (52).

APPENDIX 8

The electroplated article according to any one of Appendixes 1 to 7, wherein a ratio of the second metallic element in the electroplated layer (52) is decreased as being closer to the base member (51) in the thickness direction of the electroplated layer (52).

APPENDIX 9

The electroplated article according to any one of Appendixes 1 to 8, wherein the base member (51) is a metal or an alloy at least including copper as the first metallic element.

APPENDIX 10

The electroplated article according to any one of Appendixes 1 to 9, wherein the electroplated layer (52) is a metal or an alloy at least including tin as the second metallic element.

APPENDIX 11

The electroplated article according to any one of Appendixes 1 to 10, wherein the electroplated layer (52) has an opposite surface (52*s*) that is opposite to the base member (51), and wherein particle-like portions and/or nubby portions are two-dimensionally densely formed in the opposite surface (52*s*).

APPENDIX 12

The electroplated article according to any one of Appendixes 1 to 11, wherein the electroplated article (5) is at least a part of a costumery part (7).

In the above disclosure, it has been described that the feature of "a ratio of the second electroplated layer-metallic element in the electroplated layer is continuously decreased as being away from the base member in the thickness direction of the electroplated layer and a clear interface does not exist between the base member and the electroplated layer" has been described as one of some key features. However, it should be noted that this key feature is not superior to or is not a premise of other features. For example, the following inventions could be understandable.

APPENDIX 13

An electroplated article comprising:

a base member (51); and an electroplated layer (52) that is formed directly on the base member (51), wherein the electroplated layer (52) has an opposite surface (52*s*) that is positioned opposite to the base member (51), and particle-like portions and/or nubby portions are two-dimensionally densely formed in the opposite surface (52*s*).

APPENDIX 14

The electroplated article of Appendix 13, wherein there is substantially no crack or pin-hole in the opposite surface (52*s*).

APPENDIX 15

The electroplated article of Appendix 13 or 14, wherein the base member (51) includes one or more base member-metallic elements, the electroplated layer (52) includes at least a first electroplated layer-metallic element and a second electroplated layer-metallic element that is different from the first electroplated layer-metallic element, the second electroplated layer-metallic element is a metallic element that is identical to at least one of the one or more base member-metallic elements, and a ratio of the second electroplated layer-metallic element in the electroplated layer (52) is continuously decreased as being away from the base member (51) in the thickness direction of the electroplated layer (52) and/or a clear interface does not exist between the base member (51) and the electroplated layer (52).

APPENDIX 16

The electroplated article of any one of Appendixes 13 to 15, wherein grain defined by a polygonal boundary does not appear in the opposite surface (52*s*).

Given the above teachings, a skilled person in the art would be able to add various modifications to the respective embodiments. Reference codes in Claims are just for reference and should not be referenced for purposes of narrowly construing the scope of claims.

REFERENCE SIGNS LIST

5 Electroplated article
51 Base member
52 Electroplated layer

The invention claimed is:

1. An electroplated article comprising:

a base member that includes one or more base member-metallic elements; and an electroplated layer that is formed directly on the base member, the electroplated layer including at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, a ratio of the second electroplated layer-metallic element in the electroplated layer is continuously decreased as being away from the base member in a thickness direction of the electroplated layer, and a plurality of alloy grains including at least the first and second electroplated layer-metallic elements are distributed in the electroplated layer such that the base member and the electroplated layer appear continuous in a first TEM (Transmission Electron Microscope) image with a magnification of 200,000, and wherein at least one of following conditions is satisfied;

(a) the electroplated layer includes a region where the alloy grains, each having a width equal to or less than 100 nm are formed; and (b) an average area of the alloy grains is equal to or less than 1000 $nm^2$, wherein an average area of each alloy grain is determined as a value of half an area of a rectangular frame applied around a respective alloy grain observable in a second TEM image with a magnification of 1,000,000.

2. The electroplated article according to claim 1, wherein the electroplated layer includes at least one alloy grain that has a width equal to or less than 25 nm.

3. The electroplated article according to claim 2, wherein (i) the at least one alloy grain has a width equal to or less than 25 nm is observable in the second TEM image in which an arrangement of metal atoms is observable or (ii) the at least one alloy grain has a width equal to or less than 25 nm is formed in an initial growth region in the electroplated layer.

4. The electroplated article according to claim 3, wherein the initial growth region is a region located within 50 nm from a region that shows an arrangement of metal atoms of the base member in the second TEM image.

5. The electroplated article according to claim 1, wherein the average area of the alloy grains calculated in said (b) is equal to or less than 500 $nm^2$.

6. The electroplated article according to claim 1, wherein a maximum area of the alloy grains calculated in said (b) is equal to or less than 700 $nm^2$.

7. The electroplated article according to claim 1, wherein the electroplated layer does not include coarse grains, said coarse grains having a width greater than 100 nm.

8. The electroplated article according to claim 1, wherein the electroplated layer does not include coarse grains, said coarse grains having a width greater than 150 nm.

9. The electroplated article according to claim 1, wherein a result of X-ray diffraction of the electroplated layer shows a diffraction peak shifted from a diffraction peak angle identified based on ICDD card of an alloy having the same composition as the alloy included in the electroplated layer.

10. The electroplated article according to claim 1, wherein (i) a thickness of a portion of the electroplated layer where the ratio of the second electroplated layer-metallic element is continuously decreased as being away from the base member in the thickness direction of the electroplated layer is equal to or greater than 10 nm or (ii) a thickness of a portion of the electroplated layer where the ratio of the second electroplated layer-metallic element is continuously decreased as being away from the base member in the thickness direction of the electroplated layer is equal to or less than 80 nm.

11. The electroplated article according to claim 1, wherein a ratio of the first electroplated layer-metallic element at a surface of the electroplated layer is less than 100%.

12. The electroplated article according to claim 1, wherein a thickness of the electroplated layer is equal to or less than 150 nm.

13. The electroplated article according to claim 1, wherein the electroplated layer has an opposite surface that is opposite to the base member, and wherein decrease of the ratio of the second electroplated layer-metallic element in the electroplated layer continues up to the opposite surface or to proximity of the opposite surface in the thickness direction of the electroplated layer.

14. The electroplated article according to claim 1, wherein the base member includes a plurality of base member-metallic elements, and the electroplated layer includes a plurality of second electroplated layer-metallic elements, and wherein ratio of each second electroplated layer-metallic element in the electroplated layer is continuously decreased as being away from the base member in the thickness direction of the electroplated layer.

15. The electroplated article according to claim 1, wherein a ratio of the first electroplated layer-metallic element in the electroplated layer is decreased as being closer to the base member in the thickness direction of the electroplated layer.

16. The electroplated article according to claim 1, wherein (i) the base member is a metal or an alloy at least including copper as the base member-metallic element or (ii) the electroplated layer is a metal or an alloy at least including tin as the first electroplated layer-metallic element.

17. A method of manufacturing electroplated articles comprising:

supplying, into an electroplating tank, base members each of which including one or more base member-metallic elements; and flowing the base members in a circumference direction and electroplating the base members in the electroplating tank so that an electroplated layer is formed directly on the base member, the electroplated layer including at least a first electroplated layer-metallic element and a second electroplated layer-metallic element that is different from the first electroplated layer-metallic element, wherein the second electroplated layer-metallic element is a metallic element that is identical to at least one of the one or more base member-metallic elements, a ratio of the second electroplated layer-metallic element in the electroplated layer is continuously decreased as being away from the base member in a thickness direction of the electroplated layer, and a plurality of alloy grains including at least the first and second electroplated layer-metallic elements are distributed in the electroplated layer such that the base member and the electroplated layer appear continuous in a first TEM (Transmission Electron Microscope) image with a magnification of 200,000, and wherein at least one of following conditions is satisfied;

(a) the electroplated layer includes a region where the alloy grains, each have a width equal to or less than 100 nm; and (b) an average area of the alloy grains is equal to or less than 1000 $nm^2$, wherein an average area of each alloy grain is determined as a value of half an area of a rectangular frame applied around a respective alloy grain observable in a second TEM image with a magnification of 1,000,000.

* * * * *